US008526652B2

(12) United States Patent
Ambrose et al.

(10) Patent No.: US 8,526,652 B2
(45) **Date of Patent: *Sep. 3, 2013**

(54) RECEIVER ASSEMBLY FOR AN INFLATABLE EAR DEVICE

(75) Inventors: Stephen D. Ambrose, Longmont, CO (US); Samuel P. Gido, Hadley, MA (US); Robert B. Schulein, Schaumburg, IL (US); Paul Christiaan Van Hal, Amsterdam (NL); Adrianus M. Lafort, Delft (NL)

(73) Assignee: Sonion Nederland BV, Hoofddorp (NL)

( * ) Notice: Subject to any disclaimer, the term of this patent is extended or adjusted under 35 U.S.C. 154(b) by 129 days.

This patent is subject to a terminal disclaimer.

(21) Appl. No.: 13/025,391

(22) Filed: Feb. 11, 2011
(Under 37 CFR 1.47)

(65) Prior Publication Data

US 2011/0311069 A1 Dec. 22, 2011

Related U.S. Application Data

(62) Division of application No. 12/777,001, filed on May 10, 2010.

(60) Provisional application No. 61/233,465, filed on Aug. 12, 2009, provisional application No. 61/242,315, filed on Sep. 14, 2009, provisional application No. 61/253,843, filed on Oct. 21, 2009, provisional application No. 61/297,976, filed on Jan. 25, 2010.

(51) Int. Cl.
*H04R 25/00* (2006.01)

(52) U.S. Cl.
USPC ..... 381/328; 381/322

(58) Field of Classification Search
USPC ..... 381/328, 380; 181/130–135
See application file for complete search history.

(56) References Cited

U.S. PATENT DOCUMENTS

| | | | | |
|---|---|---|---|---|
| 2,876,767 | A | 3/1959 | Wasserman | |
| 2,896,491 | A * | 7/1959 | Lover | 84/725 |
| 4,009,707 | A | 3/1977 | Ward | |

(Continued)

FOREIGN PATENT DOCUMENTS

| | | | |
|---|---|---|---|
| DE | 2825233 | A1 | 1/1979 |
| EP | 0383483 | A1 | 8/1990 |

(Continued)

OTHER PUBLICATIONS

International Search Report for PCT/US2010/034237, issued Dec. 23, 2010.

(Continued)

*Primary Examiner* — Curtis Kuntz
*Assistant Examiner* — David J Ho
(74) *Attorney, Agent, or Firm* — Nixon Peabody LLP

(57) ABSTRACT

A diaphonic valve utilizing the principle of the Synthetic Jet is disclosed herein. A diaphonic valve pump is provided for the inflation of an in-ear balloon. More complex embodiments of the present invention include stacks of multiple synthetic jets generating orifices as well as an oscillating, thin polymer membrane. In one or more embodiments of the present invention, a novel application is provided for the creation of static pressure to inflate or to deflate an inflatable member (balloon). In addition, sound can be utilized to inflate or deflate an inflatable member in a person's ear for the purpose of listening to sound.

23 Claims, 58 Drawing Sheets

(56) References Cited

U.S. PATENT DOCUMENTS

| | | | | |
|---|---|---|---|---|
| 4,133,984 | A | 1/1979 | Akiyama | |
| 4,539,440 | A | 9/1985 | Sciarra | |
| 4,834,211 | A | 5/1989 | Bibby et al. | |
| 4,852,177 | A | 7/1989 | Ambrose | |
| 5,333,622 | A | 8/1994 | Casali et al. | |
| 5,338,287 | A | 8/1994 | Miller et al. | |
| 5,500,902 | A | 3/1996 | Stockham et al. | |
| 6,094,494 | A | 7/2000 | Haroldson | |
| 6,339,648 | B1 | 1/2002 | McIntosh et al. | |
| 6,354,990 | B1 | 3/2002 | Juneau et al. | |
| 6,438,244 | B1 | 8/2002 | Juneau et al. | |
| 6,671,381 | B1 | 12/2003 | Lux-Wellenhof | |
| 6,901,288 | B2 | 5/2005 | Janke et al. | |
| 7,227,968 | B2 | 6/2007 | van Halteren et al. | |
| 7,292,704 | B2 | 11/2007 | Lederer | |
| 7,425,196 | B2 | 9/2008 | Jorgensen et al. | |
| 7,861,723 | B2 * | 1/2011 | Dedrick et al. | 128/848 |
| 2001/0043708 | A1 | 11/2001 | Brimhall | |
| 2002/0076057 | A1 | 6/2002 | Voix | |
| 2002/0114479 | A1 | 8/2002 | McIntoch et al. | |
| 2002/0136421 | A1 | 9/2002 | Topholm | |
| 2002/0196958 | A1 | 12/2002 | Halteren et al. | |
| 2004/0215053 | A1 | 10/2004 | Jorgensen et al. | |
| 2007/0116319 | A1 | 5/2007 | Hagberg | |
| 2007/0270988 | A1 | 11/2007 | Goldstein et al. | |
| 2008/0015463 | A1 | 1/2008 | Goldstein | |
| 2008/0031475 | A1 | 2/2008 | Goldstein | |
| 2008/0037797 | A1 | 2/2008 | Goldstein et al. | |
| 2008/0137873 | A1 | 6/2008 | Goldstein | |
| 2008/0144842 | A1 | 6/2008 | Goldstein et al. | |
| 2008/0181419 | A1 | 7/2008 | Goldstein et al. | |
| 2008/0181442 | A1 | 7/2008 | Goldstein | |
| 2008/0187163 | A1 | 8/2008 | Goldstein et al. | |
| 2008/0212787 | A1 | 9/2008 | Goldstein et al. | |
| 2008/0219486 | A1 | 9/2008 | Goldstein et al. | |
| 2008/0240458 | A1 | 10/2008 | Goldstein | |
| 2008/0253583 | A1 | 10/2008 | Goldstein et al. | |
| 2008/0299339 | A1 | 12/2008 | Keady | |
| 2008/0311324 | A1 | 12/2008 | Keady | |
| 2009/0007596 | A1 | 1/2009 | Goldstein et al. | |
| 2009/0010442 | A1 | 1/2009 | Usher et al. | |
| 2009/0012420 | A1 | 1/2009 | Keller | |
| 2009/0014014 | A1 | 1/2009 | Roos et al. | |
| 2009/0022294 | A1 | 1/2009 | Goldstein et al. | |
| 2009/0022353 | A1 | 1/2009 | Goldstein et al. | |
| 2009/0028356 | A1 | 1/2009 | Ambrose et al. | |
| 2009/0034765 | A1 | 2/2009 | Boillot et al. | |
| 2009/0067661 | A1 | 3/2009 | Keady et al. | |
| 2009/0071486 | A1 | 3/2009 | Perez et al. | |
| 2009/0071487 | A1 | 3/2009 | Keady | |
| 2009/0130423 | A1 | 5/2009 | Keady | |
| 2009/0147966 | A1 | 6/2009 | McIntosh et al. | |
| 2009/0155518 | A1 | 6/2009 | Keady | |
| 2009/0192407 | A1 | 7/2009 | Keady et al. | |
| 2009/0232684 | A1 | 9/2009 | Hirata et al. | |
| 2010/0002897 | A1 * | 1/2010 | Keady | 381/328 |
| 2011/0182453 | A1 * | 7/2011 | Van Hal et al. | 381/328 |

FOREIGN PATENT DOCUMENTS

| | | | |
|---|---|---|---|
| EP | 0755168 | A2 | 1/1997 |
| EP | 01272003 | A1 | 1/2003 |
| GB | 2323295 | A | 9/1998 |
| JP | 52019905 | | 2/1977 |
| JP | 53147526 | A | 12/1978 |
| JP | 55047713 | A | 4/1980 |
| JP | 61238198 | A | 10/1986 |
| JP | 01101794 | A | 4/1989 |
| JP | 06335473 | A | 12/1994 |
| KR | 10-1990-0013806 | A | 9/1990 |
| WO | 86/01399 | | 3/1986 |
| WO | 99/31934 | | 6/1999 |
| WO | 99/31935 | | 6/1999 |
| WO | 00/08895 | | 2/2000 |
| WO | 01/00267 | A1 | 1/2001 |
| WO | 02/082788 | A1 | 10/2002 |
| WO | 03/005765 | A2 | 1/2003 |
| WO | 2009/015210 | A2 | 1/2009 |
| WO | 2009/055347 | A2 | 4/2009 |

OTHER PUBLICATIONS

O'Brien et al.; "Evaluation of Acoustic Propagation Paths into the Human Head"; *New Directions for Improving Audio Effectiveness*; pp. 15-1-15-24; 2005.

Zwislocki; "Factors Determining the Sound Attenuation Produced by Earphone Sockets"; *The Journal of the Acoustical Society of America*; vol. 1; No. 1; pp. 146-54; 1955.

Zwislocki, "In Search of the Bone-Conduction Threshold in a Free Sound Field," *The Journal of the Acoustical Society of America*; vol. 29; No. 7; pp. 795-804; 1957.

Staudinger et al.; "Mechanical Properties and Hysteresis Behavior of Multigraft Copolymers"; *Macromolecular Symposia*; 233, pp. 42-50; 2006.

Zhu et al.; "Morphology and Tensile Properties of Multigraft Copolymers With Regularly Spaced Tri-, Tetra-, and Hexafunctional Junction Points"; *Macromolecules*; 39; pp. 4428-4436; 2006.

Compton; "Notes on the Diaphone"; *The Organ*; vol. 3; No. 9; pp. 42-47; 1923.

Mays et al.; "Synthesis and Structure—Property Relationships for Regular Multigraft Copolymers"; *Macromolecular Symposia*; 215; pp. 111-26; 2004.

Weidisch et al.; "Tetrafunctional Multigraft Copolymers as Novel Thermoplastic Elastomers"; *Macromolecules*; 34, pp. 6333-6337; 2001.

"Sound Fit™ In—Canal Sound Delivery and Custom Fit Sleeve for Bluetooth™ Headsets", http://ctiait.ctia.org/eTechw2009pubiic/index.cfm? fuseaction=main. viewEntry&productID=692 &start=1 &subCat=5&scoreStatus=all&ct=1[Mar. 30, 2009 12:41:13PM] E-Tech Awards 2009 Public Site 2009.

Tiku; "When his bank cut the cord, Kevin Semcken faced a tough choice; Stick to his own big plans? Or listen to his board and play it safe?"; *Inc.*; pp. 58-61; Jul./Aug. 2009.

Data Sheet RoHS 2002/95/EC receiver 44A030; 3 pages; Aug. 7, 2009.

Luo et al.; "Sensors and Actuators A 122"; pp. 131-140; 2005.

* cited by examiner

REFLECTIVE SOURCE OF DIMENSIONS (ANSVEC)

| | |
|---|---|
| NOMINAL VOLTAGE: | 1 = V |
| RATED CAPACITY: | 90 mAh AT 3000 OHM TO 1.1V AT 21°C (70°F) |
| NOMINAL INTERNAL IMPEDANCE: | 14 ohm @ 12 Mz |
| AVERAGE WEIGHT: | 0.3 gm |
| VOLUME: | 0.06 $cm^3$ |
| TERMINALS: | FLAT |
| OPERATING TEMPERATURE RANGE: | 0°C TO 50°C (32°F TO 122°F) |
| ANST. IEC. | 7005 ZO PR70 |

TYPICAL DISCHARGE CHARACTERISTICS AT 21°C (70°F)

AUTO INSERTION/PROTECTION MECHANISM FOR THE DIAPHONIC EAR LENS

RECEIVER ASSEMBLY FOR AN INFLATABLE EAR DEVICE

CROSS REFERENCE TO RELATED APPLICATIONS

This application is a divisional of prior U.S. application Ser. No. 12/777,001, filed May 10, 2010, which claims the benefit of U.S. Provisional Application No. 61/233,465, filed Aug. 12, 2009, U.S. Provisional Application No. 61/242,315, filed Sep. 14, 2009, U.S. Provisional Application No. 61/253,843, filed Oct. 21, 2009, and U.S. Provisional Application No. 61/297,976, filed Jan. 25, 2010, each of which is incorporated by reference in its entirety.

FIELD OF THE INVENTION

The present device and methods relate to the structure, operation and manufacture of fluid pumps and the utilization of their output such as in an insertable sound transmission instrument for a user's ear. Specifically, the device and methods relate to such an instrument which can be coupled with any number of electronic sound devices, such as a hearing aid, MP3 player, Bluetooth® device, phone, and the like, while providing improved comfort and control to the user.

BACKGROUND OF THE INVENTION

The use of headphones for private listening of an audio device, such as a phone, telegraph or the like, began back as early as the 1900's. The original devices provided very poor sound quality and even less comfort to the user. Such devices have come a long way in the last 20 years with noise-reduction, sound control, feedback control and comfort features as well. However, the prior art has typically taken the "one-size-fits-all" approach to function and comfort and has been unable to offer an in-ear device which is individually customizable for a particular user. The present device addresses this oversight in the prior art by providing an in-ear device which is adjustable to comfortably fit each user, while providing full rich sound quality.

U.S. Patent Publication No. 2009/0028356 A1 (the '356 application), published on Jan. 29, 2009, discloses an in-ear, inflatable, diaphonic member (bubble), for the coupling of sound to the ear, wherein a source of static and active pressure is utilized to inflate the bubble and to keep it inflated. As part of this invention disclosure, a diaphonic valve is described that can convert oscillating sound pressure into static pressure to inflate the bubble in the user's ear. This is accomplished while still passing the sound of the program material (music, voice, etc.) through the valve, into the bubble and thus into the ear, with a minimum of attenuation or distortion. Thus a speaker or acoustical driver of the type used in hearing aids, mp3 player ear buds, or professional in ear monitors may be used to generate static pressures to inflate the diaphonic member (bubble), in addition to playing the program material. The diaphonic valve of the '356 application uses a flat valve design where oscillating sound waves cause oscillations in thin elastic membranes, thus opening and closing ports to harvest the positive pressure, pushing cycles of the speaker and venting in outside air during the negative pressure, pulling cycles of the speaker. Embodiments of the present invention supplement the inventive pumping methods which utilize sound energy to both actively inflate and deflate a diaphonic bubble in a user's ear.

Sound waves generate a sound pressure level and transmit mechanical energy. However, the periodic reversal of the sound pressure, due to the oscillatory nature of the sound waves, makes it difficult to harness sound pressure in the form of the type of static pressure necessary to do $P\Delta V$ work (where P is an applied pressure and $\Delta V$ is a change in volume). An example of $P\Delta V$ work is the inflation of a balloon. Unfortunately, the sound pressure waves pull as much as they push in every wave cycle, resulting in no net pressure for balloon inflation.

Accordingly, it is desirable to achieve design improvements in the diaphonic valve, which harvests static (analog to DC) pressure from alternating (analog to AC) sound pressure waves. The diaphonic valve may be thought of as a fluid pump which uses sound as its energy source, or alternatively it is analogous to an electronic rectifier that converts alternating electrical current (AC) into direct electrical current (DC). In the present device, the diaphonic valve includes such changes as a reduction in the number of moving parts, increased simplicity of design and manufacture, and greater pressure generating capacity.

A synthetic jet is another featured improvement of the present device. A synthetic jet occurs when a fluid (a liquid or gas) is alternately pushed and pulled through a small orifice. As shown in FIG. 1A, when the fluid is pushed out through the orifice it exits as a narrow, directed jet, which is expelled directly away from the surface containing the orifice. On the pulling stroke, as shown in FIG. 1B, when the fluid is pulled back through the same orifice, the flow field is much different: like fluid going down a drain it enters the orifice mainly from the sides. Even when the amount of fluid pushed and pulled through the orifice on each alternating cycle is the same (and thus there is no net flow of material through the orifice) the asymmetry in the flow fields caused by the push cycle (FIG. 1A) and the pull cycle (FIG. 1B) result in a net flow of fluid away from the face of the surface containing the orifice. At a distance beyond the surface equal to a large number of orifice diameters, the synthetic jet produces a near-continuous jet or motion of fluid, which is difficult to distinguish from a conventional jet such as a hose expelling liquid or gas under a pressure driving force.

Luo and Xia have recently described the design of a "valveless synthetic-jet-based micro-pump" [Z. Luo and Z. Xia Sensors and Actuators A 122 (2005) 131-140]. A schematic of their device, reproduced from their publication, is shown in FIGS. 2A and 2B. The Luo and Xia pump design was not contemplated for the present, in-ear application, and by its structure could not be of utility in the present invention.

The present invention relates to fluid pumps and the utilization of their output. Also, the present invention addresses and solves numerous problems and provides uncountable improvements in the area of earphone devices and manufacturing methods of the same. Solutions to other problems associated with prior earphone devices, whether the intended use is to be in conjunction with hearing aids, MP3 players, mobile phones, or other similar devices, may be achieved by the present devices.

SUMMARY OF THE INVENTION

There is disclosed herein an improved fluid pump and the utilization of its output such as in an audio receiver device for in-ear placement of a user which avoids the disadvantages of prior devices while affording additional structural and operating advantages.

Generally speaking, an invention of the present application provides for converting acoustical vibrations, such as sound, into static pressure. This can be accomplished by an inventive pump that transports air or another fluid and pressurizes the air or the other fluid using acoustical vibrations as its power source. The pressurized fluid can be used for inflating a bubble within an ear or for many other useful applications. Moreover, the diaphonic valve described herein can include sound driven micropumps for microfluidic and MEMS devices, such as chip based medical diagnostic tests or devices.

Also, generally speaking, a closed system is provided around or over an orifice through which a synthetic jet expels its jet of fluid. This closed system, such as a bubble on one side of the orifice and an enclosed space (e.g., a transducer housing) on the other side of the orifice, can contain fluid pumped by the device and also contain the static pressure that the device generates. In providing the fluid pumped by the device, an ingress tube or ingress port can supply the source fluid to the synthetic jet, at or near the edge of the synthetic jet orifice. The other end of the ingress tube can be located outside the closed system into which the synthetic jet expels its jet of fluid.

Further, generally speaking, an invention of the present application, numerously embodied in countless combinations of components, is comprised of an electronic signal generator, an acoustical driver, a sound actuated pump, and an inflatable member.

It is an aspect of the present invention to provide a design and construction for pumping devices that use acoustical energy (sound) to produce air pressure for the inflation, and possible deflation, of a sealing device in the user's ear.

In an embodiment, an improved design for a diaphonic valve utilizes the principle of the Synthetic Jet. A synthetic jet is produced when a fluid is alternately pushed and then pulled back through a small orifice. This is frequently done using alternating pressure waves in the form of sound. Although there is no net mass transfer through the orifice, the asymmetry between the outward jet of fluid produced on the pushing strokes relative to the flow pattern of the fluid sucking on the pulling strokes, produces a net transfer of fluid from the edges of the exterior of the orifice to a sustained fluid jet in front of the orifice. A great deal of experimental and theoretical work has gone into understanding and modeling the operation of the Synthetic Jet.

In an embodiment of the present invention, a diaphonic valve pump is provided for the inflation of an in-ear balloon. More complex embodiments of the present invention include stacks of multiple synthetic jet generating orifices as well as an oscillating, thin polymer membrane. In one or more embodiments of the present invention, a novel application is provided for the creation of static pressure to inflate or to deflate an inflatable member (balloon). In addition, sound can be utilized to inflate or deflate an inflatable member in a person's ear for the purpose of listening to sound.

In an embodiment of the present invention, the design, fabrication and working mechanism of a diaphonic (sound driven) pumping device is also disclosed. This device works in conjunction with an existing balanced armature sound transducer, of the type currently used in hearing aids and high end audio ear pieces. Alternatively, this device can also work in conjunction with an existing moving coil speakers of the type currently used in headphones, headsets and ear buds. The inventive device acts both as an air pump to inflate an inflatable member in the listener's ear, and also allows the transducer to perform its conventional function of playing audio material. The inflatable member (bubble or balloon), when inflated by the inventive diaphonic pump, produces a comfortable, adjustable and variable ear seal and works with the ear canal to produce a variable volume resonant chamber for safe, comfortable, rich sounding and high fidelity reproduction of audio.

These and other aspects of the invention may be understood more readily from the following description and the appended drawings.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated. The components in the drawings are not necessarily to scale, emphasis instead being placed upon illustrating the principles of the invention. In the following description and throughout the numerous drawings, like reference numbers are used to designate corresponding parts.

DETAILED DESCRIPTION OF THE INVENTION

Figure 1A:
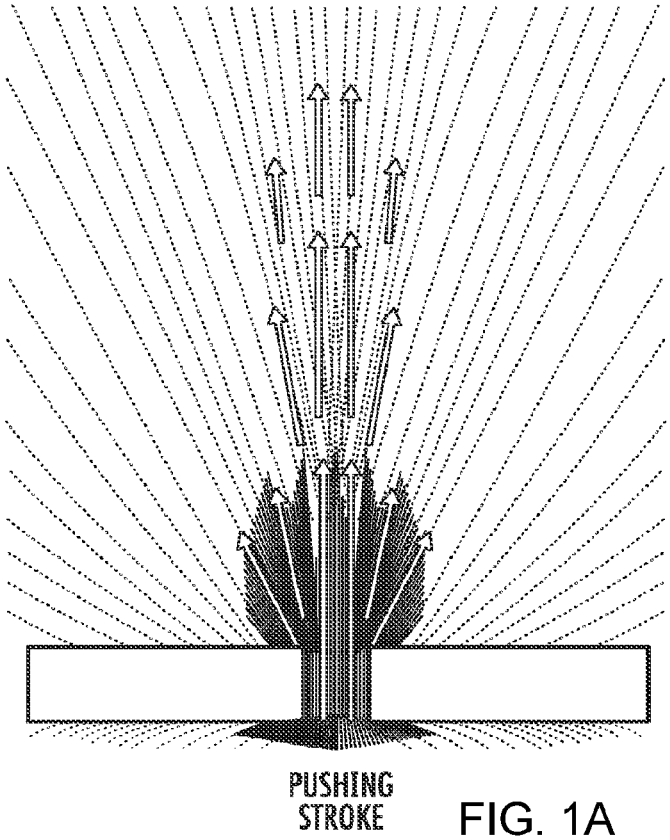
FIGS. 1A and 1B depict the working principle of a synthetic jet.
Figure 1B:
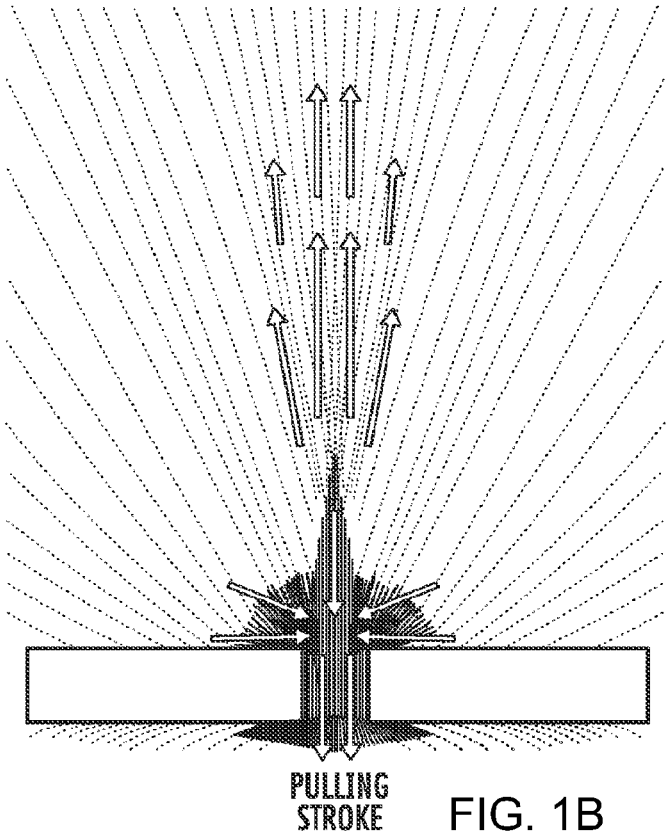
Figure 2A:
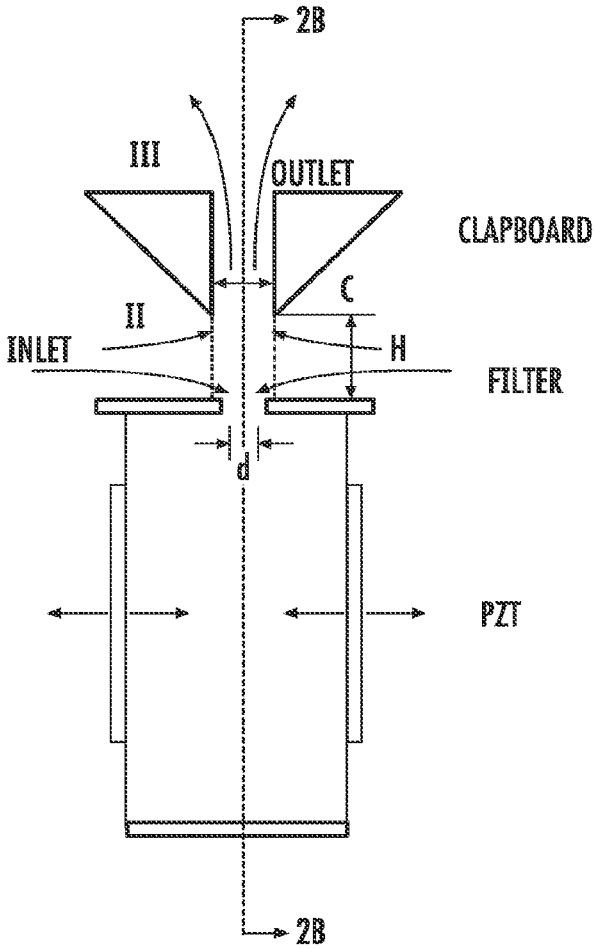
FIGS. 2A and 2B depict a known synthetic jet based pump design.
Figure 2B:
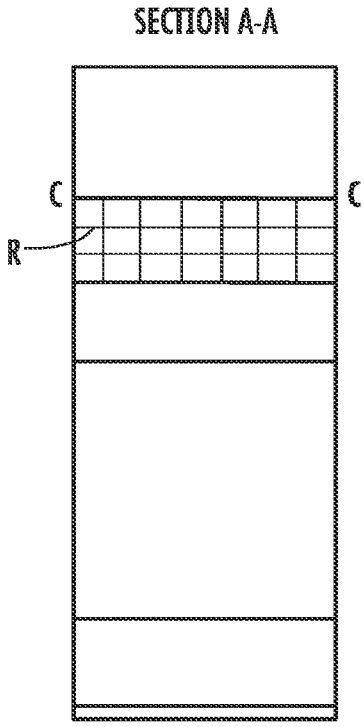

While this invention is susceptible of embodiment in many different forms, there is shown in the drawings, and will herein be described in detail, preferred embodiments of the invention, including embodiments of the various components of the invention, with the understanding that the present disclosure is to be considered as an exemplification of the principles of the invention and is not intended to limit the broad aspect of the invention to embodiments illustrated.

Figure 3:
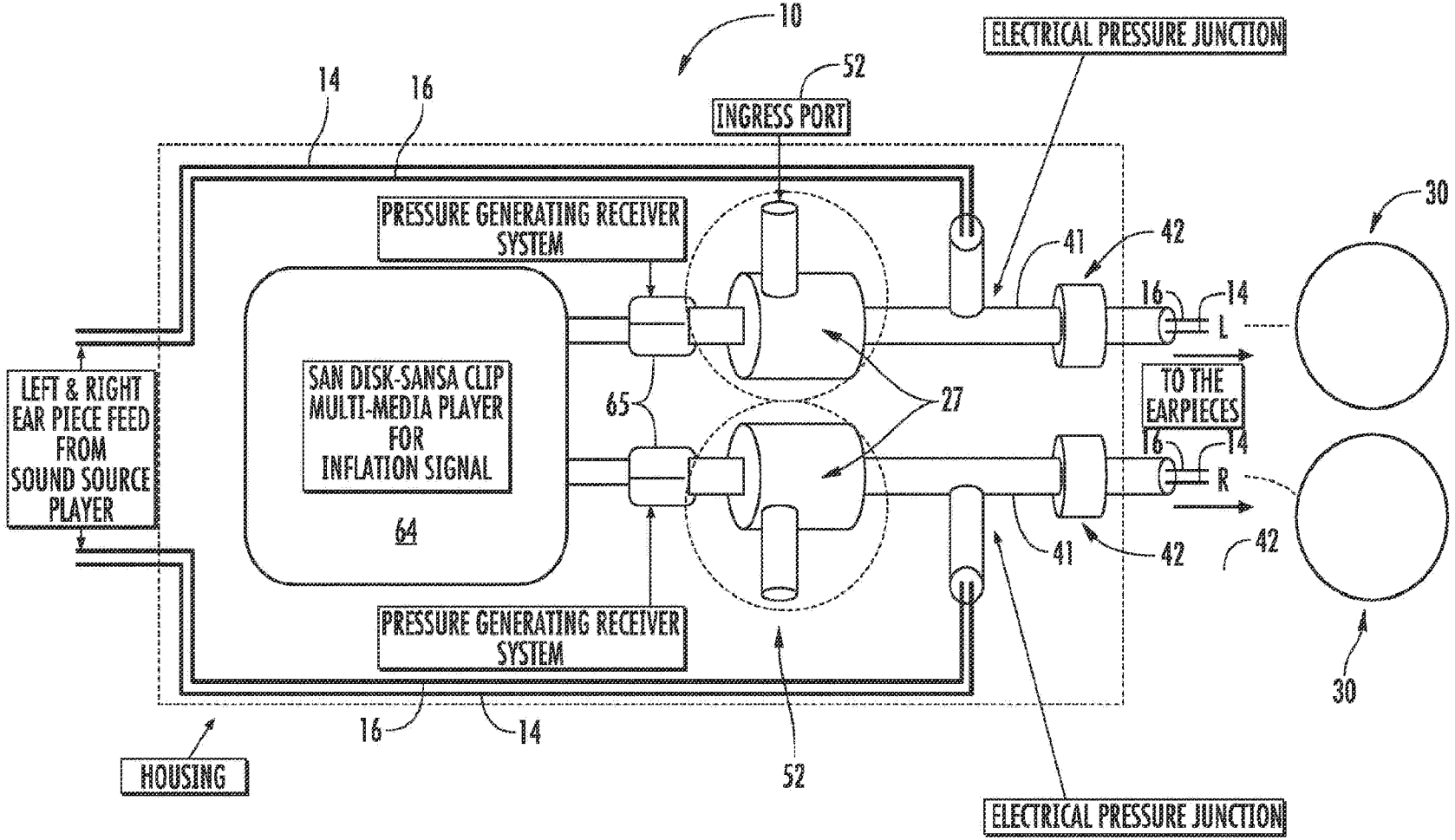
FIG. 3 is a schematic of pressure generating elements of an embodiment of the disclosed in-ear device.
Figure 88:
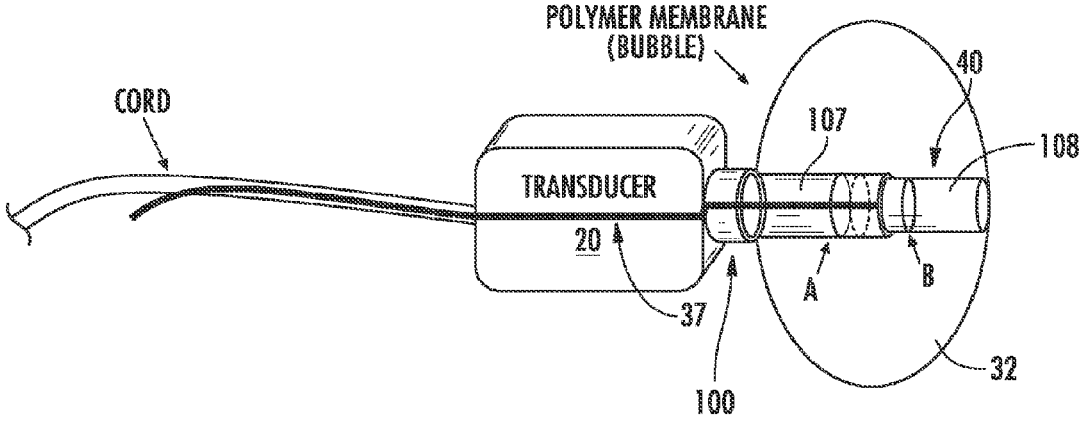
FIG. 88 illustrates a device similar to that shown in FIG. 87 including a sound tube coupling to the transducer.

Referring to FIGS. 3-88, there is illustrated numerous embodiments for converting acoustical vibrations, such as sound, into static pressure. This can be accomplished by an inventive pump that transports air or another fluid and pressurizes the air or the other fluid using acoustical vibrations as its power source. The pressurized fluid can be used for inflating a bubble via an in-ear device, generally designated by the numeral 10, and the various components thereof. The device 10 is designed for use in combination with an external audio source, such as a hearing aid, MP3 player, or the like, of most any size and power dimension. The term "device" is used throughout the following description to refer to all embodiments of the present invention, with the reference numbers for similar components being consistent across all embodiments as well. The intent is to make clear that such components are interchangeable between different embodiments, except where noted.

The invention is generally comprised of four components, including a transducer, a diaphonic valve, an inflatable member, and a sound tube. The transducer 20 is powered by an electrical source, either AC or DC, to produce a, in some cases reversible, fluid flow using the diaphonic valve. The fluid is used to inflate the inflatable member 30 (aka, bubble) which fits within an ear canal of the user. The sound tube 40 is used to channel sound, fluid, or both, to and from the ear canal, the inflatable member 30, or both.

The following detailed description is organized to cover each of these general components in their numerous variations, as well as additional and alternative components, with specific combinations illustrated and described for exemplification purposes. However, due to the numerous embodiments of the various components, there are combinations of such components which are not specifically discussed herein but which should be considered to be implicit within the present disclosure and encompassed by the appended claims.

General Device Description

FIG. 3, which will be described in further detail herein (See paragraphs 148-149), shows one particular layout for a basic embodiment of the present device 10.

Figure 13:
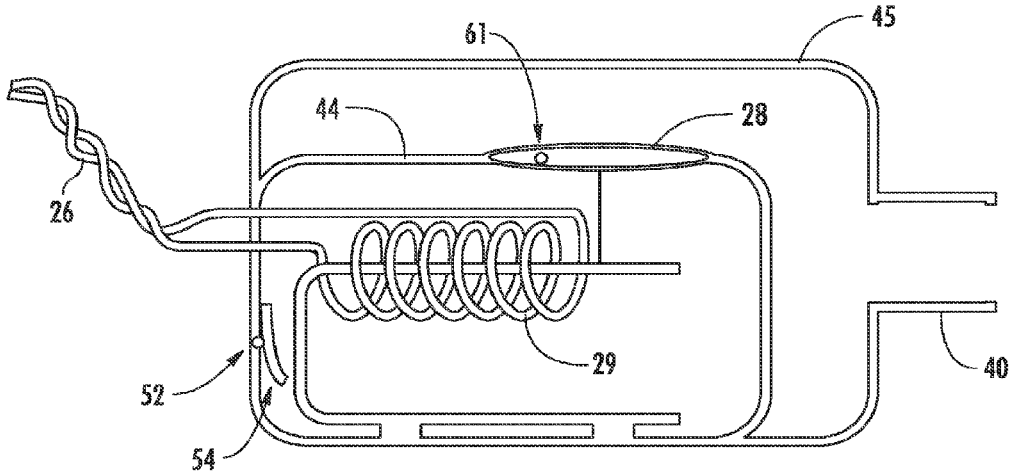
FIG. 13 is a cross-sectional schematic of a device similar to that shown in FIG. 10, including a flap valve.
Figure 14:
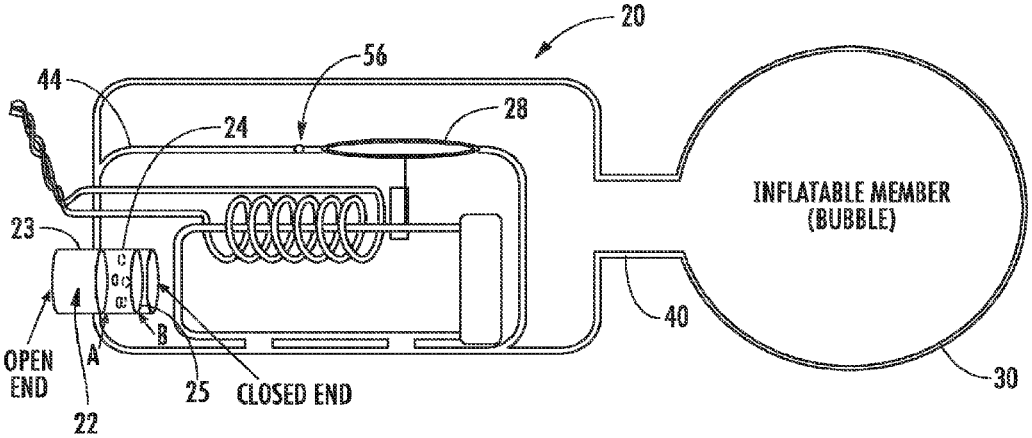
FIG. 14 is a cross-sectional schematic of a device including a co-axial diaphonic valve in the transducer back volume, in accordance with an embodiment of the present invention.
Figure 15:
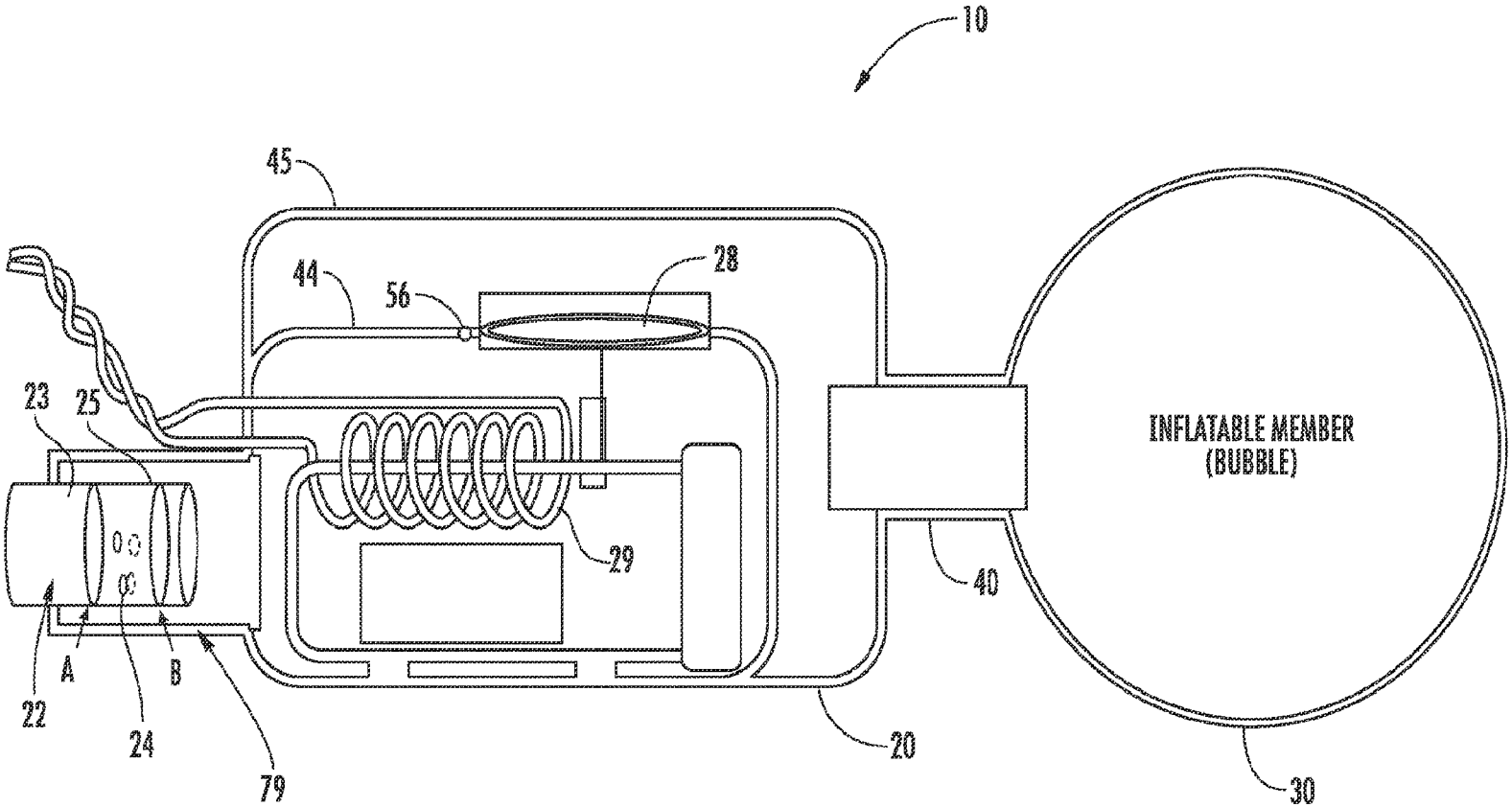
FIG. 15 illustrates a device similar to that shown in FIG. 14.

Referring to FIGS. 13-15, a transducer 20, which produces sound in response to an electrical signal supplied through a cord 50, may be outside of or enclosed within an inflatable member 30 (e.g., bubble 31). If within the bubble 31, the cord 26 passes through one end of the bubble 31 and the transducer sound output is directed out through the other end of the bubble 31 through a sound tube 40. In use, the device 10 is inserted into a user's ear with the cord 26 coming out of the ear and connecting the device to an audio signal generating device such as a hearing aid, a cell phone, a Bluetooth® device, a digital music player, or another communication device. The opening of the sound tube 40, which provides a direct path, uninterrupted by the polymer bubble 31, from the transducer 20 to the outside of the polymer bubble 31, is directed down the user's ear canal toward the user's tympanic membrane, commonly referred to as the ear drum.

Power Requirements

Figure 4:
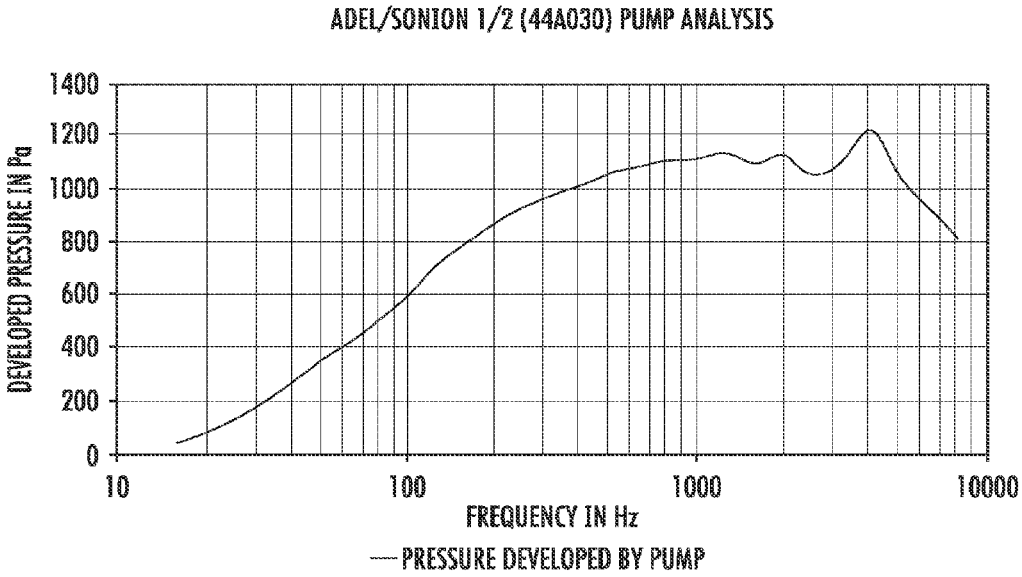
FIG. 4 is a line graph illustrating pump pressure developed by Sonion 44A030 transducer along a frequency range.

Experimental study based from working embodiments of the present device have allowed the evaluation of bubble inflation pressure versus transducer frequency and the power efficiency of bubble inflation versus transducer frequency. For example, these measurements were performed on a device pumped with the pressure generated by a diaphonic valve fitted to the back volume of one-half of a dual transducer (44A030) manufactured and sold by Sonion of The Netherlands. FIG. 4, a graph of pressure developed by the device pump as a function of frequency, illustrates, for this particular example of the device, that the highest pressure can be generated at about 4000 Hz.

However, the condition of peak pressure generation, also as shown in FIG. 4, is not necessarily the optimal frequency for device operation because transducers typically draw different amounts of power when operated at different frequencies.

Figure 5:
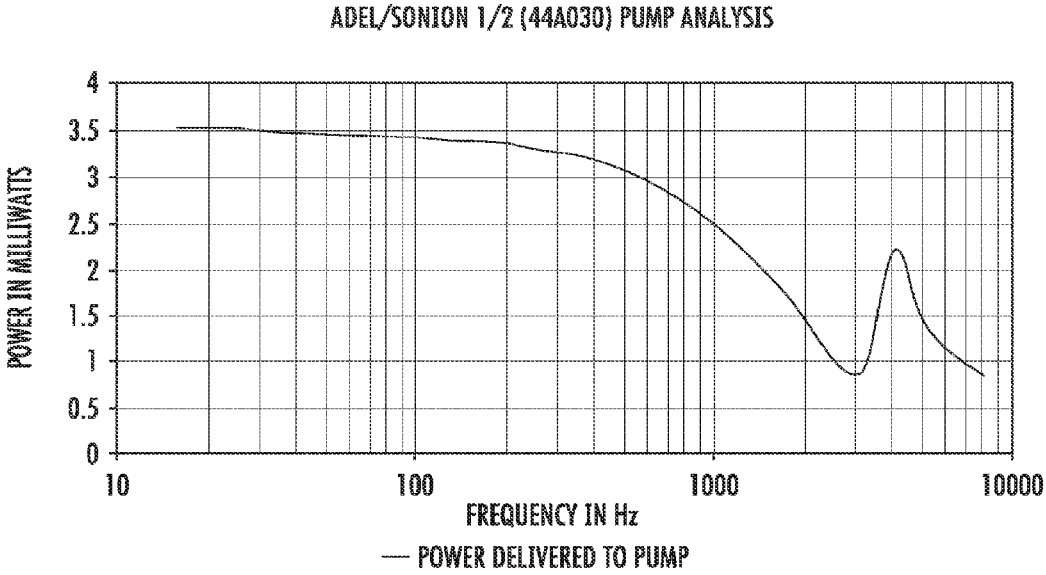
FIG. 5 is a line graph illustrating power required by the Sonion 44A030 transducer along the same frequency range as that of FIG. 4.

FIG. 5 shows the power required to drive this particular device as a function of frequency.

While the device can generate the highest pressure at about 4000 Hz (FIG. 4), FIG. 5 shows that this frequency corresponds to a local maximum in power requirement. It is desirable to operate the device at a frequency where the pumping is most energy efficient so as to make the optimum use of the limited power available in a battery driven application such as a hearing aid or an MP3 player. This frequency is found at the maximum of the ratio of pressure generated (FIG. 4) to power required (FIG. 5). A plot of this ratio versus frequency is shown in FIG. 6.

Figure 6:
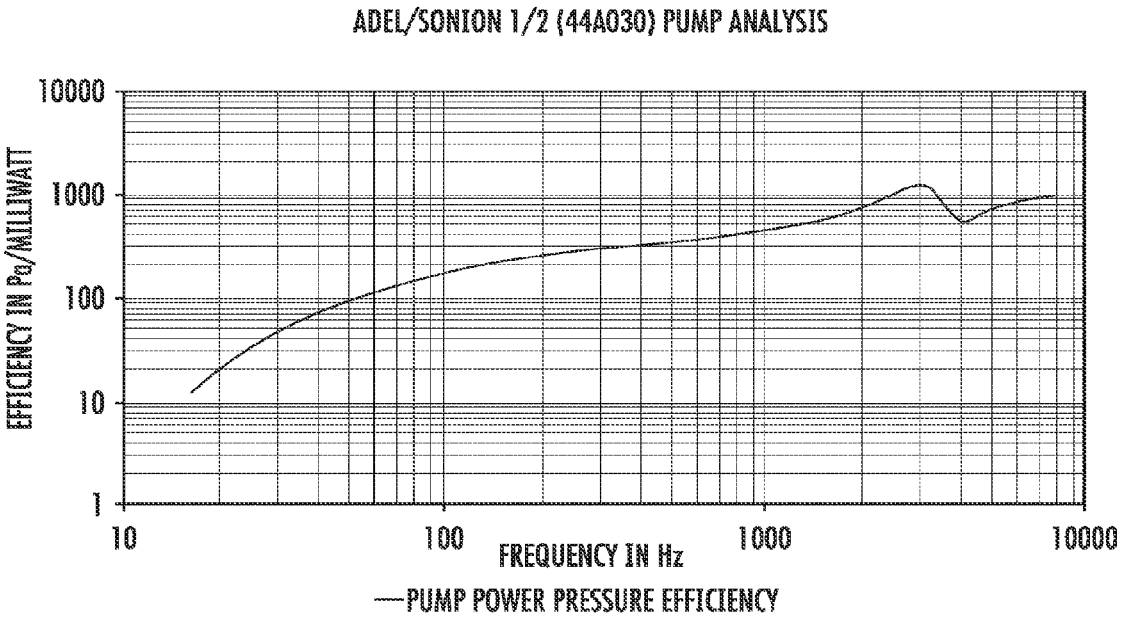
FIG. 6 is a line graph illustrating the efficiency of the Sonion 44A030 transducer along the same frequency range as that of FIG. 4.

FIG. 6 shows that operating this particular embodiment of the device at about 3000 Hz gives the greatest energy efficiency—i.e., Pascals of pressure generated per milli-Watt of power consumed. This conclusion is only useful provided that, at its most energy efficient frequency, the device can actually generate a high enough pressure to fulfill the intended application. When the application is sealing a bubble in a user's ear, a pressure of one kPa is more than adequate. Thus, 3000 Hz is found to be a good operational frequency for the referenced embodiment of the device.

By comparison, FIG. 6 shows that high energy efficiency is also achieved at the highest frequencies measured, 8000 Hz. The trend of the data also suggests that it may be possible to continue to increase pumping efficiency by going to even higher frequencies, or at least that a similarly high efficiency might be maintained at even higher frequencies. This observation raises the attractive possibility of a device that inflates a balloon in the user's ear by operating at a very high frequency—i.e., one which is beyond the audible range. However, FIG. 4 indicates that this may not be practical, at least for the particular embodiment evaluated. The pressure generated by the device drops off at high frequencies, and the trend indicates that at frequencies above the audible range the device may generate insufficient pressure for the application. Thus, this particular device should be operated at 3000 Hz to provide the combination of performance and efficiency.

Finally, FIGS. 4 and 6 show that workable pressures and reasonable power efficiencies are achieved over a very broad range of frequencies, from less than 100 Hz to as high as 8000 Hz with the Sonion transducer. Other transducers may have even broader usable ranges. The data suggests that one can produce effective device pumping using a wide range of sound including the environmental sounds picked up by a hearing aid, conversation, music and the like. Tests on a prototype hearing aid device showed that normal conversation or recorded music played at normal levels produced enough pressure to inflate a bubble and produce an effective ear seal.

Battery Life Considerations

For the present device 10, which inflates a bubble in the ear using sound generated by the device itself (described below), it is important that the power required to inflate the bubble and to keep it inflated is a small enough percentage of the available battery power so as not to adversely impact the device performance. As a general rule, for a hearing aid application the bubble inflation and bubble pressure maintenance should not consume more than about five percent of the available battery energy.

Example

Zinc Air Battery Powering an ear device on a Behind the Ear (BTE), Receiver In Canal (RIC) Hearing Aid.

Figure 7:
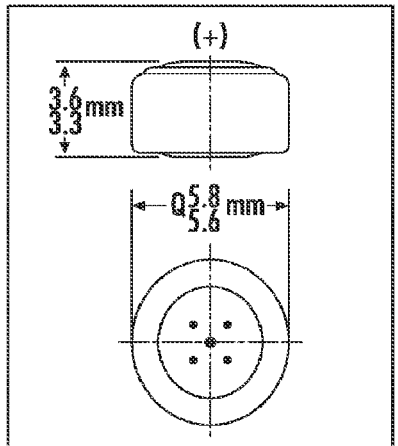
FIG. 7 is a reproduction of the operating parameters of a Duracell Zinc Air Battery 10, including a operation voltage curve.
Figure 7:
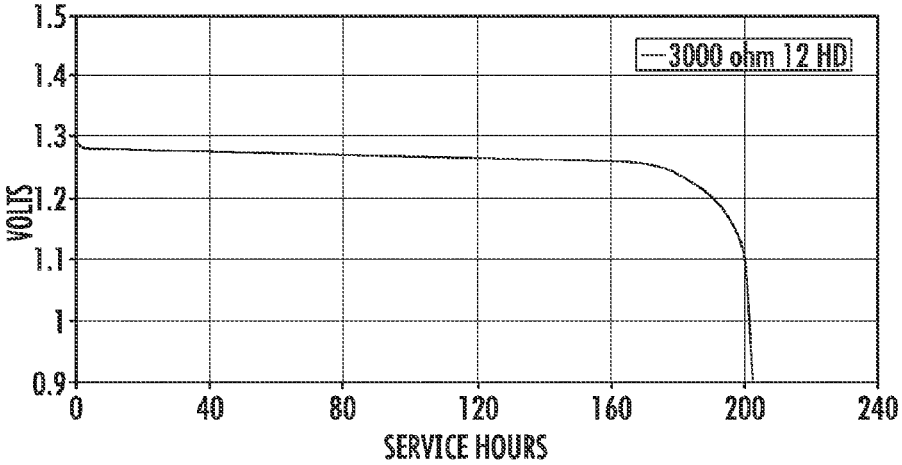

The Data Sheet, shown in FIG. 7, is for a typical size hearing aid battery (DURACELL® No. 10 Zinc Air Battery manufactured by Duracell) used in small BTE style RIC type products (5.7 mm diameter×3.5 mm thickness).

The "Typical Discharge Curve" shown in FIG. 7 assumes a load impedance of 3000 ohms applied for twelve hour periods, with 12 hour rest periods between. This suggests a hearing aid user would use the device for 12 hours per day. The graph shows a battery voltage of about 1.3 volts as being maintained for about 180 hours. The end point voltage appears to be 0.9 volts after a little more than 200 hours. This would imply that the power being dissipated for 180 hours is 1.3×1.3/3000 equal to 0.00056 Watts or 0.56 milli-Watts. This further implies that the energy being expended from the battery over a 180 hour period is about 0.00056 Watts×180 Hours or about 0.101 Watt Hours.

Applying the guideline that the present inflation pump can at most consume five percent of the available battery energy, this would be about 0.005 Watt Hours or 5 milli-Watt hours. If the battery powers the hearing aid for 12 hours a day and provides such service for 180 hours, this would extrapolate to a battery lifespan of approximately 15 days. Thus, the device can consume about 0.3 milli-Watt hours/day for bubble inflation and bubble pressure maintenance. Based on measurements made on one prototype pump (i.e., device pumped with the pressure generated by a diaphonic valve fitted to the back volume of one half of a Sonion dual transducer 44A030, as discussed above) operating at 3.15 kHz (the most energy efficient condition, as discussed above), capable of generating a bit more than one kPa with a power consumption of about 0.9 milli-Watts, this would indicate a maximum inflating time of about ⅓ of an hour or 20 minutes/day.

Twenty minutes of pumping per 12 hour day (theoretical maximum allowed by a limit of 5% of battery energy) is far in excess of the amount of pumping required to inflate and maintain inflation of a bubble of the present invention, provided that the bubble is a statically inflated (low permeability) bubble, and the diaphonic valve is prevented from leaking with the addition of a check valve, as described in more detail below.

1. Transducer

Figure 8:
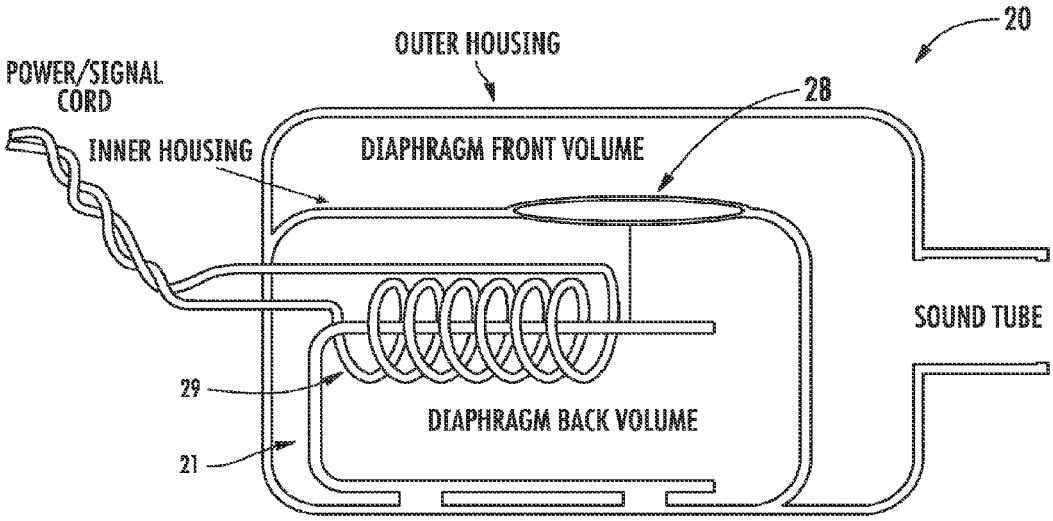
FIG. 8 is a cross-sectional schematic of a balanced armature transducer in accordance with an embodiment of the present invention.

Embodiments of the present device 10 work in conjunction with an existing balanced armature sound transducer, as illustrated in FIG. 8, of the type currently used in hearing aids and high end audio ear pieces. Embodiments of the present device could also work in conjunction with a moving coil speaker. The inventive transducer 20 acts both as an air pump to inflate an inflatable member in the listener's ear, and also allows the transducer 20 to perform its conventional function of playing audio material. The inflatable member (bubble or balloon), when inflated by the inventive diaphonic pump, produces a comfortable, adjustable and variable ear seal and works with the ear canal to produce a variable volume resonant chamber for safe, comfortable, rich sounding and high fidelity reproduction of audio.

The working of such a balanced armature transducer is well-known to those skilled in the art. Different designs and different physical embodiments of a balanced armature transducer 20 from different manufacturers may have different physical layouts of the components. However, all possible balanced armature transducers will have certain basic components. These include a diaphragm 28, for the production of sound, which is mechanically connected to the balanced armature 21. Using the interaction of a permanent magnetic field and an electromagnet produced by passing electricity through electrical coils 29, the armature is electronically actuated to produce vibrations of the diaphragm 28. The balanced armature 21 and electrical coils 29 reside in a back volume space behind the diaphragm 28. The front volume, on the opposite side of the diaphragm 28, is continuous with the sound tube by which the audio exits the transducer 20. The invention described here can be produced using any balanced armature transducer containing these basic components, regardless of the details of the layout or arrangement of these components in a particular balanced armature transducer embodiment. Additionally, embodiments of the invention described herein could use a moving coil speaker as its audio and sound energy source rather than a balanced armature transducer. The basic layout of such a device is similar regardless of whether the sound source is balanced armature or moving coil. Illustrations shown herein generally use a balanced armature sound source.

Figure 9:
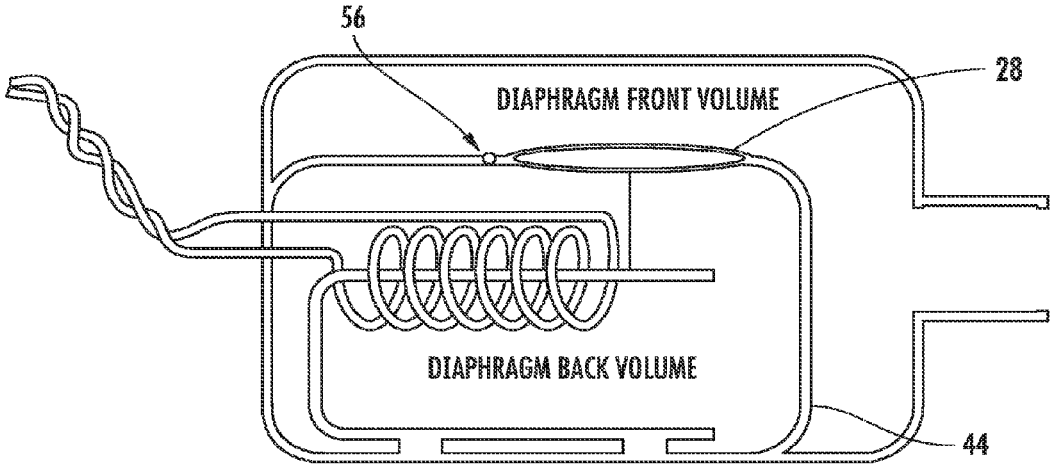
FIG. 9 illustrates an embodiment similar to that shown in FIG. 8, including a pressure equalization port.

It is common in prior art transducers, as the one shown in FIG. 9, to have a small hole or port 56 in the inner housing 44. The inner housing 44 separates the diaphragm back volume from the diaphragm front volume. The port 56 allows for the equalization of barometric pressure between the back volume and front volume. An excess of pressure on one side of the diaphragm 28 over the other will bias its vibrations and modify (impede) its sound generating characteristics. The pressure equalization port 56 provides a small physical pathway by which air can move between the front and back volumes thus equalizing pressure between them. The pressure equalization port 56 can be placed anywhere in the inner housing 44, including in a flexible membrane that seals the diaphragm with the inner housing 44.

Synthetic Jet

As will be appreciated after studying this disclosure, a closed system is provided in one or more embodiments around or over an orifice through which a synthetic jet expels its jet of fluid. This closed system, such as a bubble on one side of a synthetic jet orifice and an enclosed space (e.g., a transducer housing) on the other side of the orifice, can contain fluid pumped by the device, such as in the bubble, and also contain the static pressure that the device generates. In providing the fluid pumped by the device, an ingress tube or ingress port can supply the source fluid to the synthetic jet, at or near the edge of the synthetic jet orifice. The other end of the ingress tube can be located outside the closed system into which the synthetic jet expels its jet of fluid.

Through the use of the device, both positive pressure in the jet and negative pressure at the sides of the synthetic jet orifice may be directed, or stored in closed systems, and therefore isolated from each other. Accordingly, accumulated pressures, and or vacuums can be directed to do work.

Other additions to the fundamental device that are present in some embodiments include, but are not necessarily limited to, flaps covering the synthetic jet orifice and check valves to prevent backflow when the synthetic jet pump is not operating. The use of a flap or membrane over the synthetic jet orifice enhances the separation of the positive and negative pressures created by the diaphonic valve, thus allowing them to be both contained in separate closed systems with greater efficiency.

Pumping Based on a Moving Synthetic Jet Orifice

Figure 51:
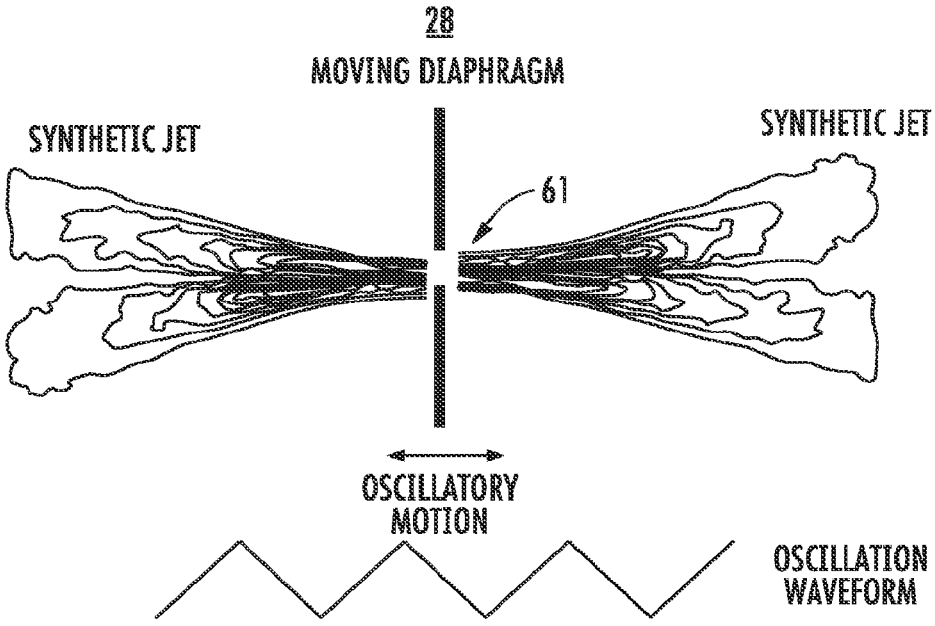
FIG. 51 is a graphic illustration of a moving diaphragm having balanced synthetic jets as a result of the illustrated accompanying waveform.

One particular embodiment of a diaphonic pumping device uses an orifice located in the surface of a moving diaphragm of a balanced armature transducer or the diaphragm of a moving coil speaker. When the diaphragm 28 vibrates back and forth, the orifice 61 in the diaphragm 28, see transducer 20 of FIG. 10, creates a pair of synthetic jets, one on either side of this orifice 61, as shown in FIG. 51. Movement of the orifice 61 in a given direction creates the synthetic jet in the opposite direction. Excursions of the diaphragm 28, and thus the orifice, upward generate the synthetic jet downward into the back volume of the transducer 20. Likewise, downward excursions of the diaphragm 28 and the orifice generate the upward synthetic jet into the front volume of the transducer 20.

Figure 52:
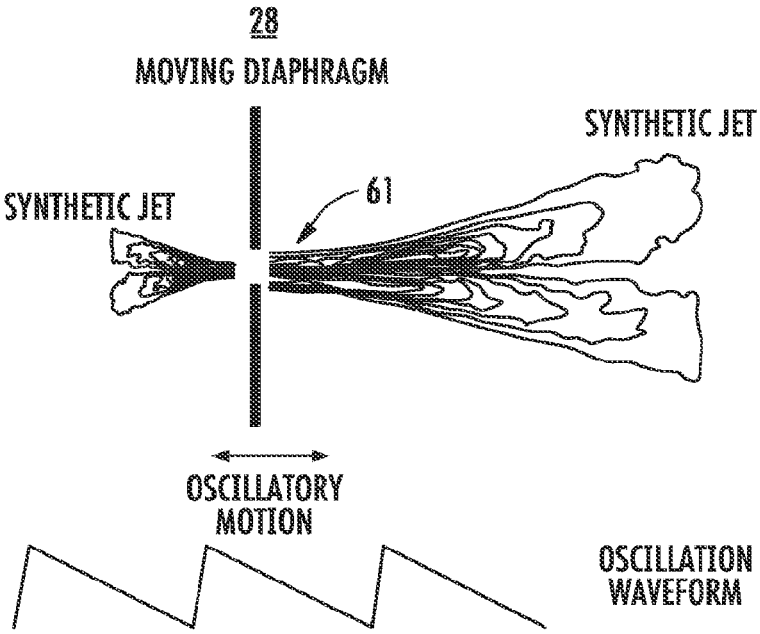
FIG. 52 is a graphic illustration of a moving diaphragm having unbalanced synthetic jets as a result of the illustrated accompanying waveform.

If the waveform driving the diaphragm 28 is symmetric, then the two synthetic jets (upward into the front volume and downward into the back volume) will be equal in strength, as shown in FIG. 51. The net effect with respect to mass transport and/or pressure generation will cancel on another out, and no net pumping action will be achieved. As shown in FIG. 52, an asymmetric waveform produces asymmetric synthetic jets, resulting in a net flow or pumping in the direction opposite to the more rapid or vigorous motion of the moving orifice.

Figure 11:
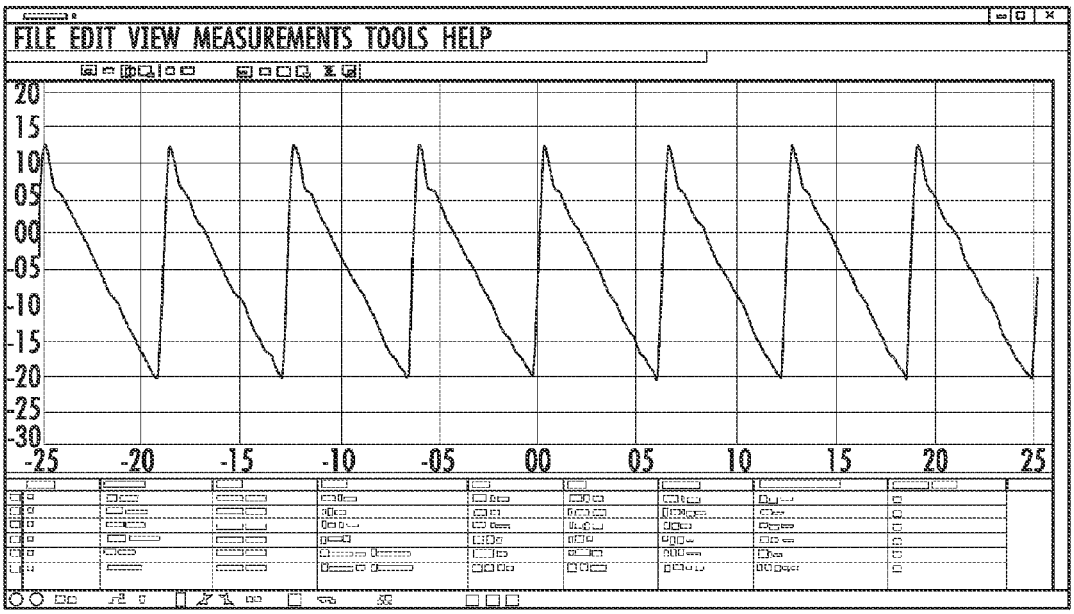
FIG. 11 is a graph illustrating an asymmetric wave.

With transducer 20 wired such that a rising wave, as shown in FIG. 11, indicates an outward (upward) thrust of the diaphragm 28, a pumping action from the front volume toward the back volume will be produced. FIG. 11 shows an opposite waveform with a vigorous downward draw followed by a slower upward thrust. This wave form will produce a net pumping action from the back volume toward the front volume.

Figure 10:
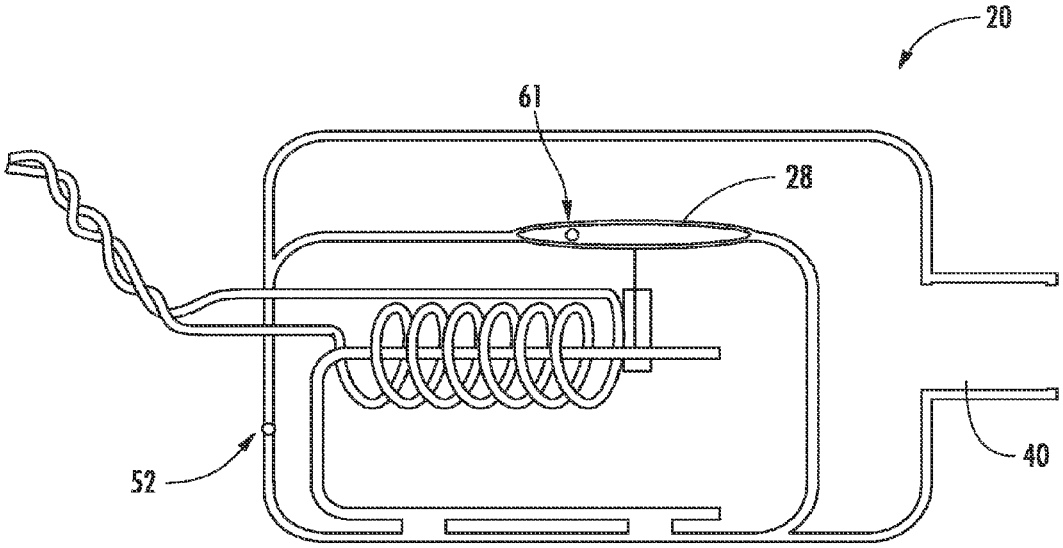
FIG. 10 illustrates an embodiment similar to that shown in FIG. 9, including a port in the diaphragm.

FIG. 10 also shows an ingress port 52, which directly connects the back volume to ambient air. The port 52 is desired if the device is going to be operated as a pump for the net transport of air from the outside, through the device and into an inflatable member 30 in the user's ear. The port 52 is also desired if device 10 is going to be used (by reversing the waveform driving the diaphragm 28) to actively deflate the inflatable member 30 in the ear by drawing air out of the bubble, through the device and expelling it outside.

Both the size and location of the ingress port 52 and the size and location of the orifice 61 on the diaphragm 28, if present, influence the acoustical impedance and the air flow impedance that each contributes to the device 10. By tuning these impedances it is possible to control the flow of both sound and air (pressure) through device 10. For example, it is desirable that the audio program sound generated by the diaphragm 28 propagates exclusively or at least predominantly through the front volume of the diaphragm 28, down the sound tube 40, and into the inflatable member 30 (i.e., toward the ear drum). Thus, the orifice 61 in the diaphragm 28 and the ingress port 52 have high acoustical impedance in the audible frequency range. One way this high acoustical impedance is achieved is my making these ports (52 and orifice 61) very small. The same consideration about acoustical impedance applies to the pressure equalization port 56 when it is present. Conversely, the sound tube 40 has a much lower acoustical impedance.

Figure 12:
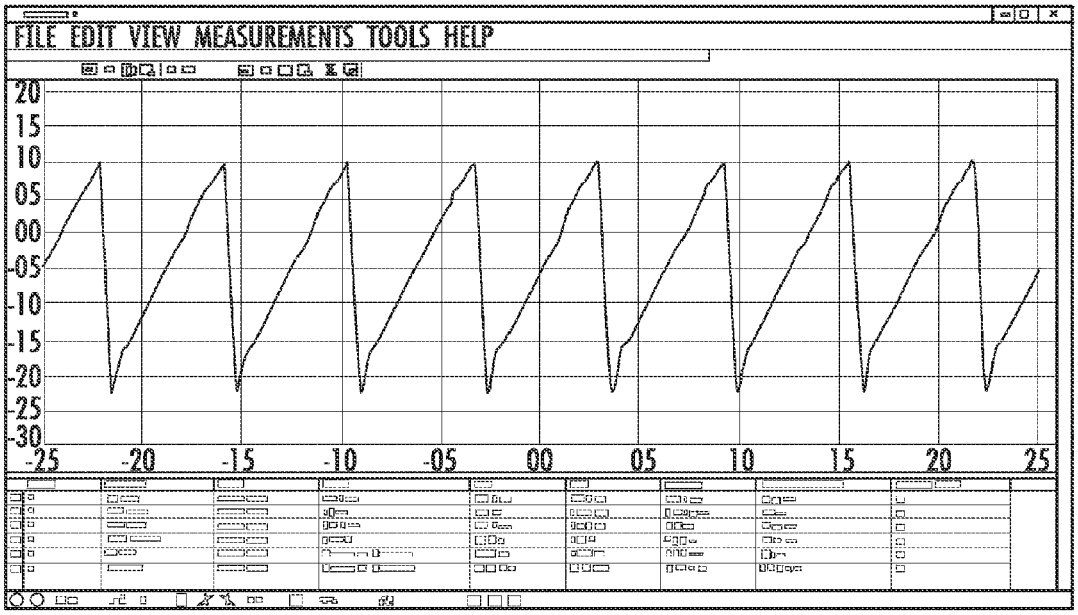
FIG. 12 is a graph illustrating an asymmetric wave similar to that shown in FIG. 11, but reversed.

The balance of impedances for air flow influence the working of the device as a pump. If the air flow impedances of the ingress port 52 and the orifice 61 in the diaphragm are balanced or nearly balanced, then it is possible to reverse the direction of overall air flow by changing the wave form driving the diaphragm 28, as in FIG. 12.

FIG. 13 shows a modification of the previous embodiment in which the inside of the ingress port 52 (the side within the diaphragm back volume) is covered by flap valve 54. The flap valve 54 permits air to flow from outside into the back volume but prevents the reverse flow of air from the back volume to outside. The flap valve 54 creates an extreme imbalance in the impedance for air flow such that the pumping efficiency in the forward direction (from outside through the device into the inflatable member) is enhanced, but at the expense of making the pumping action irreversible. With the flap valve 54 in place it is not possible to reverse the wave form and actively pump down or deflate the bubble 31.

Co-Axial Diaphonic Valve

FIG. 14 shows a co-axial diaphonic valve 22, which consists of a tube 23 preferably a few millimeters in diameter. A ring of small ports or holes 24 (1 to 6 holes generally) is drilled around the circumference of the tube 23. A tight fitting polymer sleeve 25 is placed on the outside of the tube 23 covering the ring of holes 24. The polymer sleeve 25 is fixed to the tube 23 around its circumference at one end (A) and is open at the other end (B). The fixed and the open end (A and B) may be switched without compromising the performance of the device.

The end of the co-axial diaphonic valve tube 23 that extends outside of the transducer 20 into ambient air is open. The other end of the tube 23, within the back volume of the transducer 20, is closed off.

Note that the embodiment of FIG. 14 does not have a port in the diaphragm 28. It does, however, have a pressure equalization port 56 in the inner housing 44, allowing pressure equalization of the front and back volumes of the transducer 20. In this embodiment, the pumping action is provided by the diaphonic valve 22 in response to the acoustical actuation provided in the back volume by the back side of the diaphragm 28. The co-axial diaphonic valve 22 pumps air into the back volume and increases its pressure. Air leaks through the pressure equalization port 56, equalizing the pressure in the front volume. Since the front volume is connected, through the sound tube 40, to the inflatable member 30, the bubble is also inflated as the front volume is pressurized. This embodiment has the advantage that the pressure equalization between the back and front volume results in no net pressure on the diaphragm 28 and thus no distortion of audio.

FIG. 15 shows a slight modification of the previous embodiment in which a tube 79 is extended off the back of the transducer housing 44 to hold the diaphonic valve 22. This is done for the simple reason that there may not be sufficient space within the compactly built housing of the commercial balanced armature transducer 20 to accommodate the co-axial diaphonic valve 22. In FIG. 15, the open end of the co-axial diaphonic valve 22 still accesses ambient air and the ring of ports 24 in the tube 23 and the polymer sleeve 25 sit within the volume of the extension tube and this volume is continuous with the back volume of the transducer 20.

Returning to FIG. 3, the incorporation of a sound actuated pump 27 (actually two pumps) into a larger total device, is shown. The pumps 27 are used to inflate a bubble in the ears of a user and to supply the bubble with audio program material.

An electronic signal is generated by a conventional prior art electronic device shown as a computer chip 64 in the schematic. This signal generates mechanical oscillations in the pressure generating receivers 65 shown. There are two sets of receivers 65 and the other components shown in the figure, one for each of the user's ears. The receivers 65 are electronically driven acoustical drivers (balanced armature or moving coil) of the general type used to create audio signals in prior art hearing aids, headsets and the like. However, the disclosed acoustical drivers (receivers 65) supply an oscillating sound-pressure to the pressure driven pumping devices 27. In an embodiment in accordance with the present invention, the sound driven pump 27 works in part or in whole on the principles of a synthetic jet (described further herein). Various embodiments of the pump 27 are available that can include, for example, a membrane that operates in cooperation with a valve seat. In such an embodiment, the sound pump 27 passes a static pressure on to the in-ear bubble as well as sound corresponding to the audio program material. In another embodiment, the pump 27 passes static pressure but blocks the transmission of sound, corresponding to noise made by the oscillating drivers (receivers) 65 driving the pumps 27, and prevents this sound from reaching the user's ear. In these embodiments, the acoustical program material is separately supplied via another set of acoustical drivers (not shown). The electrical signal to these other acoustical drivers is indicated by lines 14 and 16 in FIG. 3.

The sound actuated pump 27 is connected to the pressure generating receivers (acoustical drivers) 65 via a short or long tube. Additionally, an ingress port 52 has a tube impedance and supplies air to sound actuated pump 27, and an outlet tube 41 carries the static pressure generated on to inflate a bubble of the in-ear device 10. In some embodiments, the tube 41 carrying the pressure from the sound actuated pump 27 to the bubble incorporate inertance filters 42 to dampen the sound created by the pressure generating receivers (acoustical drivers) 65.

Flat Diaphonic Valve Mounted on Transducer Case

In order to produce the most compact design for insertion into the ear canal, a flat diaphonic valve 50 was constructed which mounts to the side of a transducer case and which adds 0.4 mm or less to the overall device width. The working principle and practical operation of the flat diaphonic valve 50 is not different from that described above. However, the device disclosed here, has the advantage of compact design fitting onto the side of a balanced armature transducer 20. The entire device, including the transducer and the diaphonic valve 50 is small enough to fit into the user's ear, and is small enough to be partially or fully contained within a bubble 31.

Figure 16:
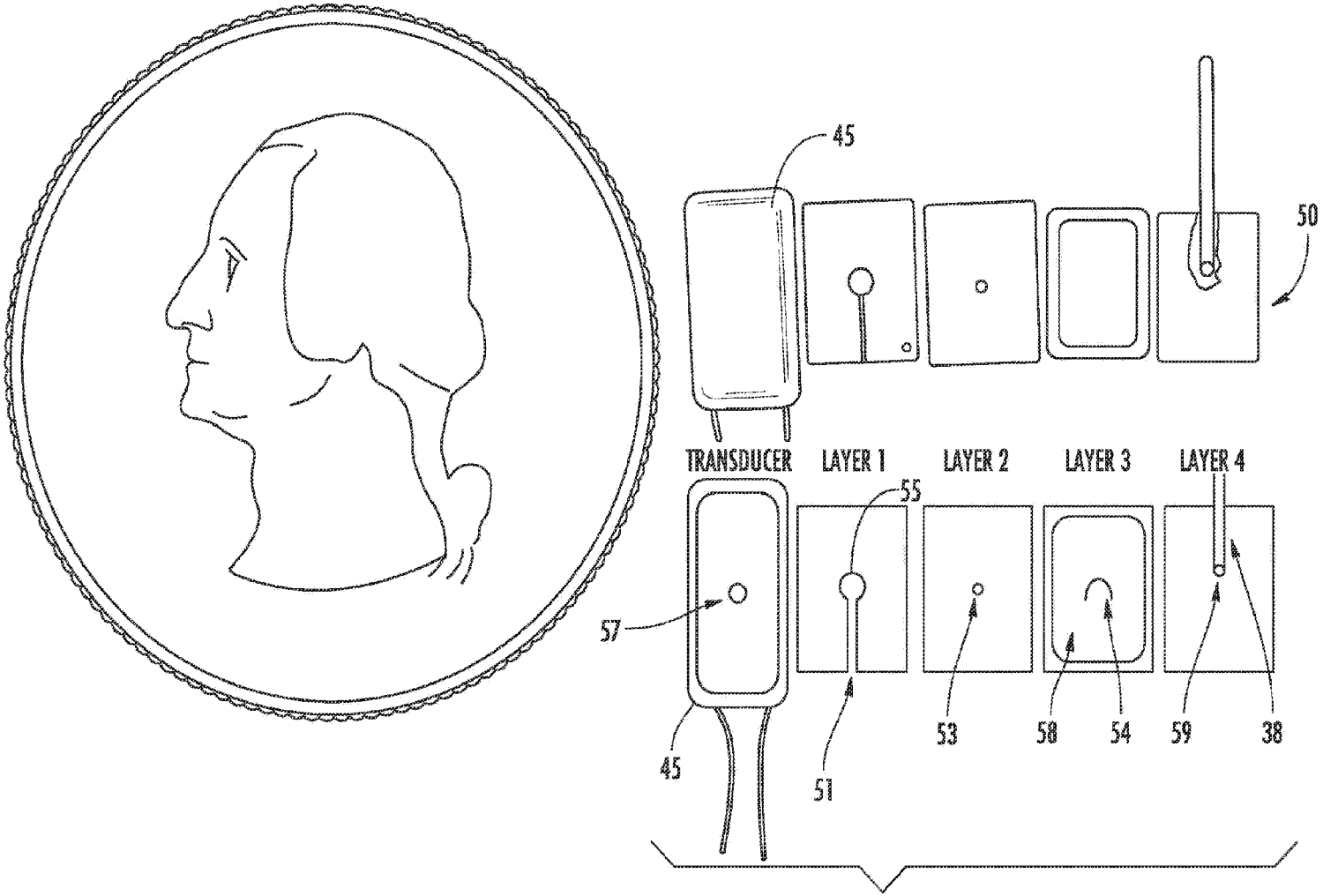
FIG. 16 is a photograph of a disassembled diaphonic valve as well as labeled schematics of the component parts (for scale purposes, a portion of a U.S. dime is also shown)
Figure 17:
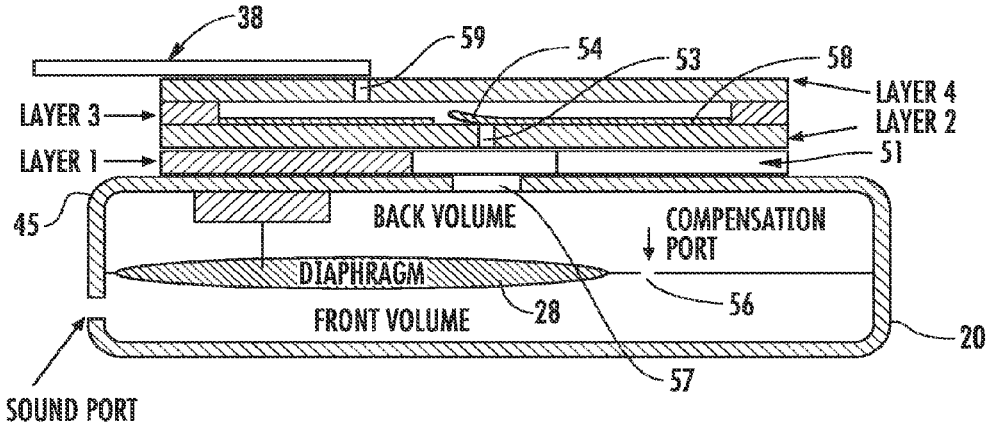
FIG. 17 is a side schematic of the assembled component parts of the diaphonic valve illustrated in FIG. 16.

FIG. 16 shows a photograph of a disassembled working diaphonic valve 50 as well as labeled schematics of the component parts. For scale purposes, a U.S. dime is provided in the image as well. FIG. 17 shows a cross sectional view of the assembled, multilayered valve 50. The valve 50 is built on the side of a balanced armature transducer 20, which has a hole 57 in the middle of its outer casing 45. The hole 57 is a byproduct of the manufacture of this particular transducer 20, and it leads directly into the back volume of the transducer 20. If no such hole is present on a particular transducer to be fit with a diaphonic valve of this type, then one would need to be drilled.

Layer 1 of the valve structure is a plate containing a groove or slot 51 which will become an air ingress channel in the final valve when all the layers are stacked on top of one another. At the closed end of the slot 51 is a circular terminus 55. Layer 2 is a plate with a single small hole 53. When assembled, the hole 53 is aligned with the hole 57 in the transducer housing 45 as well as with the circular terminus 55 of the air ingress channel. The hole 53 in Layer 2 is the orifice of the synthetic jet, which is the heart of the diaphonic valve 50. This orifice is smaller than the hole 57 in the transducer housing 45 and it is smaller than the circular terminus 55 of the air ingress channel.

Layer 3 of the flat diaphonic valve is a rigid frame with a central region spanned by a thin and flexible polymer membrane or film 58. In this particular device, the membrane 58 is composed of polyethylene terephthalate (PET). The membrane 58 could be composed of any polymer materials suitable for use as a membrane in flat diaphonic valves. The membrane 58 could also be a non-polymer film or foil such as a thin metal foil. The membrane 58 is mounted on the underside of the rigid frame of Layer 3 so that in the assembled device this flexible film rests directly on the top of the plate of Layer 2. Above the membrane 58 is a narrow gap, which allows the flexible film 58, below the bottom of Layer 4, to flex upward. A flap 54 is cut in the center of the membrane 58 of Layer 3. In the assembled device, the flap 54 is directly over the synthetic jet port 53 in Layer 2. Layer 4 is a top plate or cover for the diaphonic valve 50. This cover contains an egress port 59 by which air pumped by the diaphonic valve exits the device. In the particular embodiment shown, this egress port 59 connects to an egress air tube 38, which may be used to route the air into a bubble for inflation.

Experimentation with prototype devices has shown that it is often desirable to prevent escape of air from an inflated bubble by leakage back through the diaphonic valve, during time periods when the diaphonic valve is not pumping, but during which the bubble needs to remain statically inflated. To prevent air leakage back through the diaphonic valve, the diaphonic valve itself can be designed to minimize leakage or a check valve may be added to the diaphonic valve by addition of two more layers to the structure of FIGS. 16 and 17, as shown in FIG. 18.

Figure 18:
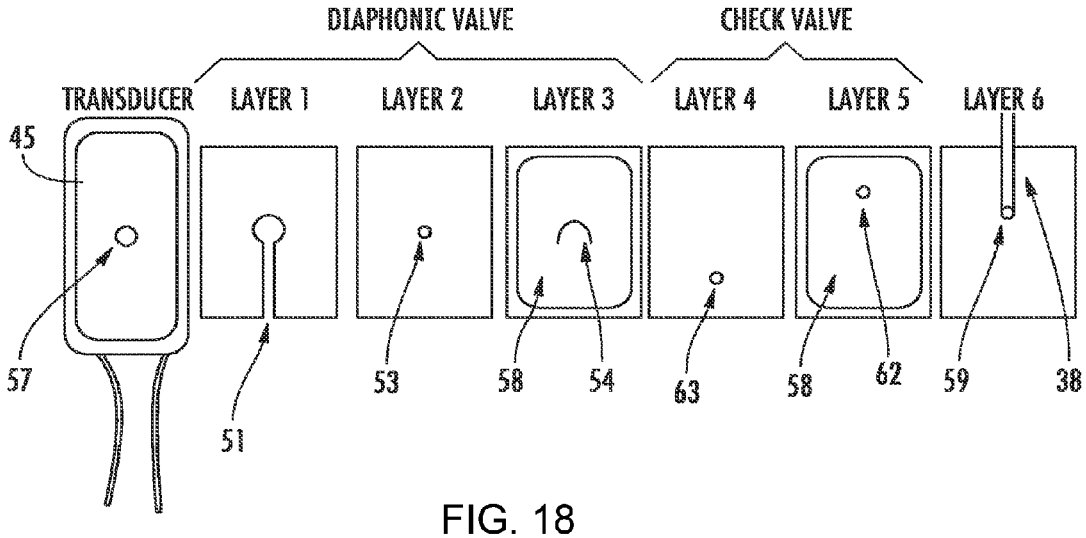
FIG. 18 is a schematic of a disassembled six-layered diaphonic valve in accordance with an embodiment of the present invention.
Figure 19:
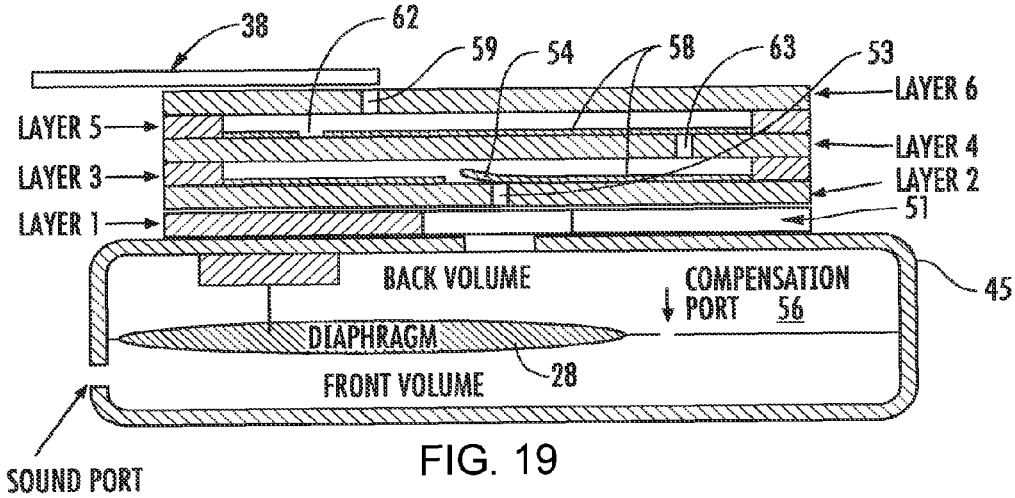
FIG. 19 is a side schematic of the assembled component parts of the diaphonic valve illustrated in FIG. 18.

The disassembled layers of the diaphonic valve 50 with the added check valve 62 are shown schematically in FIG. 18. FIG. 19 shows an assembled, six-layer structure.

Layers 1 through 3 are the same as the first three layers in the flat diaphonic valve 50 discussed previously. Layer 4 is a plate with a single small hole 63. The hole 63 is not in the center of the plate, but is closer to one of the ends of the plate, along its long axis. Layer 5 is a rigid frame with a flexible membrane 58 on its lower side, similar to Layer 3. However, in Layer 5, there is no flap, but rather another small hole 66 in the membrane 58, which is located at the opposite end of the structure from the hole in the plate of Layer 4. Layers 4 and 5 comprise the check valve 62. The region of contact of the top of the plate of Layer 4 and the bottom of the film of Layer 5, between the hole 63 in Layer 4 and the hole 66 in the flexible film 58 of Layer 5, comprises the sealing function of the check valve 62. Placing the holes 63, 66 in Layers 4 and 5 at opposite ends of the structure creates the largest possible valve seat for the check valve 62 and thus improves the seal. Finally, Layer 6 is the same cover plate with an air egress port 59.

Figure 20:
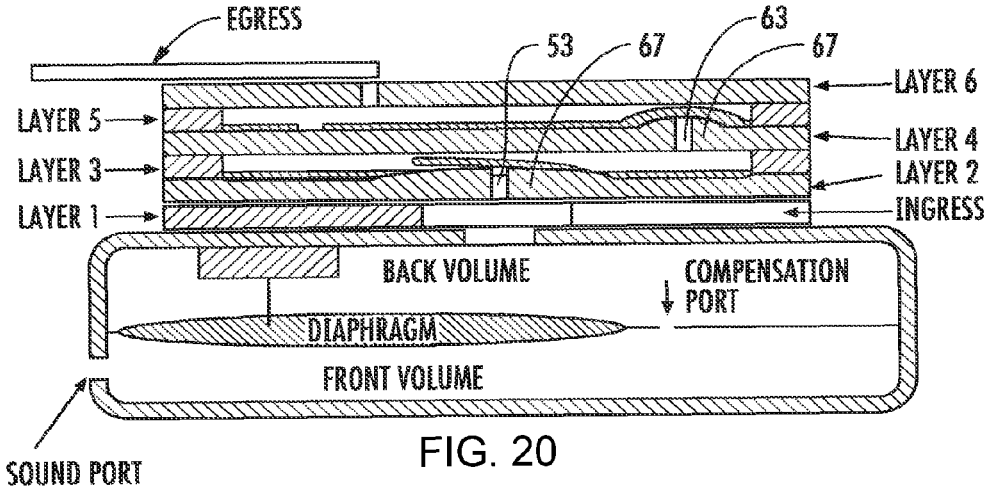
FIG. 20 is a side schematic of assembled component parts of a diaphonic valve similar to the embodiment illustrated in FIG. 19.
Figure 21:
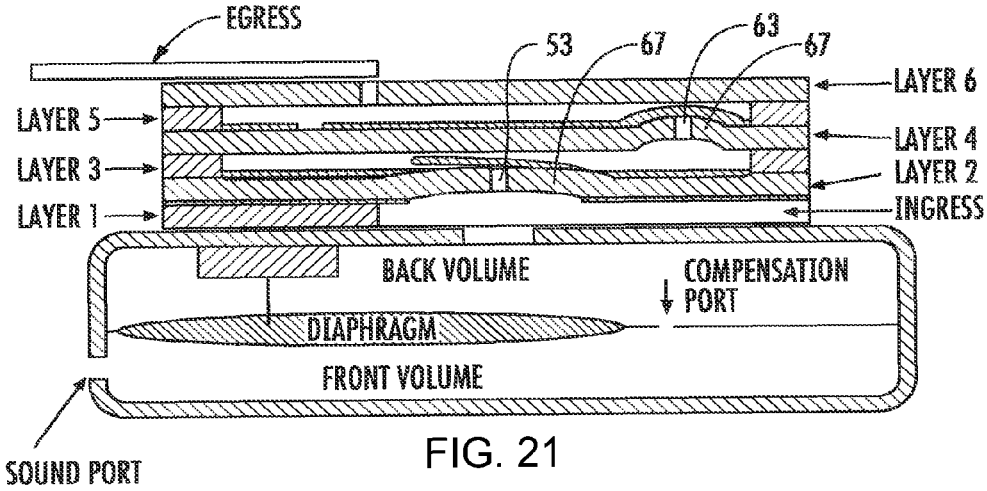
FIG. 21 is a side schematic of assembled component parts of a diaphonic valve similar to the embodiment illustrated in FIG. 19.

As shown in FIG. 20, raising the rim 67 around the ports 53 and 63 in Layers 2 and 4 improves the seating of the flexible membrane 58 across these ports. This increases the pumping efficiency of the diaphonic valve 50 and produces a tighter seal for the check valve 62. FIG. 20 shows that this can be accomplished by thickening the rim 67 around the ports 53 and 63. FIG. 21 shows that this can also be accomplished by pushing up or embossing the plate underneath the ports 53 and 63. This also raises the rim 67 of the ports 53 and 63 and produces the desired improvement in performance.

Figure 22:
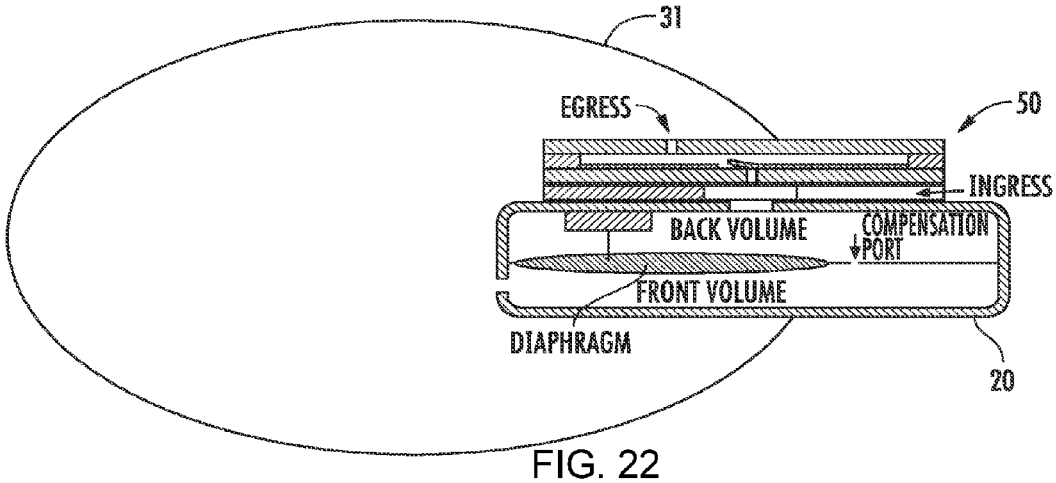
FIG. 22 is a side schematic of a driven bubble system with a transducer partially enclosed by the bubble, in accordance with an embodiment of the present invention.
Figure 23:
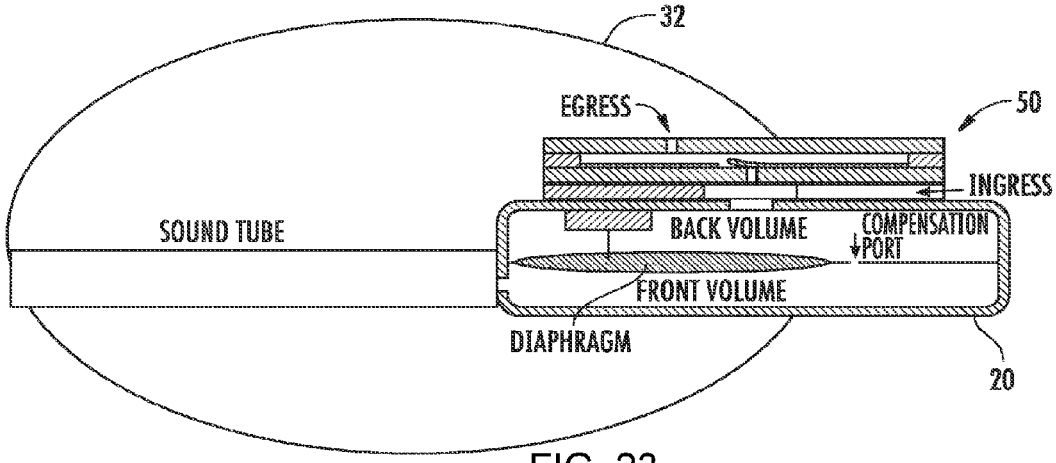
FIG. 23 is a side schematic of a driven bubble system with a sound tube fully enclosed and a transducer partially enclosed by the bubble, in accordance with an embodiment of the present invention.
Figure 24:
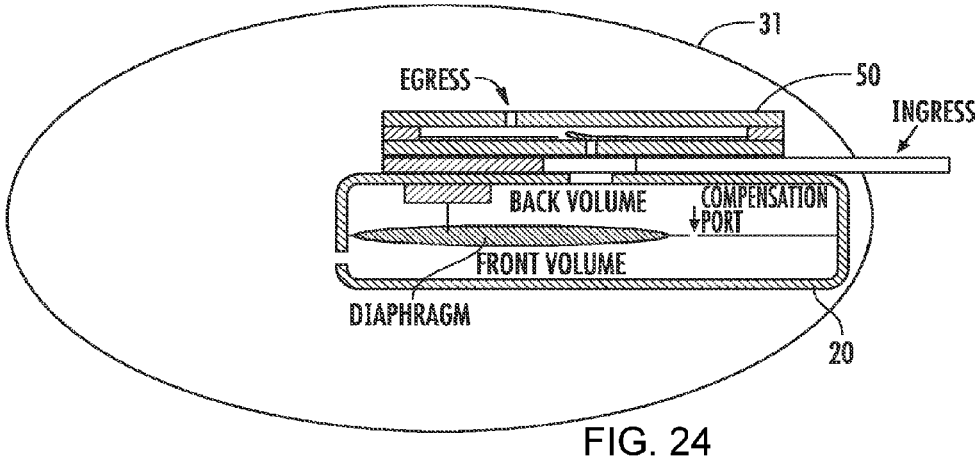
FIG. 24 is a side schematic of a driven bubble system with a transducer fully enclosed by the bubble, in accordance with an embodiment of the present invention.
Figure 25:
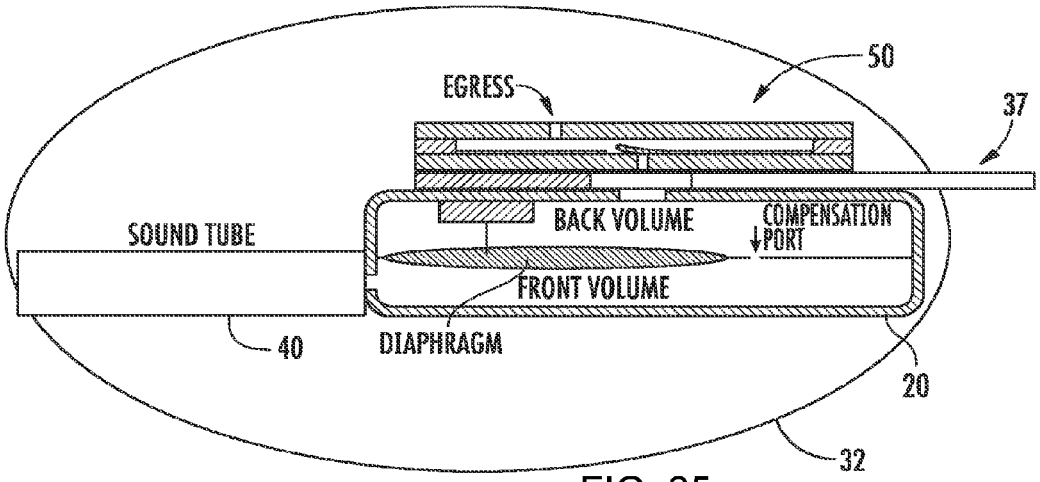
FIG. 25 is a side schematic of a driven bubble system with a sound tube and a transducer fully enclosed by the bubble, in accordance with an embodiment of the present invention.
Figure 26:
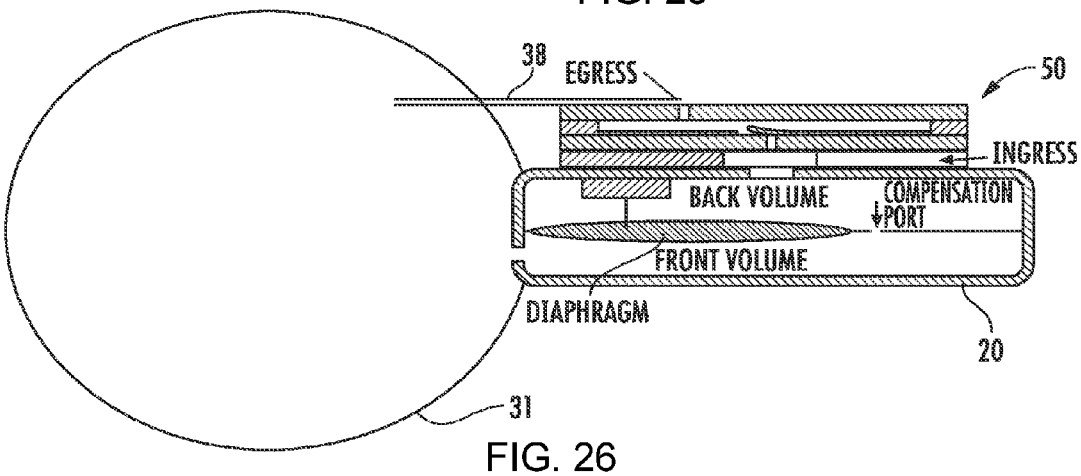
FIG. 26 is a side schematic of a driven bubble system with a transducer outside of the bubble, in accordance with an embodiment of the present invention.
Figure 27:
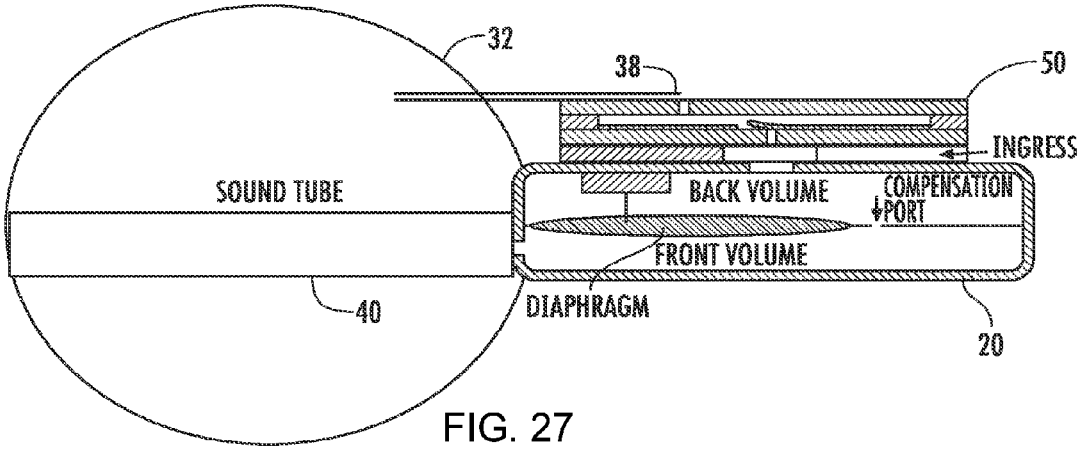
FIG. 27 is a side schematic of a driven bubble system with a sound tube fully enclosed and a transducer outside of the bubble, in accordance with an embodiment of the present invention.

FIGS. 22-27 show various ways the flat diaphonic valve 50 mounted on the side of a transducer can be incorporated with a bubble 31. These figures show the flat diaphonic valve 50 without the additional check valve. However, the same configurations are possible with a flat diaphonic valve 50 containing a check valve 62, as described above. FIG. 22 shows a device 10 with the transducer 20 partially enclosed by the bubble 31. FIG. 23 shows a donut-shaped bubble 32 with a sound tube 40 and the transducer 20 partially enclosed in the bubble 31. FIG. 24 shows a device 10 with the transducer 20 fully enclosed by the bubble 31. FIG. 25 shows a donut-shaped bubble 32 with the transducer 20 fully enclosed by the bubble 31. FIG. 26 shows a device 10 with the transducer 20 completely outside the bubble 31. FIG. 27 shows a donut-shaped bubble 32 with the transducer 20 completely outside the bubble 31.

Figure 28:
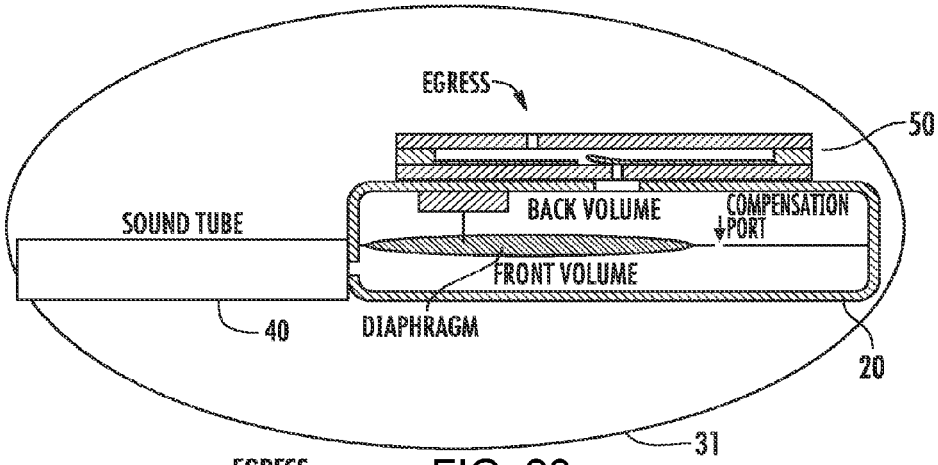
FIG. 28 is a side schematic of a driven bubble system with a sound tube and a transducer fully enclosed by the bubble similar to the embodiment of FIG. 25, in accordance with an embodiment of the present invention.

FIG. 28 shows an embodiment of the device 10 with the flat diaphonic valve 50 in which the air ingress channel is absent. This is shown with the transducer 20 fully enclosed within the bubble 31, but other embodiments lacking an air ingress port can also be partially enclosed by the bubble 31 or completely outside the bubble 31.

In the device lacking an air ingress channel, air to inflate the bubble 31 is drawn from the ear canal, down the sound tube 40, into the front volume of the transducer 20, through the pressure compensation port 56, into the back volume of the transducer 20, through the pumping diaphonic valve 50 and finally into the bubble 31. This embodiment has the advantage of using air pressure to pull the bubble 31 into the user's ear, producing a good acoustic seal.

Multiple Diaphonic Valves to Boost Pressure Output

Figure 29:
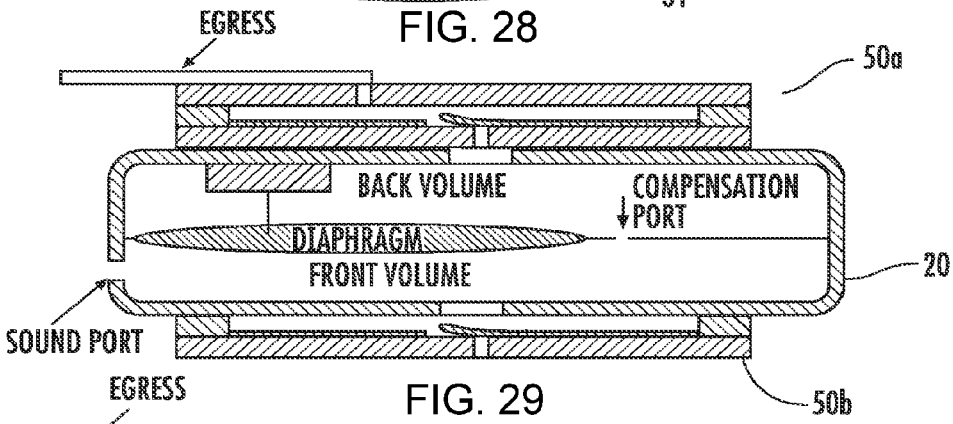
FIG. 29 is a side schematic illustrating two flat diaphonic valves attached to a single transducer, in accordance with an embodiment of the present invention.

FIG. 29 shows an embodiment where two flat diaphonic valves 50 are attached to a single transducer 20.

The diaphonic valve 50*a* on the front volume is turned around to pump from outside into the front volume, thus pressurizing the front volume. This pressure leaks through the compensation port 56 into the back volume, thus increasing the pressure of the back volume. The other diaphonic valve 50*b* on the back volume further increases pressure and pumps air out of the device via the egress port 59. This device can produce higher pressures than the single diaphonic valve on the back volume only. With two diaphonic valves 50, the first valve increases pressure inside the transducer 20 and the second boosts pressure even more before egress. The device in FIG. 29 is illustrated using flat diaphonic valves 50. However, this same arrangement will also work with any of the previously disclosed diaphonic valve designs (e.g., co-axial diaphonic valve 22).

Figure 30:
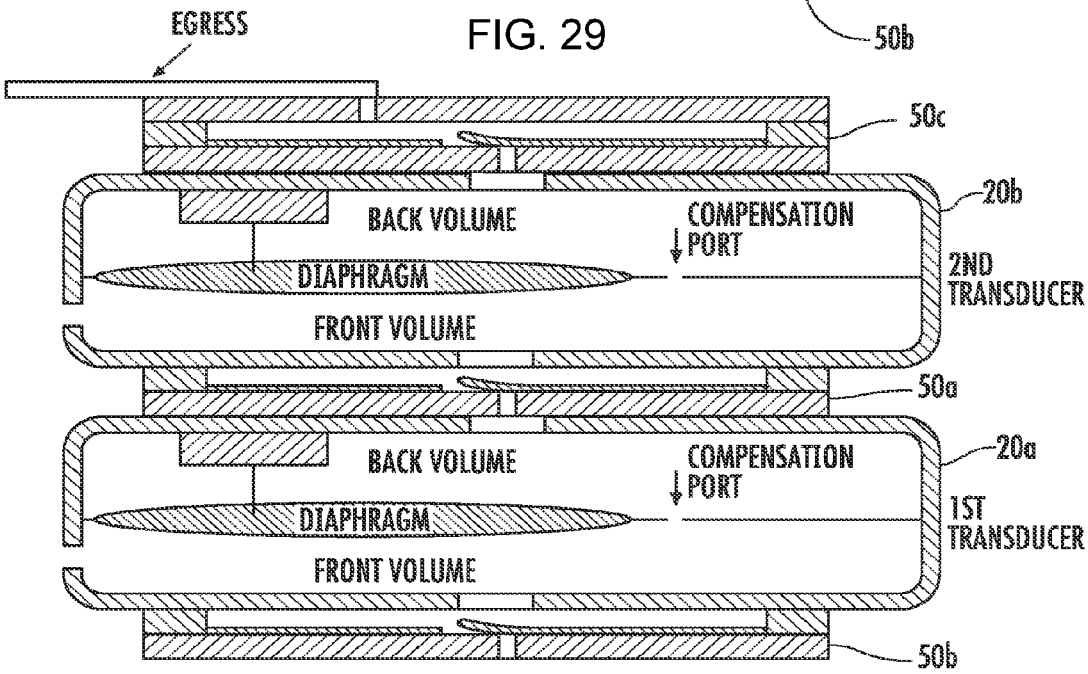
FIG. 30 is a side schematic illustrating a stack of flat diaphonic valves and two transducers, in accordance with an embodiment of the present invention.

FIG. 30 shows that it is possible to stack two transducers 20 together with a diaphonic valve 50*a* between them and with additional diaphonic valves 50*b*, 50*c* on the front volume of the first transducer 20*a* and on the back volume of the second transducer 20*b*.

This produces a cascade of pressure increases. Each transducer and diaphonic valve combination can only increase the pressure so much (about 1 kPa at most). However, by stacking the devices as shown, the second transducer/diaphonic valve combination begins with air which has already been pressurized. It can thus boost the pressure higher. When operating a device such as that shown in FIG. 30, it is necessary to coordinate the phase of the inflation tones between the two transducers 20 to ensure that the diaphonic valves 50 all work in the same direction. Additionally, the diaphonic valve 50*a* which sits between the first transducer 20*a* and the second transducer 20*b* necessitates that the two transducers have their inflation tones in phase with one another.

Figure 31:
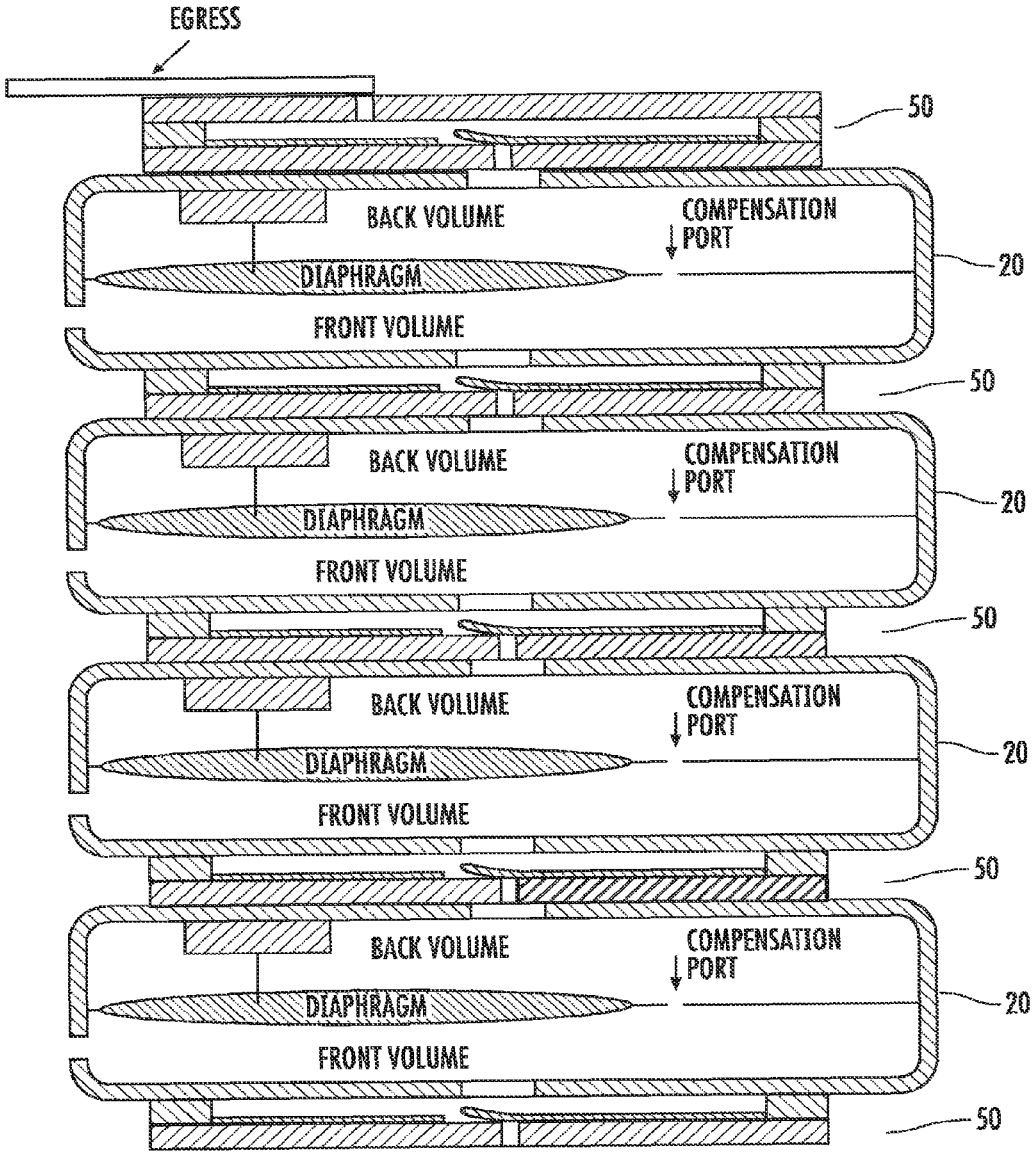
FIG. 31 is a side schematic illustrating a plurality of diaphonic valves alternating with transducers, in accordance with an embodiment of the present invention.

FIG. 31 carries the concept of a stack of transducers and diaphonic valves even further. One can build stacks of arbitrary numbers of alternating transducers and diaphonic valves to generate higher and higher pressure. The pressures achievable will eventually be limited by the mechanical strength of the components to resist increasing pressure.

The devices shown in FIGS. 30 and 31 have open sound ports, and will thus tend to allow some pressure to escape from the stack of transducers and diaphonic valves. Other embodiments may have some or all of these sound ports blocked to create even greater pressures. Embodiments of the devices in FIGS. 30 and 31 may have variations in the flow and sound impedance of the compensation ports (for instance by changing the size of the ports) as air progresses up the stack of transducers. This may help to prevent back flow of pressure in the device 10. The transducers 20 in a stack such as FIGS. 30 and 31 may be run in phase or with other complex combinations of phase and amplitude differences to produce different pressure and sound outputs from the device.

The devices of FIGS. 30 and 31 illustrate interleaved balanced armature transducers 20 and diaphonic valves 50. Similar stacked devices for the purpose of pressure generation, pumping, and sound generation can be produced by interleaving diaphonic valves with other sound generating devices (not shown), such as piezoelectric diaphragms, or moving coil speakers. In these cases the piezoelectric diaphragms or speakers may have small compensation ports in them or in their surrounds in order to allow pressure to move from the front volume to the back volume or vice-versa.

2. Inflatable Member

The inflatable member 30 or, more specifically to the illustrated embodiments, bubble 31 is a key component of the present invention. The bubble 31, which can be comprised of an almost infinite number of shapes, sizes, colors, and materials, all as detailed below, serves a variety of functions, including providing retention, comfort, adjustability, and compactability.

Bubble Composition

Expanded polytetrafluoroethylene (ePTFE) or PTFE are favored materials for the production of bubbles due to a combination of properties including: strength, lightness (low density), tailorable air permeability (through controlled porosity), smoothness of surface feel, and low surface energy, which makes these materials resistant to soiling and dirt accumulation. ePTFE and PTFE suitable for bubble production is available commercially in the form of sheets and films of various thicknesses and porosities. Generally, thinner grades of the ePTFE or PTFE sheet are better for bubble production than thicker grades. Depending upon specifics of tailored bubble design and on the manufacturing processes used, the thickness of the starting film material is typically less than 10 mils, preferably less than three mils, and most preferably one mil or less.

At the time of this filing, bubble production from ePTFE and PTFE films has yielded best results using grades of polymer film having low or negligible air permeability. This is because, in use, it is easier to keep a low or negligible permeability bubble inflated by the action of acoustical pumps than a more porous bubble. However, there are acoustical properties and advantages for ear comfort and ear health that are enabled by more porous and, therefore, more breathable bubbles. This includes the lessening of cerumen buildup as discussed below. Thus, using more air permeable grades of ePTFE or PTFE film in bubbles is not excluded from the present invention.

Other thin flexible polymer films including polyurethane films, thermoplastic polyurethane films, aromatic polyurethane films and aliphatic polyurethane films are also favorable materials for bubble production due to their strength, expandability, processability, and low air permeability. Polyurethanes are particularly useful when a statically inflated, non-breathable bubbles are desired. Depending upon specifics of tailored bubble design and on the manufacturing processes used, the thickness of the starting polyurethane film material is typically less than 10 mils, preferably less than three mils, and most preferably one mil or less.

Fabrication of Bubble Shape

In the manufacture of the polymer bubbles for the co-axial diaphonic valve 22 or any of the embodiments disclosed, there is the necessity to form a closed, convex bubble shape. In embodiments in which the sound tube 40 pierces the end of the bubble (various FIGURES), it is still often convenient to begin by producing a closed, convex bubble. The sound tube 40 can be later inserted down the middle of the bubble, attached to the bubble tip, and the bubble material covering the end of the sound tube then cut away. So, mass manufacture can involve production of closed, convex bubbles.

Some polymer films, ePTFE and PTFE thin films, as well as polyurethane films, can support in-plane stretching or expansion without breaking. This in-plane expansion can produce some permanent set or deformation within the material which remains after the stretching or expanding force is removed. Thus, bubbles can be formed by stretching polymer films, ePTFE or PTFE films, or polyurethane films over convex mandrels with a variety of shapes: spherical, hemispherical, cylindrical with a hemispherical cap, spherical on top of a thinner cylindrical stem, light bulb shaped (approximately spherical top tapered into a narrower cylindrical stem). Bubble shapes with a larger bulbous top and a narrow stem, the light bulb shape for example, present a problem of removing the larger top of the mandrel through the thinner bubble stem without stretching, deforming, or destroying the thinner bubble stem. This problem is believed to be addressed by using an inflatable mandrel (not shown). In one embodiment of the method, the inflatable mandrel is a small rubber balloon which is blown up to form the polymer film, ePTFE film, or polyurethane film into the correct bubble shape. Then the rubber balloon is deflated so it can be easily removed through the neck of the formed polymer, ePTFE, or polyurethane bubble.

Another approach to stretching polymer film into bubbles with bulbous tops and narrower necks is to use a concave (female) mold of the desired shape (not shown). The polymer film is drawn into the mold cavity under vacuum and/or blown into the mold cavity under positive air or gas pressure. The polymer film enters through a narrow mold neck and expands in a bulbous mold shape. The bulbous ends of the bubbles can easily be removed through the narrow necks of the molds by deflating the bubbles before removal.

Bubbles can also be produced from polymer films, ePTFE or PTFE films, or polyurethane films without in-plane stretching of the film material. One way to do this is to fold or pleat the film material over a convex mandrel (not shown). The film material is gathered or cinched up around the base of the mandrel and can be fixed to a metal or plastic ring (not shown), which would define the base of the bubble. In this method of producing bubbles, it is also helpful if the mandrel is inflatable and can thus be easily removed from the inside of the bubble, by deflation.

Finally, formation of the bubble shape may involve a combination of some amount of polymer film, ePTFE or PTFE film, or polyurethane film stretching, some folding and pleating (especially around the bubble stem and base), and fixing the base of the bubble to a ring or collar. The ring or collar may be part of the sound tube of the co-axial device, it may be part of the separable coupling, or it may perform both these functions as well as being the connection for the base of the bubble.

Bubble Material Modification

The polymer film, ePTFE or PTFE film, or polyurethane film from which the bubble of the present invention may be produced can be modified by coatings applied to the surfaces of the films or infused into the porous structures of the films, in cases where the films are porous materials. Coating and infusing agents, include polymer latex coatings, especially polyurethane latex coatings and particularly water soluble polyurethane latex coatings, are preferred. These coatings may be used by themselves or they may be combined with other fillers, modifiers, pigments and the like. For example, colored polymer latex coatings may be used to color the bubble. Or, pigments or dyes may be added to uncolored latex coating materials in order to color the bubble. Coloring of the bubble is one means to distinguish different grades or prescriptions of bubbles (discussed in further detail below). Incorporating additional materials with the bubble material coatings, especially talc and fumed silica, may be used to modify the bubble surface properties to keep the bubble membrane from sticking to itself and/or to keep the bubble membrane from sticking to the user's ear canal.

Experimentally, coating bubbles made from porous materials such as ePTFE with a polyurethane latex was found to produce excellent bubble properties, including very low air permeability. The polyurethane coating was shown to be effective at filling to eliminate or at least reduce the size of most of the pore structures of the original bubble material. The use of a polyurethane latex coating mixed with fumed silica was also found to have excellent properties for bubbles including very low air permeability. The coating fills in some pores and reduces the size of other pores in the bubble film. Additionally, the surface of the film was shown, by electron microscope imaging, to have small jagged embedded particles of fumed silica. When two of such bubble surfaces contact one another, the fumed silica particles get in the way of intimate surface-to-surface contact and thus prevent the two surfaces from sticking together.

Surface coatings may be added to the polymer films, ePTFE or PTFE films, or polyurethane films prior to bubble fabrication. This can be done with conventional spraying or web coating techniques. Coating techniques such as silk screening and ink jet printing are used to apply the coatings to the bubble forming material in some areas and not in others or to apply the coatings in different amounts in different areas of the film. This process produces gradients or patterns in bubble material properties when the films are then fabricated into bubbles. Patterns in the coatings applied to the bubble forming film materials, for instance resulting in concentric rings on the bubble surface, may be used to focus, reflect, refract, damp, or otherwise modify sound in the present device.

Coatings may also be produced on the inner and/or outer surfaces of previously formed bubbles, by dipping the bubbles in coating solution or filling the bubbles with coating solution. Patterned or gradient coating patterns can be produced by these techniques if, for example, the top or the bottom half of an inflated bubble is dipped into the coating solution for a different amount of time than other parts of the bubble. Coating solution may be placed inside the top or the bottom part of an inflated bubble, thus producing patterns or gradients of coatings inside the bubble. The concentration of the coating solutions, and the time that the bubble material is exposed to such solutions can be varied in the dipping and interior coating processes to create additional patterning flexibility.

Air Loss of a Statically Inflated Bubble

The following calculations determine the theoretical rate of air loss from a statically inflated bubble. The particular example calculation is for a bubble composed of Kraton® polymer (a block copolymer of polystyrene and a polydiene, or a hydrogenated version thereof). These calculations are also a good approximation for the behavior of expanded polytetrafluroethylene (ePTFE) bubbles that have been coated with Kraton®, as well as for bubbles composed of polyurethane or ePTFE bubbles coated with polyurethane latex. In the case of an ePTFE bubble coated with Kraton®, the Kraton® is much more air permeable than the PTFE scaffolding of the ePTFE. It is assumed that gas leaks through a membrane of Kraton® equal to the total bubble wall thickness (including Kraton® and ePTFE). This provides an overestimate of the air loss, and thus is a worst case scenario.

Characteristics of the bubble used for the estimate are one cm diameter, spherical, with a 0.1 mil (0.00025 cm) wall thickness. Calculations were done for two internal pressures of (relative to outside atmospheric pressure) 100 Pa and 1 kPa.

In general, for transport of a gas through a polymer:

$$J=P(dp/dx),\text{where}$$

J is the flux of gas through a polymer membrane having units ($cm^3$ of gas)/(($cm^2$ of membrane)(second)), P is the gas permeability of the membrane, and (dp/dx) is the driving pressure gradient across the membrane, the x-coordinate representing distance in the membrane thickness direction.

The permeability of Kraton® to air is $1\times10^{-9}$ (($cm^3$ of air)(cm of membrane thickness))/(($cm^2$ membrane area)(second)(pressure in cm of Hg)) [Reference: K. S. Layerdure "Transport Phenomena within Block Copolymers: The Effect of Morphology and Grain Structure" Ph.D. Dissertation, Chemical Engineering, University of Massachusetts at Amherst, 2001.]

The driving pressure gradient $(dp/dx)\approx(\Delta p/\Delta x)$ is 295 (cm Hg)/(cm thickness) if the interior bubble pressurization is 100 Pa, and it is 2950 (cm Hg)/(cm thickness) if the interior bubble pressurization is one kPa.

The resulting flux of air through the membrane, J, is $3\times10^{-7}$ ($cm^3$ of air)/($cm^2$ of membrane)(second) when the interior bubble pressurization is 100 Pa, and J is $3\times10^{-6}$ ($cm^3$ of air)/($cm^2$ of membrane)(second) when the interior bubble pressurization is one kPa. Based on the volume and surface area of a one cm diameter bubble, these calculations indicate that with a 100 Pa internal pressure, the bubble will lose about two percent of its gas in 12 hours and that at one kPa it will lose about 20% of its gas in 12 hours, this time period being the assumed normal length of daily wear. The calculation is an estimate that assumes the air pressure inside the bubble remains constant throughout the process. This is a good approximation for the two percent loss found for 100 Pa, and thus the calculation is quite accurate. However, the estimate is poorer for the 20% loss at one kPa since such a significant loss will obviously reduce the bubble pressure and thus the driving force for further air loss. Thus, the 20% at one kPa is a worst case estimate. The calculation is sensitive to the thickness of the bubble wall. For example, a doubling of the wall thickness to 0.2 mil will cut the gas loss rate in half to one percent for 100 Pa. Increasing the wall thickness to one mil (still a perfectly viable bubble wall thickness for the invention) would cut all calculated loss percentages by a factor of 10.

The calculation is most accurate for a case in which the diaphonic valve is used to periodically top-off the pressure in the bubble. In the present case, to maintain a pressure of one kPa in the 0.1 mil thickness bubble for over 12 hours by intermittent use of a diaphonic valve (described further herein), the device would need to make up about 20% of the bubble volume in the 12 hour period. This is a very small amount of pumping and would fall below the approximate maximum of 20 minutes per day of pumping necessary to stay below five percent of battery use.

Actual experimental investigation of bubbles of the present invention has shown that they can be inflated and remain inflated, with no noticeable loss of pressure for at least a day and in some cases up to a week.

Influence of Atmospheric Pressure on Bubble

An inflatable ear canal sealing device, such as the present device, must be able to tolerate changes in the outside atmospheric pressure without either losing its seal or causing user discomfort. For instance, if a user with an inflated bubble in his or her ear ascends rapidly to the top of a tall building or ascends in an airplane, the resulting drop in atmospheric pressure will allow the bubble in the ear to expand. Too much expansion of the bubble in the ear may cause discomfort. Conversely, if a user with an inflated bubble in his or her ear descends rapidly from the top of a tall building or descends in an airplane, the resulting increase in atmospheric pressure will reduce the bubble volume. Too much contraction of the bubble may cause the loss of the acoustical ear seal.

As a first step, it is necessary to determine the maximum atmospheric pressure change that the inflated bubble might experience in a user's ear. Then, it is necessary to design the bubble and inflation system to tolerate these atmospheric pressure changes without undue adverse effects of the type described.

For the air in the bubble, pV=constant, where p is pressure and V is volume. This is a subpart of the ideal gas law, called Boyle's Law. It is valid for air over the range of pressures, temperatures and humidities found naturally on Earth.

If $\Delta p$ is allowed to equal the change in pressure from an initial pressure value, P, and $\Delta V$ is allowed to equal the change in volume of the bubble from initial volume value, V, then pV is constant, and we get the equation:

$$pV=(p+\Delta p)(V+\Delta V) \quad \text{(Eq. 1)}$$

This can be rearranged to show that:

$$\Delta V/V = \text{Fractional Change in Volume} = (1/(1+\Delta p/p)) - 1 \quad \text{(Eq. 2)}$$

In Eq. 2, ΔV/V and Δp/p necessarily have opposite signs—that is, a positive change (increase) in pressure (Δp/p) leads to a negative change (decrease) in volume (ΔV/V). Also, note that −(100%)*ΔV/V gives the percentage change in volume of an inflated bubble (as positive number) that needs to be dealt with due to a pressure change.

Figure 32:
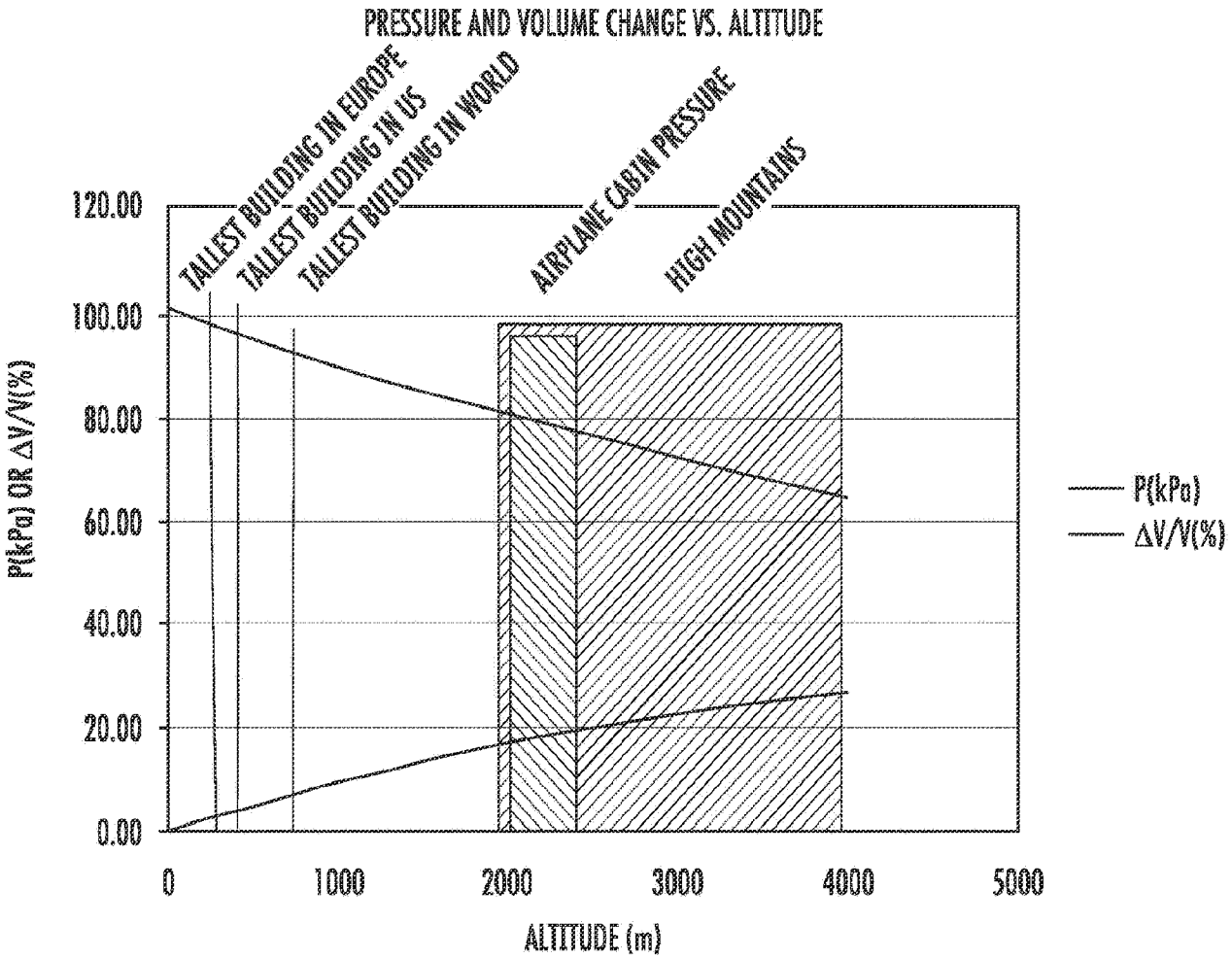
FIG. 32 is a graphic illustration of pressure and volume changes along a range of altitudes.

FIG. 32 shows a plot of atmospheric pressure versus altitude in meters constructed using a barometric pressure calculator found on the Internet (see, http://hyperphysics.phy-astr.gsu.edu/hbase/Kinetic/barfor.html). The calculation suggests that an elevator ride in a tall building should not pose much of a problem with regard to bubble contraction or expansion. For example, the tallest building in the World is 800 m high and, thus, a bubble would increase its volume by about eight percent upon ascending from the bottom (at sea level) to the top. The other very tall buildings in the world, in the US and Asia, are in the 500 m range and represent a volume increase of only about five percent. The tallest building in Europe is 300 m (similar to the Eiffel tower) and this gives a bubble volume change of around three percent.

Figure 33:
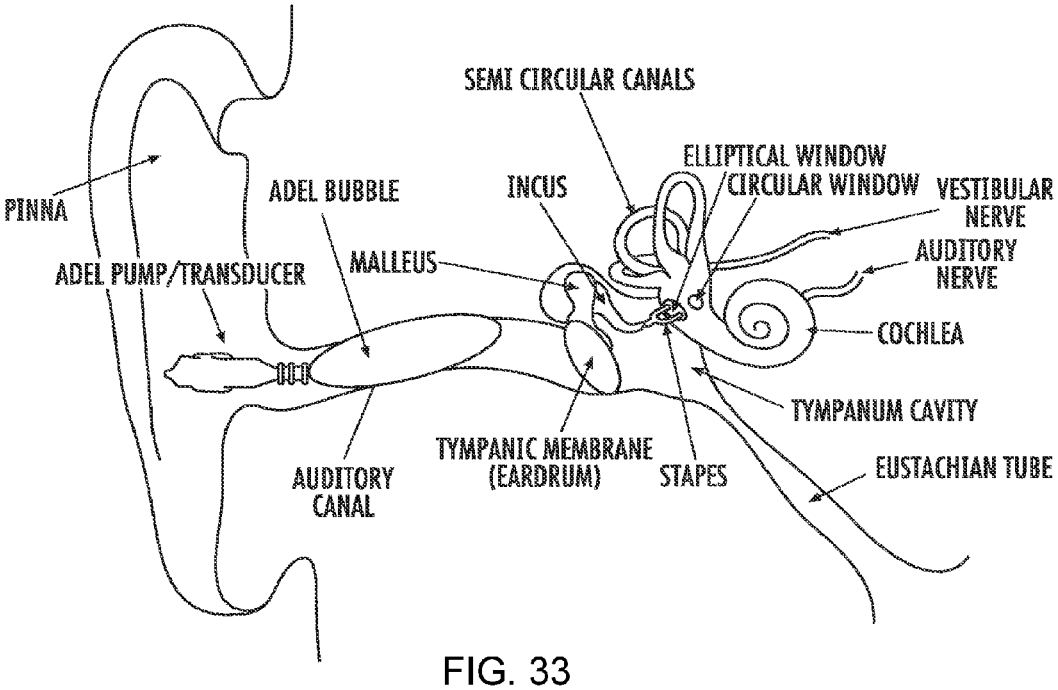
FIG. 33 is an illustration of an embodiment of the present invention inserted within an ear canal.
Figure 34:
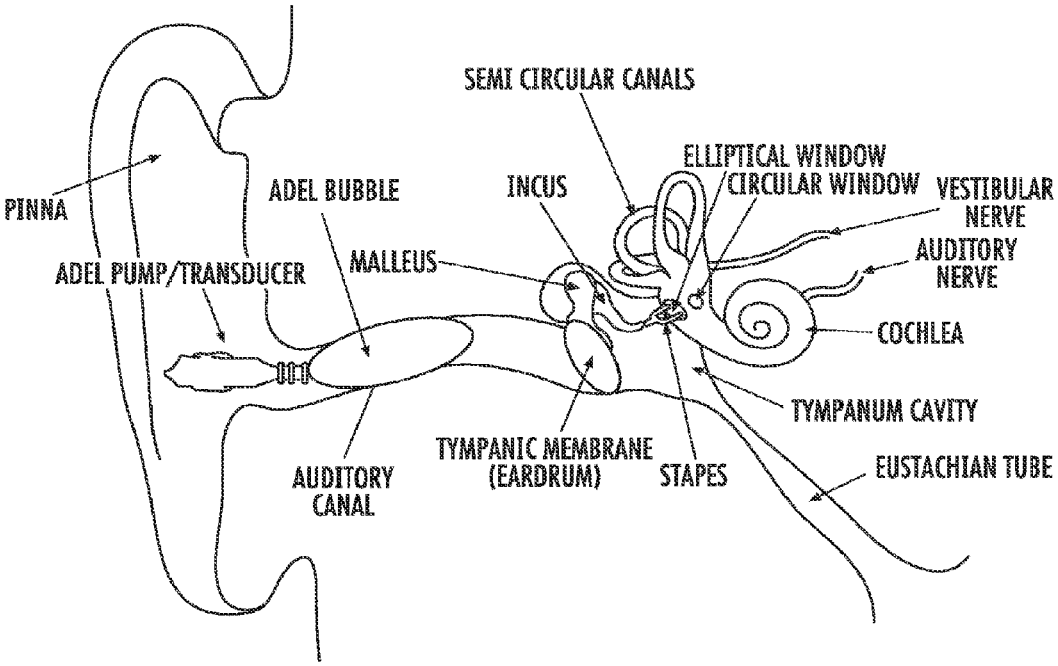
FIG. 34 is an illustration similar to FIG. 33.

Commercial airplane rides and trips up and down high mountains are more of a challenge with respect to pressure changes in the bubble. As FIG. 32 shows, such altitude changes can result in a bubble volume change in the 15% to 25% range. FIGS. 33 and 34 show a bubble 31 of the present invention, in the ear, as it undergoes a significant change in outside atmospheric pressure. The bubble 31 lays in the ear canal like a loosely inflated bag and it makes contact with a significant length of ear canal wall. At lower atmospheric pressure (FIG. 33), the bubble 31 is noticeably larger as it clearly extends a little further along the ear canal. At higher atmospheric pressure (FIG. 34), the bubble 31 is smaller and extends a little less distance along the ear canal. The difference in bubble volume and position in the ear canal between FIGS. 33 and 34 is not significant enough, even with a 25% change in bubble volume (i.e., the worst case scenario) to cause user discomfort or to disrupt the acoustic seal in the ear.

Another issue for the bubble of the present invention is surface wrinkles. Wrinkles in the bubble surface may result from the natural resting of the bubble along the ear canal surface, which may be rough, for instance, due to the presence of hairs. Also the bubble surface may be intentionally wrinkled by embossing or another mechanical or chemical processing technique. An advantage to wrinkles in the bubble wall is that they can aid the bubble in accommodating slight or moderate volume changes in response to slight or moderate changes in the external atmospheric pressure.

Fabrication of Prescription Bubbles

The physical properties of the bubble material, as discussed previously herein, influence the performance of the bubble in the ear. Relevant bubble material properties include thickness, areal density (mass per unit area of film), tensile modulus, strength, elasticity, air permeability, surface hydrophobicity or hydrophilicity, storage modulus, loss modulus, complex modulus, and mechanical damping coefficient. Certain directionally dependent properties (tensile modulus, strength, elasticity, storage modulus, loss modulus, complex modulus, mechanical damping coefficient) of the thin polymer film materials, used in bubble fabrication, may vary with changing in-plane direction. In other words, the polymer films for bubble construction may be anisotropic with respect to certain properties. The polymer films may also be isotropic with respect to directionally dependent, in plane properties. The polymer films used for bubble construction may be anisotropic with respect to some directionally dependent, in plane properties and isotropic with respect to other directionally dependent, in plane properties.

The values of these polymer film properties and the variations of these properties with direction and across the polymer bubble surface control bubble performance. Performance aspects thereby influenced include acoustical transmission of sound to the tympanic membrane, sealing of the ear canal, occlusion of the ear canal, wearer comfort, resonance and variable resonance of the sealed bubble and the sealed portion of the ear canal, sound impedance.

The various bubble material properties can be selected (by careful selection of various types and grades of bubble film material) to produce bubbles tailored to address the hearing problems of a given user or patient. For example, sound transmission and resonance may be maximized in the frequency range where the user has the greatest hearing loss. Different, predetermined prescription bubbles are produced to address common hearing problems, such as hearing loss in various commonly encountered frequency ranges. These prescription bubbles are distinguished by color coding or by different key codes in the separable couplings by which the bubbles are connected to the body of the listening device (including the transducer). Only the correct prescribed bubble and sound tube assembly will fit the coupling on the device. For more unusual hearing needs, it is possible to produce bubbles tailored to those needs of the individual. The individualized bubbles may be assigned a unique key code on their separable coupling. Thus, only the custom prescribed bubbles will fit the listening device of the user with a unique hearing or ear health issue.

Further, different portions of the bubble 31 can be optimized to selectively enhance different functions. For example, the back of the bubble (toward the outside of the ear) may be optimized to block sound transmission, thus improving isolation and avoiding feedback. The waist of the bubble (where it contacts the sides of the ear canal) may be optimized to improve the sealing function of the bubble, or to provide some air permeability for comfort and ear health. The front of the bubble (facing toward the tympanic membrane) may be optimized to enhance to acoustical properties of the trapped volume within the ear canal. A single bubble with gradients in various properties (moduli, permeability, elasticity, damping, etc.) across the surface, performs all or some of the specific functions sought.

An example of a way to produce tailored bubble material properties and to produce tailored gradients of those properties across the bubble surface is by coating or infusing a base polymer bubble material with a modifying agent. A specific example of the process is to take a bubble formed out of a semi-permeable polymer material and infuse a polymer latex into the semi-permeable structure, thus altering the density, permeability, thickness, and various mechanical moduli and coefficients of the bubble material. This type of infusion can be done to different degrees at different areas on the bubble surface, thus, leading to gradients in bubble material properties. A coating process can likewise be varied across the surface of the bubble material creating surface gradients in performance relevant properties.

The described process has yielded useful modifications of bubble properties when the base bubble material is expanded polytetrafluoroethylene (ePTFE) and the infusing latex is a water-based polyurethane latex. By infusing the polyurethane latex into the ePTFE bubble to different extents at different areas of the bubble, gradients in performance related properties are generated on the bubble surface. The extent of latex infusion into the ePTFE is controlled by controlling either the concentration of latex particles in the solution used to treat the ePTFE, or by the length of exposure of the ePTFE to the treating solution, or both.

3. Integration of Co-Axial Diaphonic Valve into Sound Tube

The sound tube 40 of the present invention can be embodied in several forms based on desired characteristics of device 10.

One or more small ports or orifices 73 in the wall of the sound tube 40 provide a path between the inside of the sound tube 40 and the space inside the polymer bubble 31 (or donut-shaped bubble 32). The small ports or orifices in the sound tube can serve not only as ports for synthetic jet based pumps, as described herein, but also allow sound into the bubble. As such, the sound energy in the bubble is transducted to the ear canal walls, increasing the sound richness.

Accordingly, when the transducer 20 produces sound, the principle of the synthetic jet (described in more detail above) and when present other working aspects of diaphonic valves including flaps, polymer sleeves, ingress ports and the like, leads to a flow of air from the sound tube 40, through the small orifices 73 in the wall of the sound tube 40, and into the polymer bubble 31. In this way, sound energy from the transducer 20 can be used to inflate the polymer bubble 31 in the user's ear.

Figure 35:
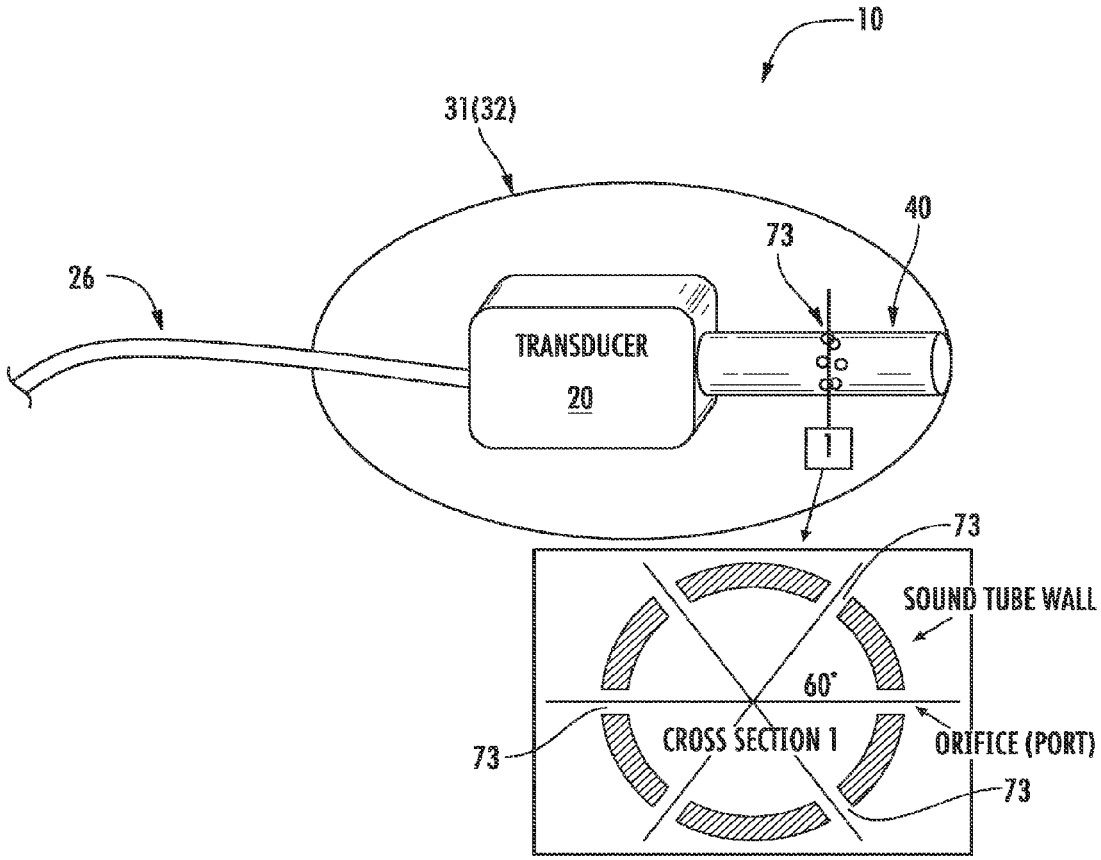
FIG. 35 illustrates a transducer and sound tube enclosed within a bubble, the sound tube having a pattern of ports arranged along a line around the circumference, in accordance with an embodiment of the present invention.

During the processes of insertion into the ear and inflation, the device, as shown in FIG. 35, draws the air needed to inflate the bubble 32 from the ear canal, down the sound tube 40 and into the bubble 32. This process helps to draw the device into the ear canal, since otherwise, the air already in the ear canal would need to be either pressurized (potentially leading to discomfort) or vented in order to make space in the canal for the bubble 32.

FIG. 35 shows a pattern of six ports 73 arranged equidistant (every 60 degrees of angle) along a line around the circumference of the sound tube 40. This particular port arrangement works very well, but other port arrangements also work including arrangements with fewer and greater numbers of ports and arrangements in which two or more rings of ports surround the sound tube at different locations along the sound tube 40. The size of the ports 73 and their location along the sound tube 40 influences the pumping efficiency as a function of the sound frequencies produced by the transducer 20. By altering the location of the ports 73 for a given sound frequency or by altering the sound frequency for a given location of the ports 73, it is also possible to reverse the pumping action of the device and to actively deflate the polymer bubble 32 for removal from the ear. Thus, with a fixed configuration of ports 73, the transducer 20 can produce one tone (frequency of sound) when inflation of the bubble 32 is desired and another tone when deflation is desired.

The device, as shown in FIG. 35, uses a single transducer 20 to produce the sound for inflation of the bubble 32 and maintenance of the bubble pressure as well as for the program material to which the person is listening. The device 10 has the advantage of allowing an unobstructed path from the transducer 20 to the user's tympanic membrane, while still harvesting energy to inflate the polymer bubble 32.

Other embodiments of this technology include a device 10 similar to that shown in FIG. 35, but with two separate transducers (discussed in further detail herein), one to produce the tone to inflate the bubble 31 (or 32) and another to produce the program material for the user. In the present case, the two transducers can both feed their respective acoustical outputs into a common sound tube 40, which functions as both the pumping mechanism for the bubble 31 and the sound path for the program material to the tympanic membrane.

Figure 36:
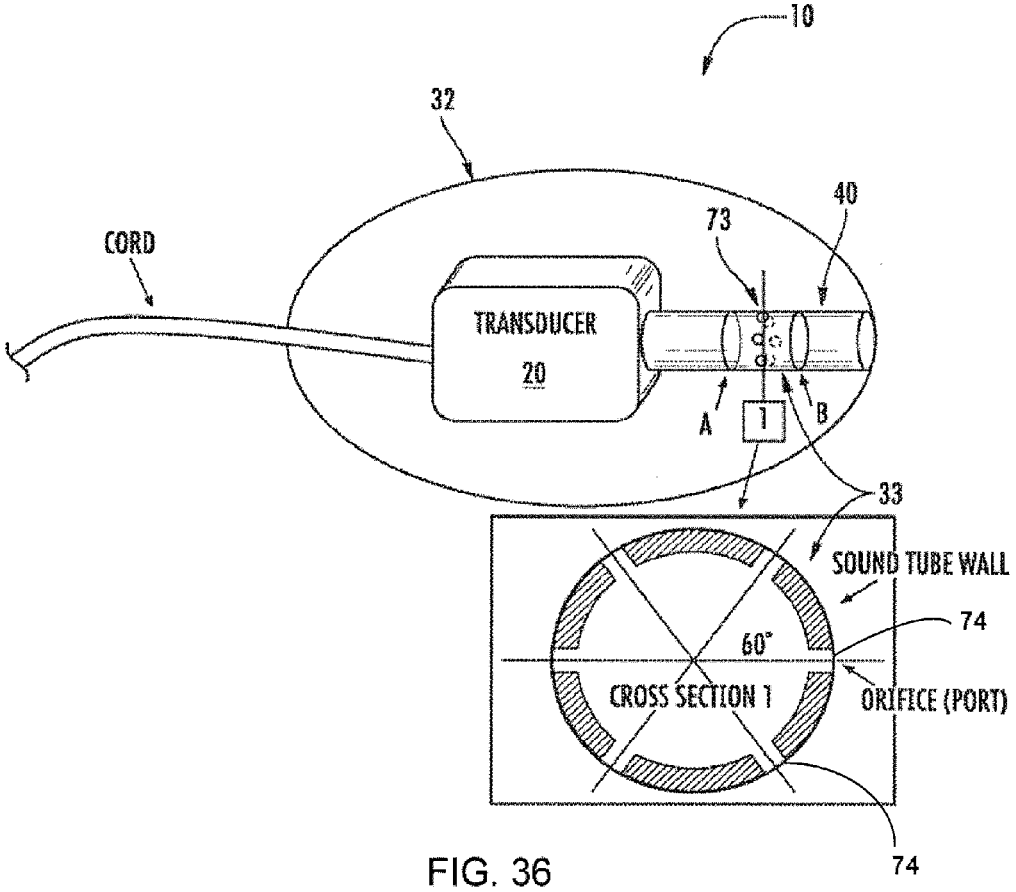
FIG. 36 shows a device similar to that illustrated in FIG. 35, including a polymer sleeve around a portion of the sound tube, in accordance with an embodiment of the present invention.

FIG. 36 shows a refinement of the coaxial structure, shown in FIG. 35, which increases the air pumping efficiency of the device 10. In the illustrated embodiment, a tight fitting sleeve 33 of thin polymer film covers a section of the sound tube 40, which includes the region containing the ports 73. The sleeve 33 is attached to the outside of the sound tube 40 with an airtight seal at position A. The sleeve 33 ends at position B, but is not attached (sealed) at this point.

The device 10 will also work if the sealed and open ends of the polymer sleeve 33 are reversed, i.e. the sleeve 33 is sealed at B and open at A. The device 10 will also work if both ends of the sleeve 33, A and B, are open.

In another working embodiment, both ends, A and B, of the sleeve 33 are sealed. In this embodiment, the polymer sleeve 33 has one or more small holes or ports 74. These holes 74 in the polymer sleeve 33 do not line up with the orifices or ports 73 in the sound tube 40 and they do not line up with any air ingress tube (discussed further herein) openings.

However, for the purposes of continuing the illustration of the invention, an embodiment where the sleeve 33 is sealed at A and open at B is considered.

As shown in the cross-section of FIG. 36, the polymer sleeve 33 now covers the ports 73 in the wall of the sound tube 40.

The embodiment of FIG. 36 draws the air needed to inflate the polymer bubble 32 from the sound tube 40. Thus, when inserted into the ear, this embodiment draws air from the ear canal into the bubble 32.

Figure 37:
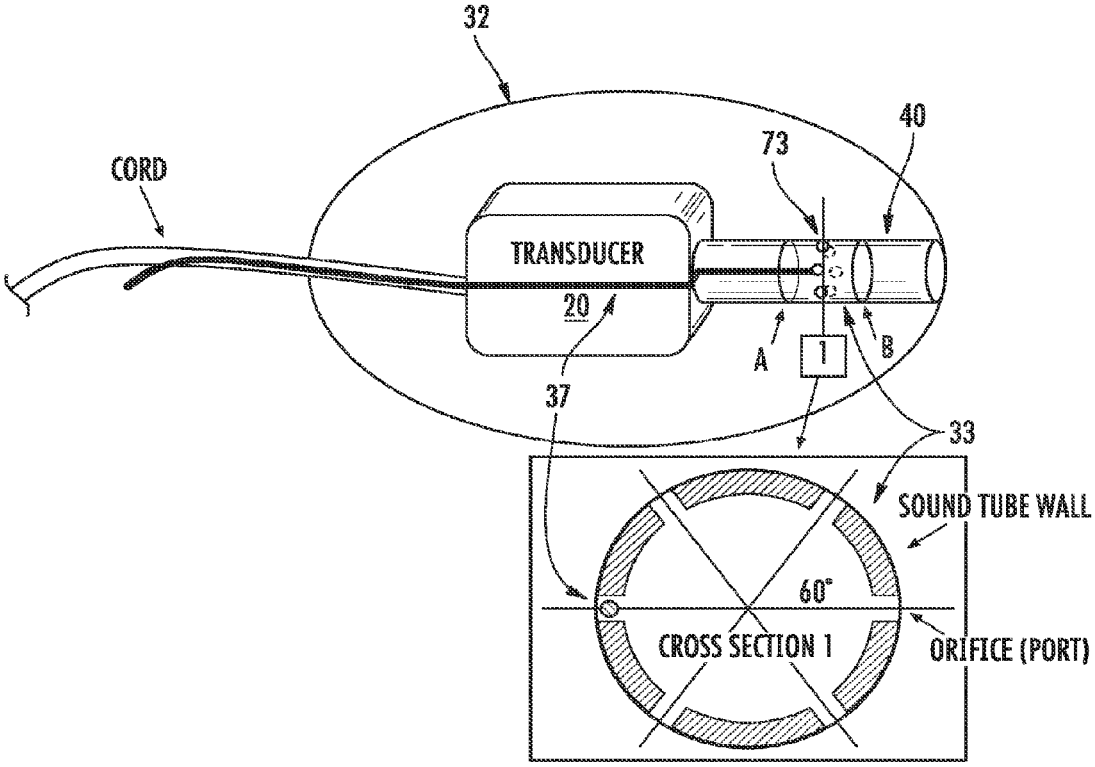
FIG. 37 shows an embodiment similar to that illustrated in FIG. 36, including an air ingress tube.

FIG. 37 shows another embodiment of a coaxial device in which an air ingress tube 37 is added to allow air to be drawn from outside of the ear canal, for the purpose of inflating the polymer bubble 31.

The air ingress tube 37 has one end outside of the bubble 31 and outside of the ear canal. The air ingress tube 37 runs into the bubble 31 and makes its way to the side of one of the ports 73 in the wall of the sound tube 40.

Figure 38:
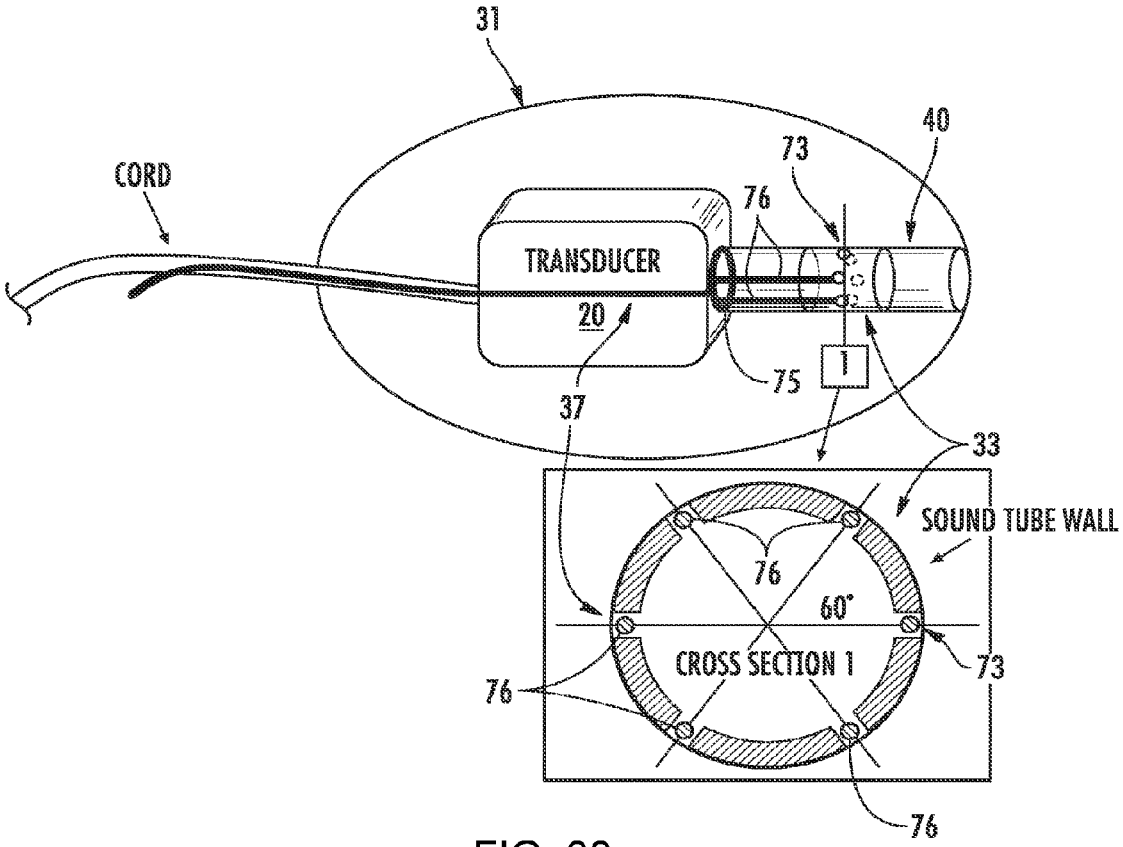
FIG. 38 shows an embodiment similar to that illustrated in FIG. 37, including an air ring manifold.

There is a great deal of possible design variability in the configuration of air ingress tubing 37. FIG. 38 shows an embodiment where air ingress tube 37 connects into the sides of all six ports 73 in the wall of the sound tube 40. Of course this particular arrangement of ports 73 is illustrative, but not limiting for the invention. There may be more or less ports 73 and they may be arranged in a different pattern.

FIG. 38 shows an air ingress tube 37 which uses a circular manifold 75 at the base of the sound tube 40 to connect individual air ingress tube sections 76 for each port 73 to the main air ingress tube 37 that leads outside of the bubble 31 and outside of the ear canal. Other branching schemes for the air ingress tubes 76 allow the main air ingress tube 37 to reach multiple ports 73 are claimed as part of this invention. FIGS. 37 and 38 illustrate ingress tubes 76 that run inside the walls of the sound tube 40 to the points where they intersect the ports 73 in the sound tube wall. The tubes 76 may also be small tubes attached to the outside or inside surfaces of the sound tube 40.

Figure 39:
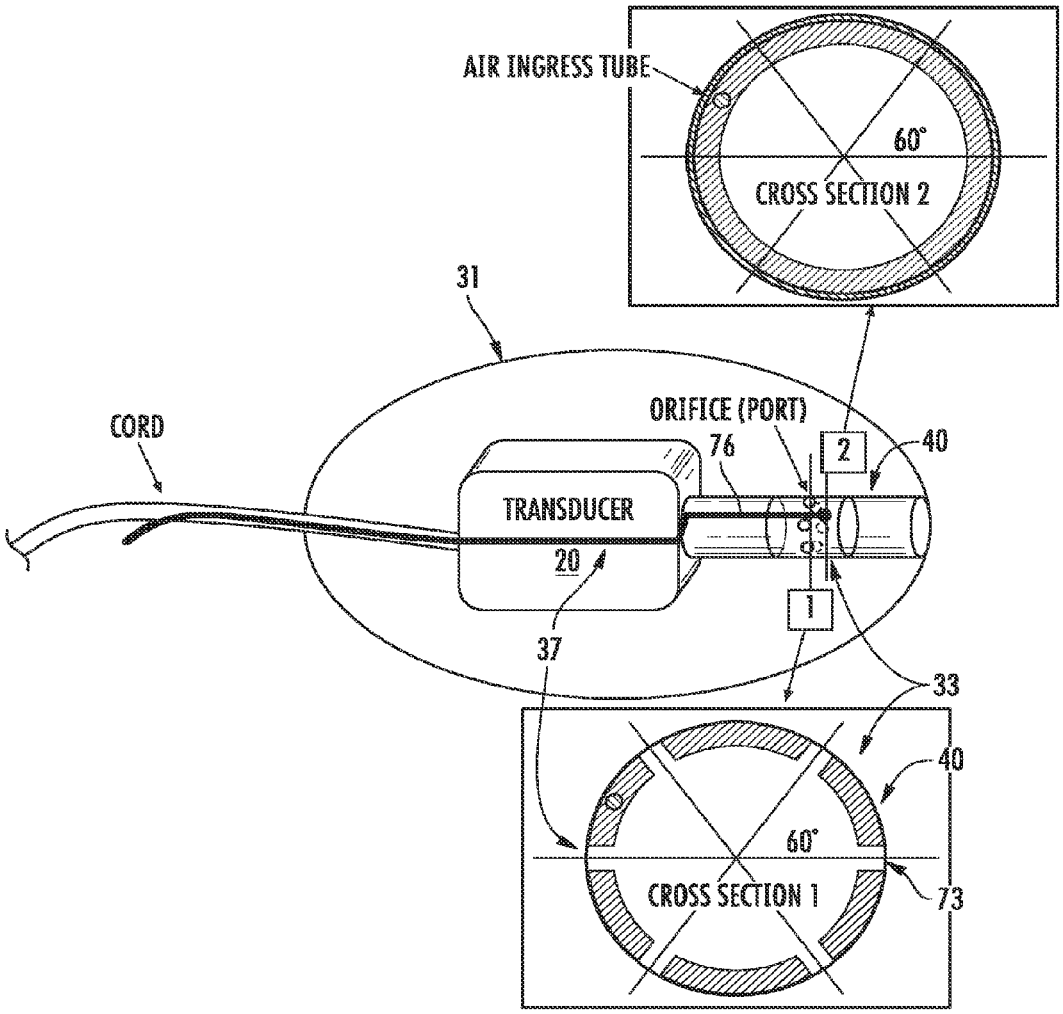
FIG. 39 shows an embodiment similar to that illustrated in FIG. 38.

The air ingress tubes 76 do not necessarily need to intersect the ports in the wall of the sound tube 40. As shown in FIG. 39, an air ingress tube 37 may have its own outlet on the outer surface of the sound tube 40. In this case, the air ingress tube outlet 77 is under the polymer sleeve 33, which surrounds the sound tube 40, and it is located between the ports 73 in the sound tube wall and the open end of the sleeve 33, location B in the illustration.

Employing an air ingress tube manifold 75, of the type shown in FIG. 38 or one of numerous other possible branching schemes, multiple air ingress tube section outlets 77 may be located in the surface of the sound tube 40 between the ports 73 and the open end of the polymer sleeve 33.

Figure 40:
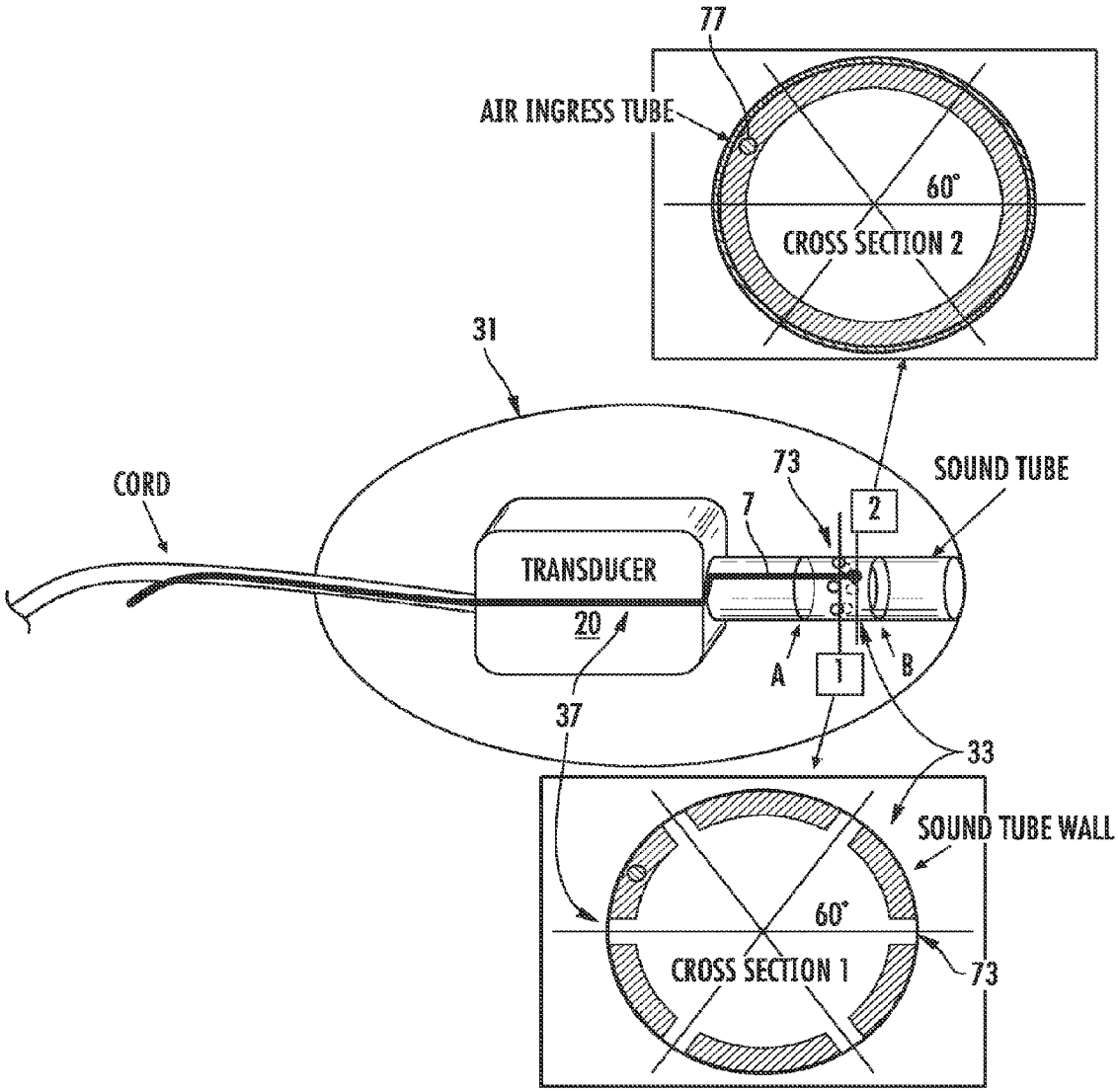
FIG. 40 shows an embodiment similar to that illustrated in FIG. 39.

FIG. 40 shows another embodiment of the coaxial device in which the air ingress tube 37 has its outlet 77 in the outer sleeve 33 of the sound tube 40, beneath the polymer sleeve 33, between the ports 73 and the open end of the polymer sleeve 33. In this case, the circular manifold 75, which distributes the ingress air, is located at the position of the air ingress tube outlet 77. One particular embodiment of the manifold 75 at the air ingress tube outlet 77 is a channel in the surface of the sound tube 40 which runs around the circumference of the sound tube 40. This channel is fed by the air ingress tube 37 and it remains a closed circular manifold when the polymer sleeve 33 is covering it. However, when the polymer sleeve 33 moves away from the outer surface of the sound tube 40, due to the synthetic jet action of the ports, this ingress air manifold releases ingress air.

The design features of the ingress air tube system (length and diameter of tubing, size, location and number of ingress air inlets and outlets, etc.) control the amount of resistance or impedance to the flow of ingress air. Air is pulled through the ingress air tubing system under a pressure differential created by the acoustical pumping of the present device. This pump-generated pressure must be sufficient to overcome the line-resistance in the ingress air tube system. By balancing the flow resistance to ingress air and the pumping characteristics of the device 10, the source of air used to inflate the polymer bubble (or to maintain inflation) can be appropriately balance between air from the ear canal (coming down the sound tube 40) and ingress air. For example, it is desirable to use some of the air in the ear canal as part of the bubble inflation, so as to not over pressurize the ear canal upon device insertion. However, it is also desirable not to draw too hard on the air in the ear canal during bubble inflation (or to maintain inflation), since this leads to a partial vacuum in the ear canal, which is also uncomfortable for the user. By tuning the flow resistance of the air ingress tubes, a balance is achieved where the correct (most comfortable) amount of air is taken from the ear canal and the remainder is brought in through the air ingress tubing.

Figure 41:
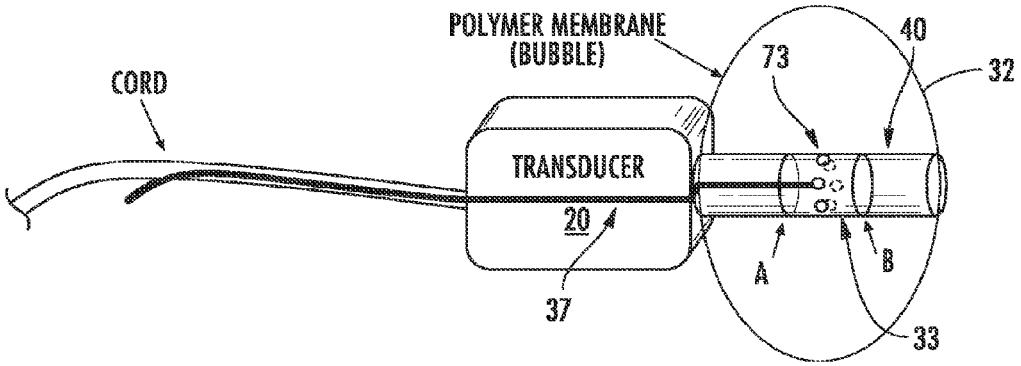
FIG. 41 shows an embodiment similar to that illustrated in FIG. 37 with only the sound tube enclosed within the bubble.
Figure 42:
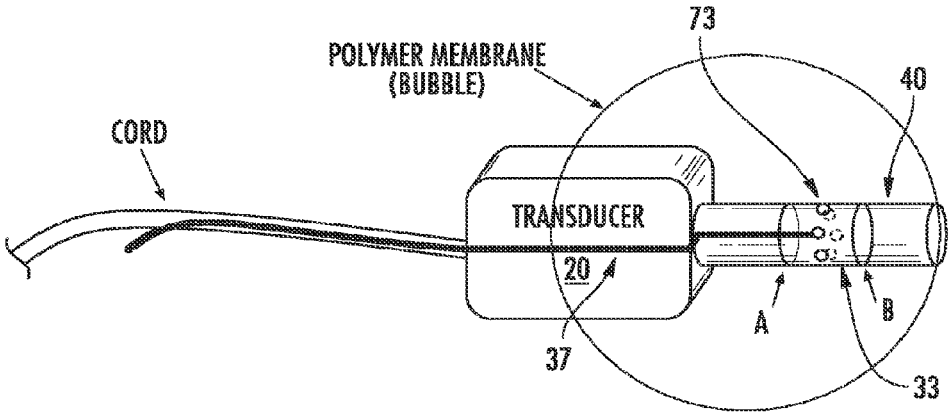
FIG. 42 shows an embodiment similar to that illustrated in FIG. 41 with the transducer partially enclosed within the bubble as well.

Embodiments of all the designs shown in FIGS. 35-40 can also be produced with the transducer 20 not enclosed in the bubble 31 (see FIG. 41) or with the transducer 20 only partially enclosed in the bubble 31 (see FIG. 42). These two figures illustrate one particular air ingress tube configuration combined with a bubble 31 which does not enclose the transducer 20 or combined with a bubble 31 which partially encloses the transducer 20. However, it is implied that all possible air ingress tube designs and all possible sound tube port designs can be combined with either a bubble that does not enclose the transducer or only partially encloses the transducer.

In other embodiments, FIG. 43 through FIG. 50, air ingress along the outside of the sound tube 40 proceeds via a groove or grooves 78 in the outer surface of the sound tube 40. The groove 78 is covered by the polymer sleeve 33 on the outer surface of the sound tube 40. The groove(s) 78 covered by the polymer sleeve 33 forms an effective air ingress tube 37 along the outside of the sound tube 40.

Figure 43:
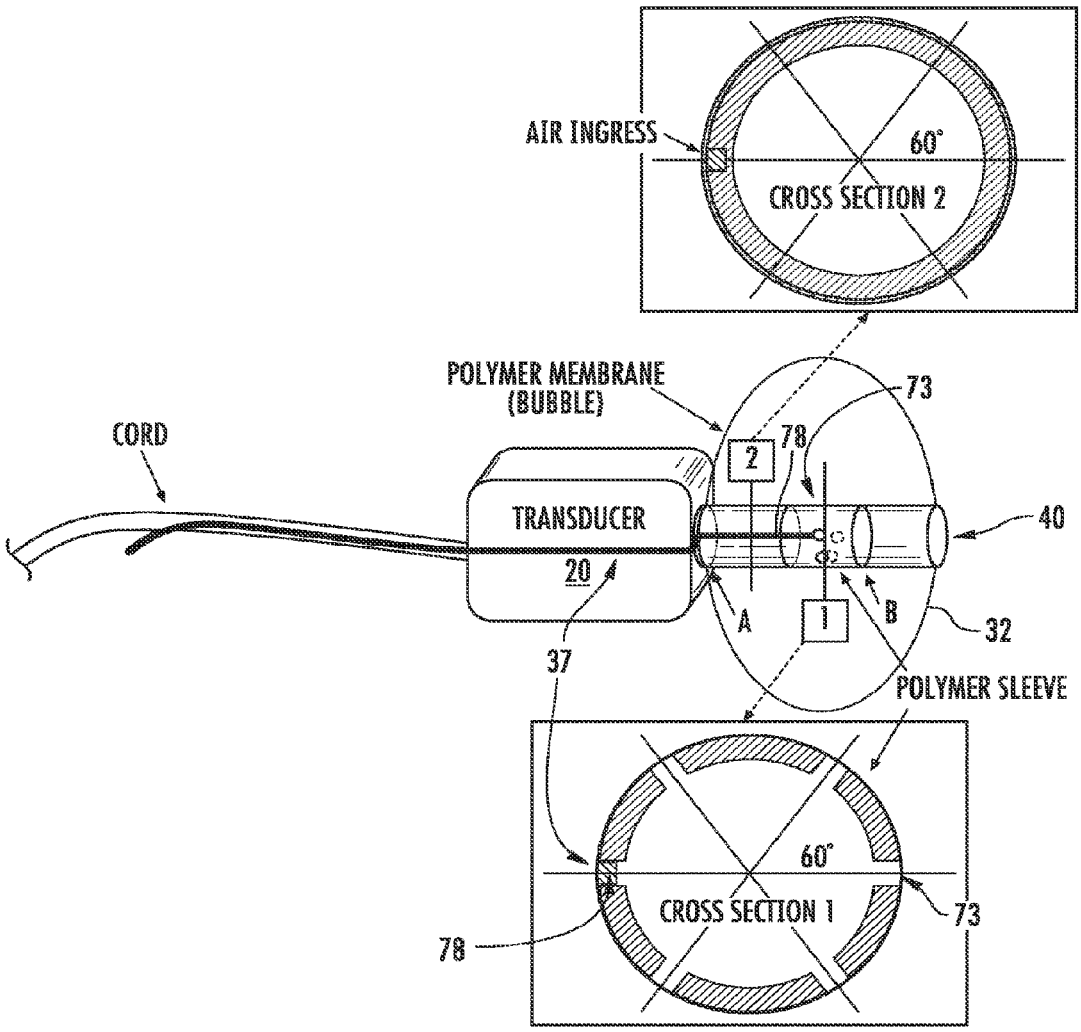
FIG. 43 shows an embodiment similar to that illustrated in FIG. 41.

FIG. 43 illustrates an embodiment in which an air ingress tube 37 of the same type shown in previous embodiments routes the air to the base of the sound tube 40. There the air ingress tube 37 connects to the groove 78 in the outside of the sound tube 40 at point A, where the polymer sleeve 33 is fixed to the outside of the sound tube 40. In FIG. 43, the bubble 31 does not enclose the transducer 20.

Figure 44:
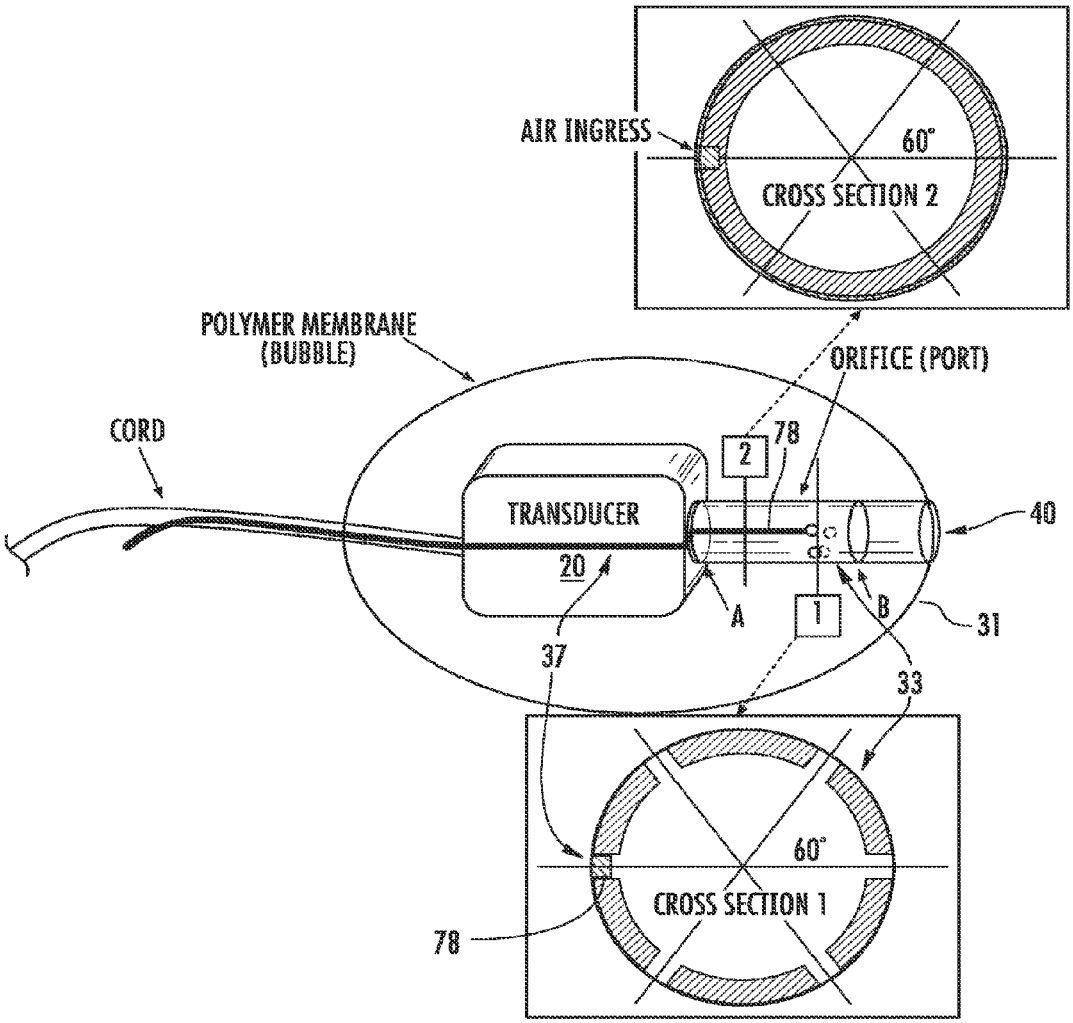
FIG. 44 shows an embodiment similar to that illustrated in FIG. 40.

FIG. 44 shows an embodiment in which the bubble 31 does enclose the transducer 20 and the air ingress tube 37 routes air to position A, where the groove 78 in the in the outside of the sound tube 40 begins.

Figure 45:
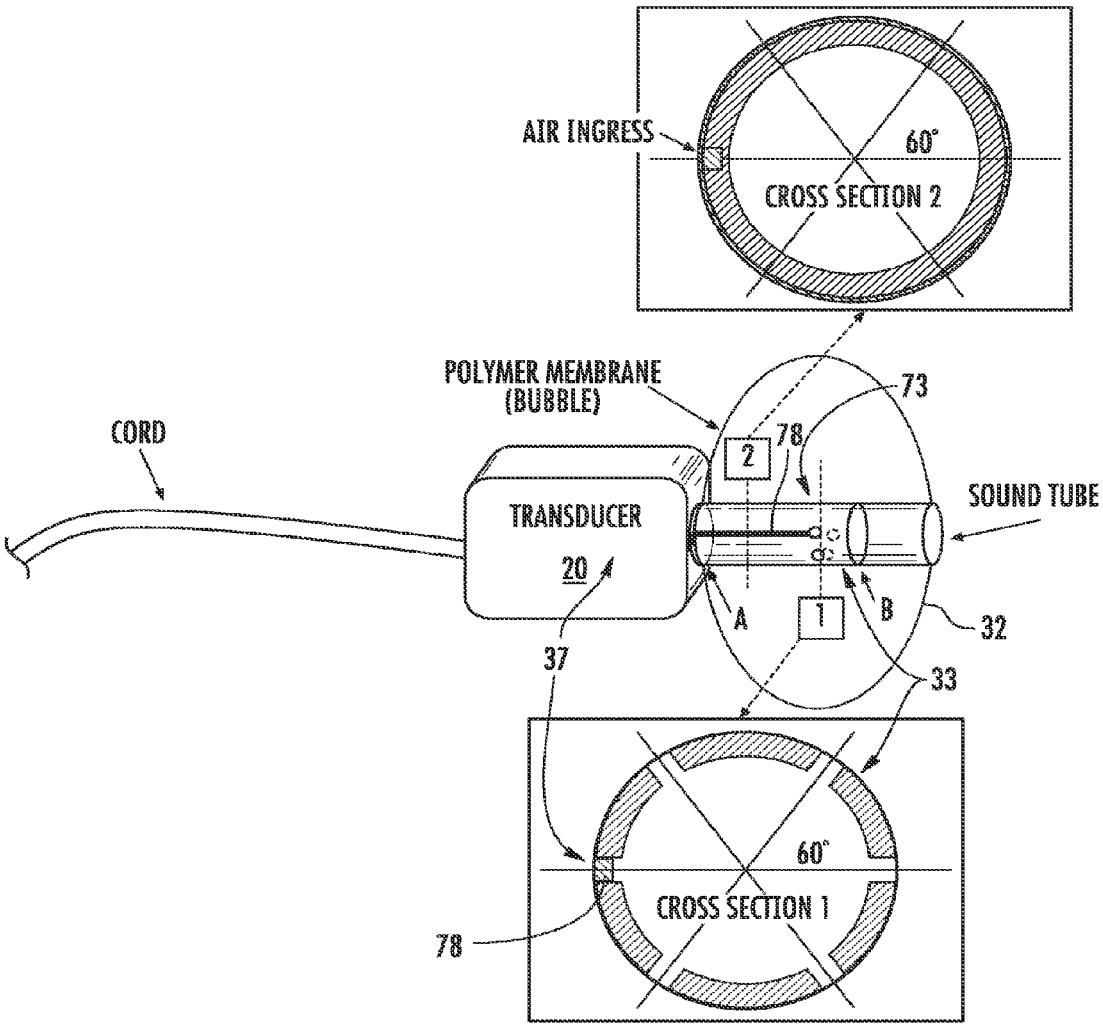
FIG. 45 shows an embodiment similar to that illustrated in FIG. 41.

FIG. 45 shows an embodiment similar to that in FIG. 43, except that there is no air ingress tube 37 leading to the start of the groove 78 at position A on the outside of the sound tube 40. Because, in this embodiment, the bubble 31 only covers the sound tube 40, allowing the end of the groove 78 nearer the transducer 20 to protrude just beyond position A, provides ingress to air along the groove 78.

Figure 46:
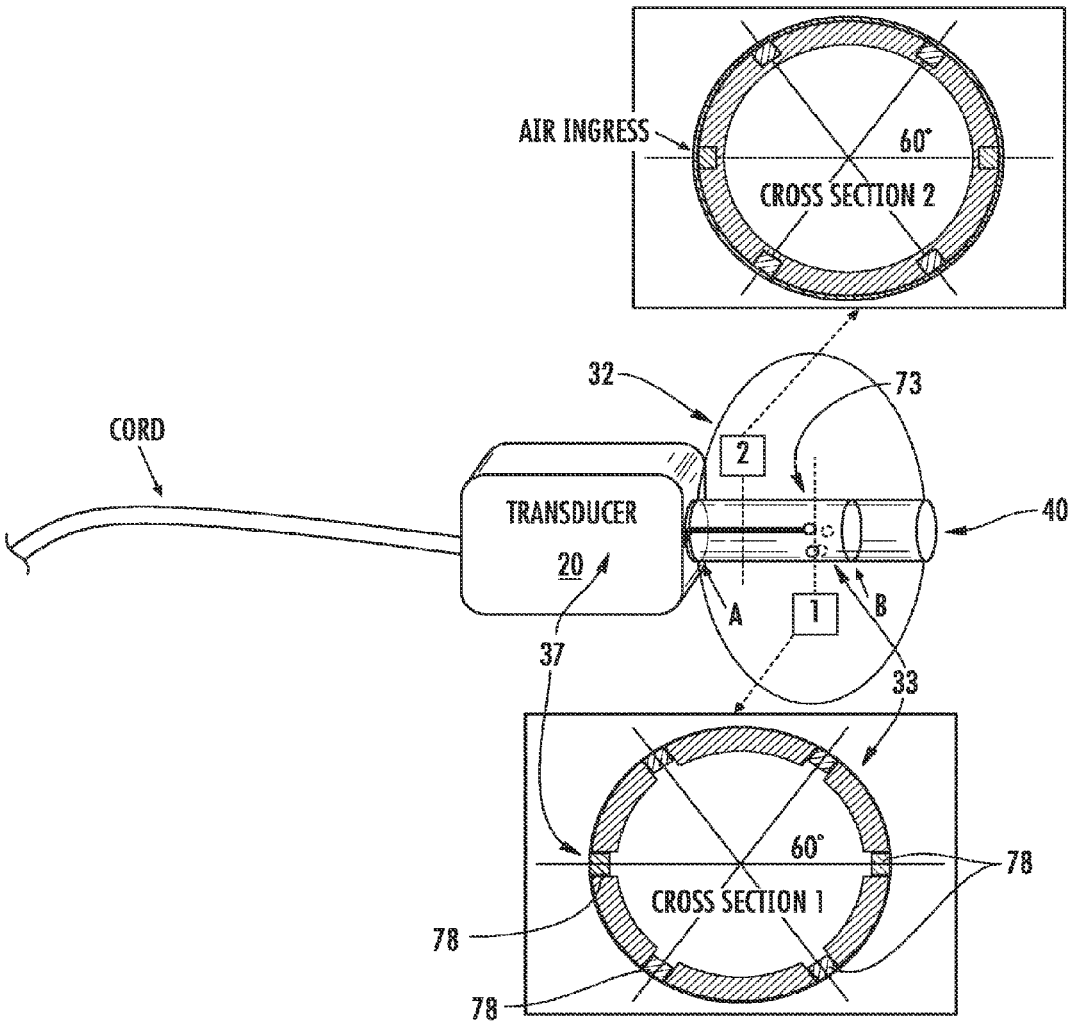
FIG. 46 shows an embodiment similar to that illustrated in FIG. 45 with multiple air ingress grooves.

FIG. 46 shows an embodiment similar to that illustrated in FIG. 45 except there are six (6) grooves 78 in the outside of the sound tube 40 providing air ingress from just beyond position A. Other embodiments similar to that of FIG. 46 can have fewer or more such grooves 78.

Figure 47:
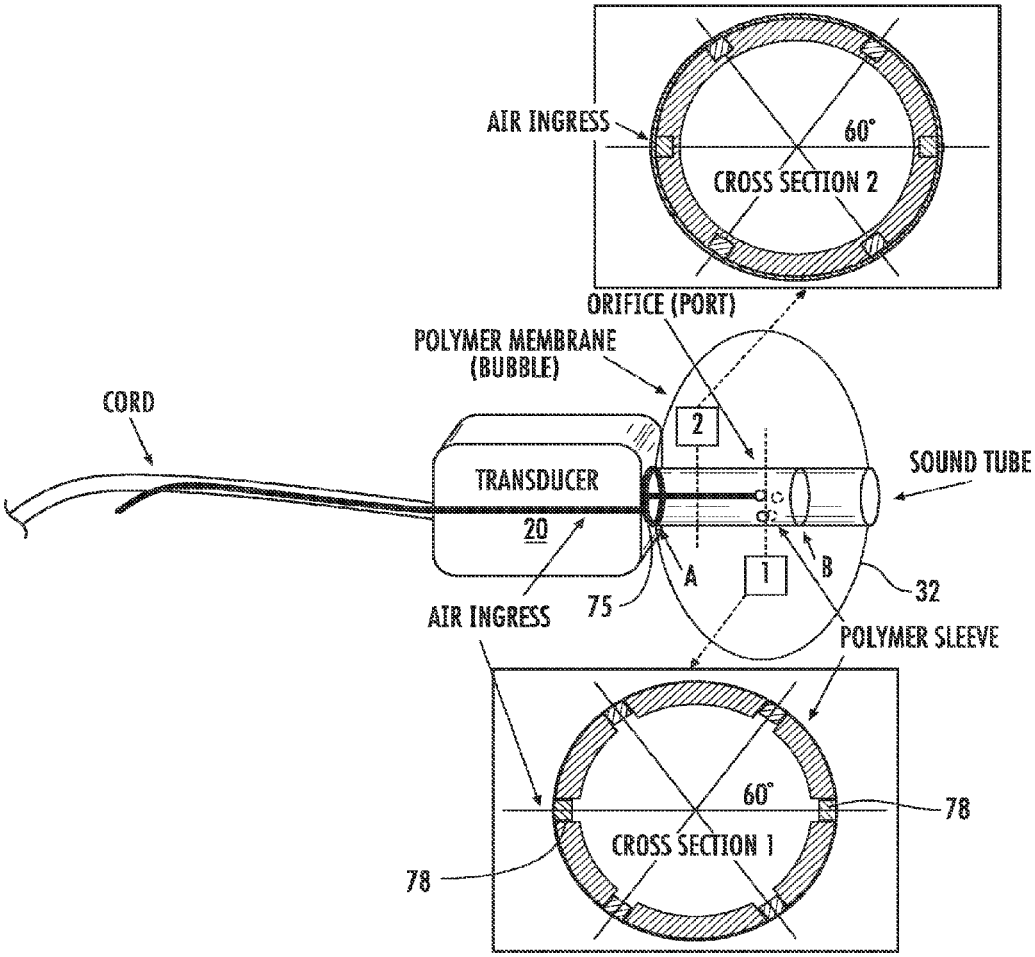
FIG. 47 shows an embodiment similar to that illustrated in FIG. 46 with a air ring manifold at the base of the sound tube.

FIG. 47 shows an embodiment in which there are multiple grooves 78 in the outside of the sound tube 40 which are providing air ingress. The multiple grooves 78 are fed air from a circular manifold 75 at the base of the sound tube 40, which in turn is fed by an air ingress tube 37.

Figure 48:
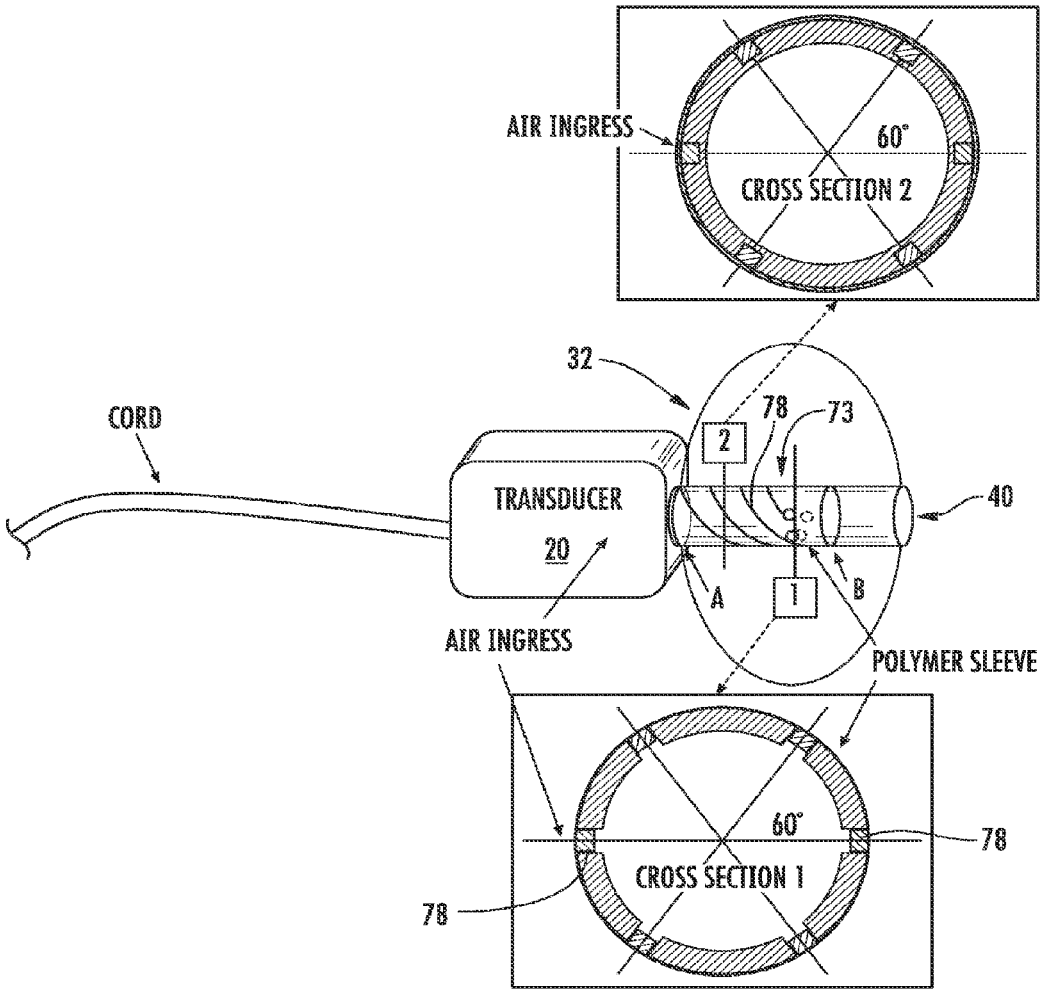
FIG. 48 shows an embodiment similar to that illustrated in FIG. 46 with spiral grooves.

FIG. 48 shows an embodiment similar to that of FIG. 47, with multiple grooves 78 in the outside of the sound tube 40 providing air ingress from just beyond position A. However, in FIG. 48, the grooves 78 are curved rather than straight. In this example the grooves spiral around the sound tube 40.

Figure 49:
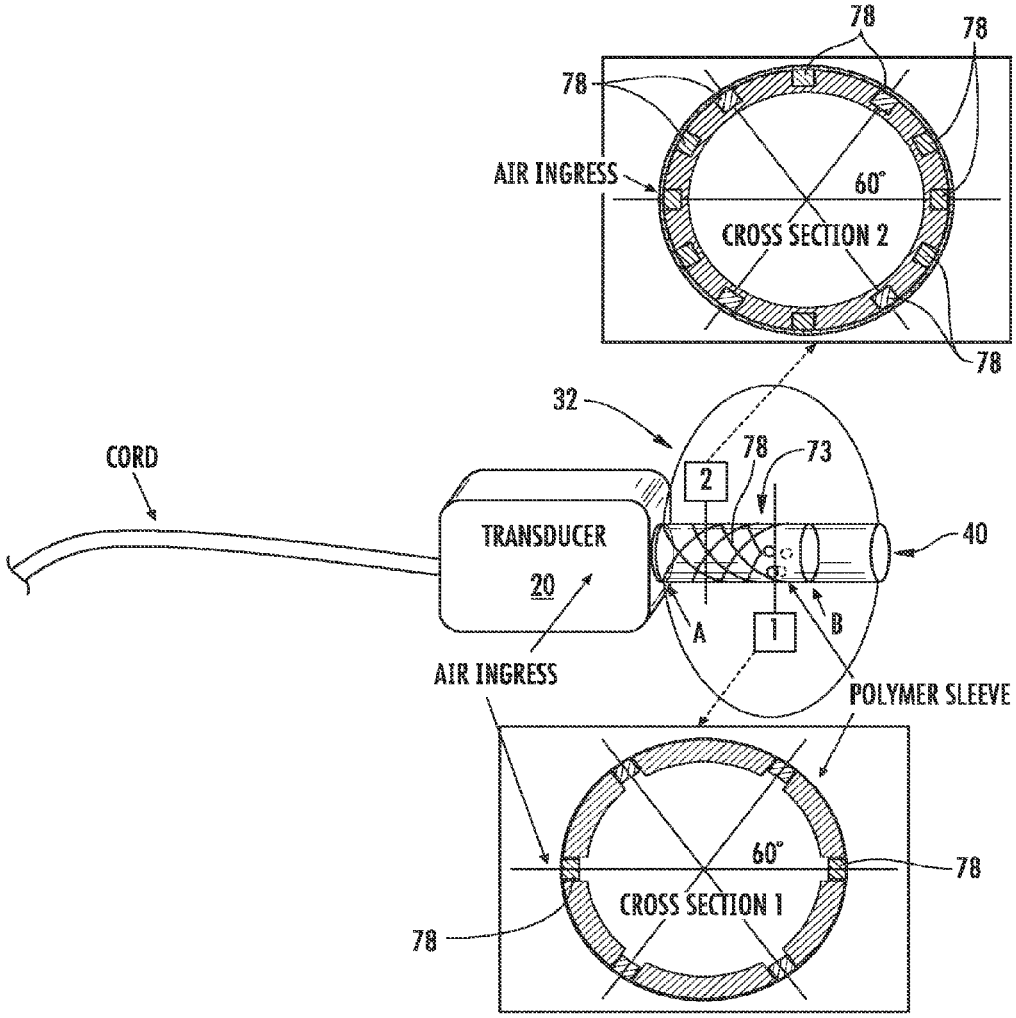
FIG. 49 shows an embodiment similar to that illustrated in FIG. 48 with crossing spiral grooves.

FIG. 49 shows an embodiment similar to that of FIG. 48, except that there are now two sets of helical grooves 78 spiraling around the sound tube 40. One set of helical grooves turns clockwise (right handed helix) and the other set of helical grooves turns counterclockwise (left handed helix). The two sets of helical grooves cross one another.

In all of the embodiments in FIGS. 43 through 49, the air ingress grooves 78 in the outside of the sound tube 40 are shown intersecting the orifices (ports) 73 in the sound tube 40. Other embodiments have these air ingress grooves 78 in the outside of the sound tube 40 terminating beyond the orifices (ports) 73, analogous to the embodiment shown in FIG. 39, or terminating in a groove around the circumference of the sound tube 40, analogous to the embodiment shown in FIG. 40.

Figure 50:
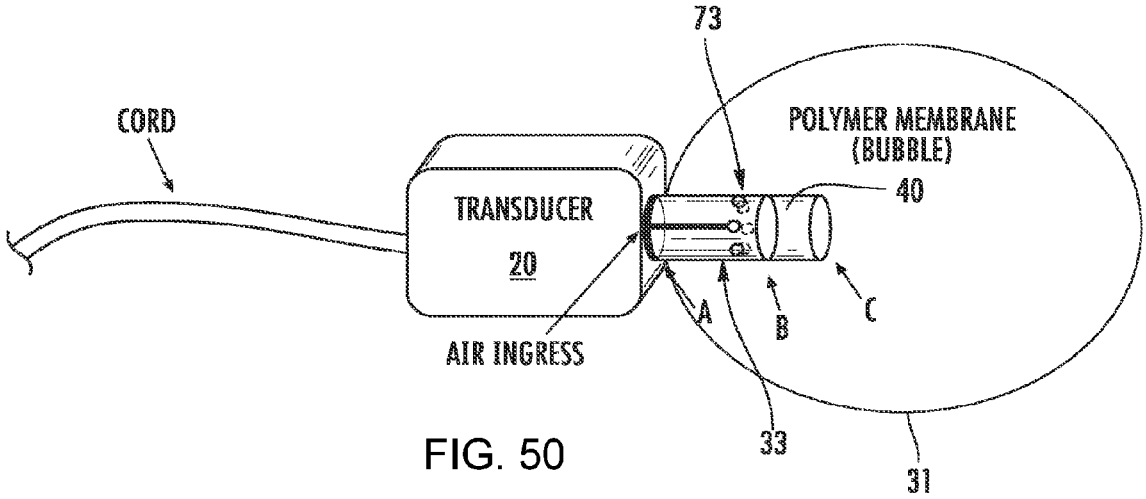
FIG. 50 shows an embodiment having a short sound tube in accordance with the present invention.

FIG. 50 shows an embodiment of the coaxial device 10 in which the sound tube 40 has an open end (position C) within the bubble 31. In this embodiment the bubble 31 acts to transport the sound further down the ear canal toward the tympanic membrane. Any embodiment in which the sound tube 40 terminates with an open end within the bubble 31 must have an air ingress system. All the types of air ingress systems shown in FIGS. 43 through 49 are possible with a sound tube 40 terminating with an open end in the bubble 31, as in FIG. 50. Furthermore, embodiments with the sound tube 40 terminating in at an open end (position C) within the bubble 31 can have bubbles which only enclose the sound tube 40 (as shown in FIG. 41) or can have bubbles which also fully or partially enclose the transducer 20 (see FIGS. 40 and 42).

Alternate Features

Transducer Impedance Pressure Feedback Control Circuit

When using the diaphonic valve 22 or 50 to pressurize an inflatable member (such as the inflatable bubble 31) it may be desirable to be able to sense the pressure achieved and the regulate pumping through a feedback mechanism. This can prevent over- or under-inflation of the system. A backpressure on the diaphonic valve 22 or 50 increases the pressure loading on the transducer 20, which is driving the pumping system. The degree of pressure loading on the transducer 20 alters the electrical impedance of the transducer 20. Measurement of this transducer impedance, therefore, provides a measure of the speaker loading and thus of back pressure in the system. Feedback circuitry can then be used to monitor and control transducer operation, as sensed by transducer electrical impedance, for the purpose of maintaining control of system pressurization.

Additionally, the use of pressure sensing devices (not shown) within or external to the audio or pressurizing transducers may be coupled to appropriate feedback-servo circuitry to achieve pump/pressure regulation which can be programmable.

Mechanical Reversal of Pump Operation

As described herein, the utility of being able to reverse the pumping direction of the diaphonic valve 22 or 50 is of some value. It allows control of pressure levels in the inflatable member 30 and also allows active deflation as well as active inflation of the bubble 31 (or 32).

Another method of reversing the pumping direction of the diaphonic valve 22 or 50 is to mechanically alter the acoustic and static pressure impedance of the ingress port and tube to achieve a reverse flow operation of the valve. Appropriate restriction of the ingress flow and or changing the acoustic impedance of the ingress port orifice and tube to the audio frequencies used within the diaphonic valve 22 or 50 results in a reversal of flow within the device 10. This allows the diaphonic valve 22 or 50 to be variably switched between inflation and deflation modes without the use of the routing manifold or similar device. Without limitation to such approaches, flow restriction methods can include devices which mechanically reduce the inside diameter of malleable tubing attached to the diaphonic valve ingress tube 37, or in the case of a port which employs no ingress tube a cone tip may be variably advanced into the ingress port orifice to achieve flow reversal. Thus, application of a flow spoiler of some sort to the ingress port or ingress tube can be used to reverse the flow of the diaphonic valve 22 or 50.

Moving Orifice

FIG. 51 shows an orifice 61 in a moving diaphragm 28. The diaphragm 28 can be either a rigid or a flexible material. As indicated by the arrows, the diaphragm 28 oscillates perpendicular to its own surface. The oscillations are symmetric and are represented in the figure by a saw-tooth waveform. A symmetric sine wave would produce similar results. This creates synthetic jet fluid flow through the orifice 61 in both directions. For example, as the diaphragm 28 moves to the right, fluid moves through the orifice 61 to the left creating a synthetic jet on the left. As the diaphragm 28 moves to the left, fluid moves through the orifice 61 to the right creating a synthetic jet on the right. FIG. 51 represents a symmetrical arrangement in which the flow effects of the two opposed jets cancel one another out. Thus, this symmetric arrangement is not useful for pumping fluid.

Figure 53B:
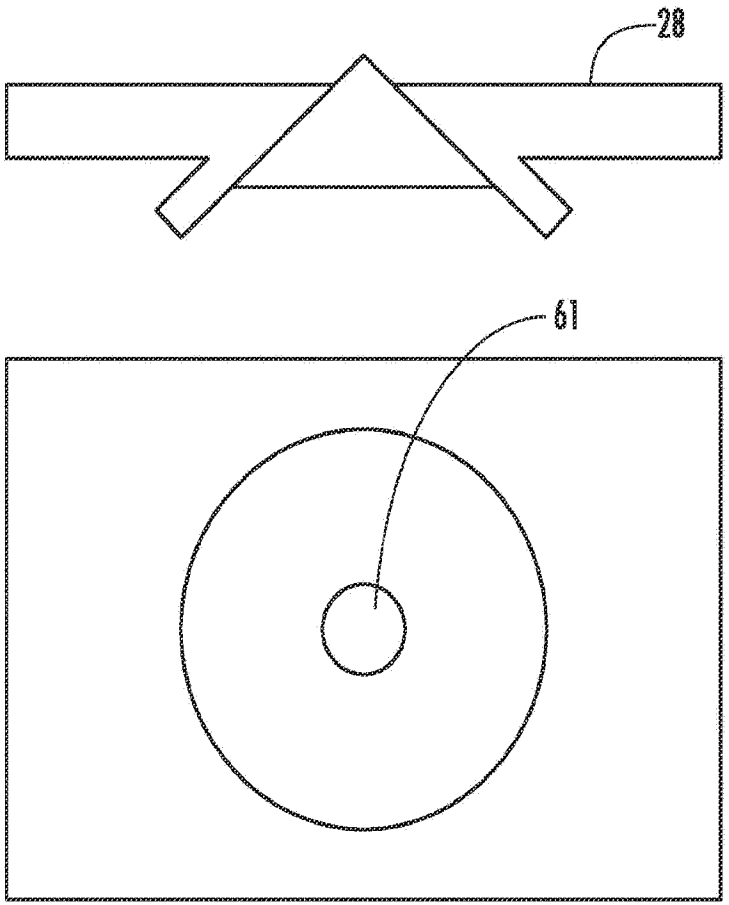
FIGS. 53A and 53B are bottom and side views of a schematic illustrating a conical orifice and a raised funnel, respectively.
Figure 53A:
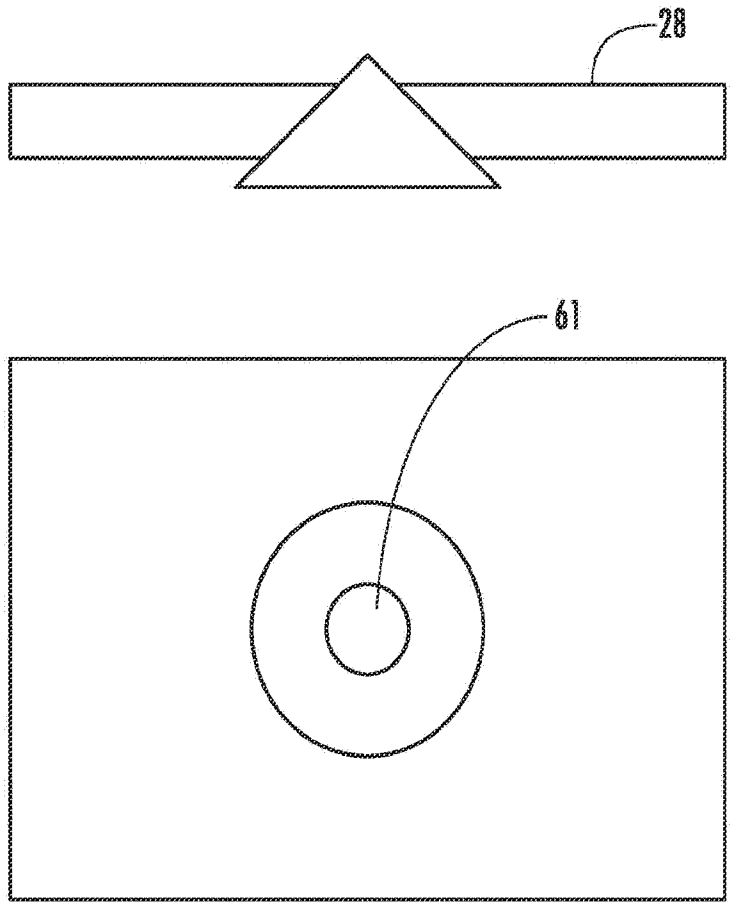

If, however, the symmetry of the system is broken one of the two synthetic jets will be stronger than the other and the device 10 will pump in one direction over the other. FIG. 52 illustrates that one way to break the symmetry and thus to pump fluid is to apply an asymmetric waveform to an otherwise symmetric device Additional ways to break the symmetry of the system is to have the orifice 61 in the moving diaphragm 28 shaped like one of either a conic depression or a raised funnel, each of which faces in one direction but not the other. These embodiments are illustrated in FIGS. 53A and 53B, respectively.

Figure 54:
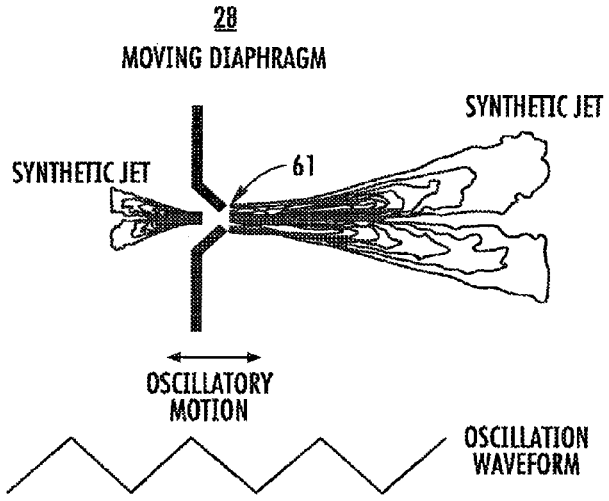
FIG. 54 is a side view of a schematic illustrating a conical moving diaphragm in accordance with an embodiment of the present invention.

In FIG. 54, the waveform driving the oscillations of the diaphragm 28 is symmetric but the orifice 61 is not. The cone, which narrows and concentrates the fluid flow from left to right, produces a larger synthetic jet to the right than to the left. One can also produce an embodiment combining the methods of FIGS. 52 and 53, i.e. an asymmetric oscillating waveform and a conical orifice shape, in order to improve pumping efficiency.

The examples described and shown here have each had one ingress port 52, one pressure equalization port 56 and one port 61 in the diaphragm 28. However, other embodiments in accordance with the invention can include multiple ingress ports, multiple pressure equalization ports and multiple ports in the diaphragm. Moreover, other embodiments in accordance with the invention can combine pressure equalization port(s) with port(s) in the diaphragm. The location of the orifice 61 in the diaphragm 28 may be varied in different embodiments to produce different pumping effects. For example, a location of the port 61 near the center of the diaphragm 28, where excursions are greater, produces a larger pumping effect than locations of the port near the edge of the diaphragm 28.

Orifice in Transducer Diaphragm

Figure 55:
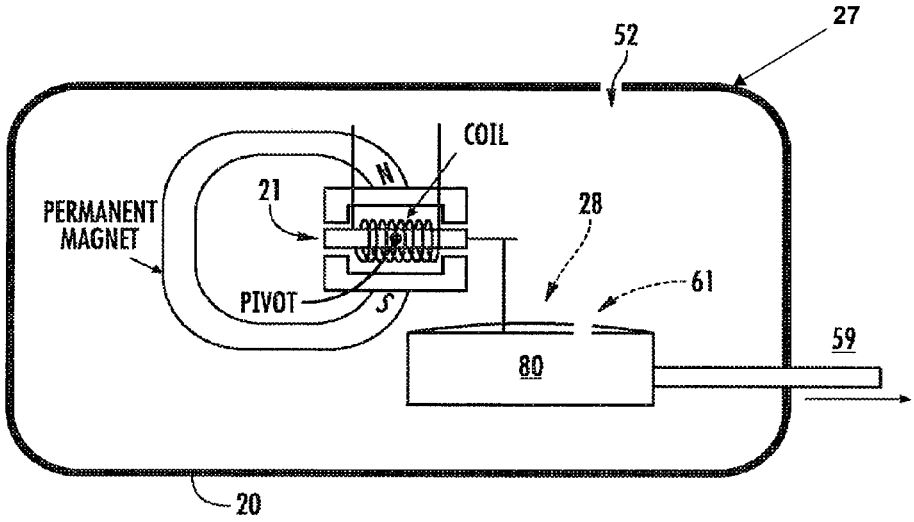
FIG. 55 is a schematic of an embodiment of the present invention.

FIG. 55 shows an example in which the moving orifice 61 described in the previous section is utilized to transform a balanced armature sound transducer 20 into a sound actuated pump 27. The balanced armature 21 is coupled to a diaphragm 28 covering a chamber 80, and connected to an egress port 59. In the conventional working mode of the balanced armature transducer 20, electrical signals corresponding to sound actuate the balanced armature 21, which oscillates the diaphragm 28, thus producing sound from the egress port 59.

In the pumping embodiment shown in FIG. 55, the diaphragm 28 has a small hole or orifice 61. When the diaphragm 28 is actuated by the balanced armature 21, the orifice 61 functions as a moving orifice and produces synthetic jets. If one of the two asymmetric conditions shown in FIG. 53 (asymmetric wave form supplied to the transducer) or 64 (conical orifice) or both are present the oscillation of the diaphragm 28 will produce asymmetric synthetic jets. If the symmetry is pointed in the correct direction then a net flow of fluid will exit the egress port 59. An ingress port 52 in the wall of the device is desired to allow a conservation of mass as fluid flows into the device and then is pumped out the egress port 59.

By reversing the asymmetry conditions of the moving orifice 61 in the system (making the conical pore entrance face the other way or changing the phase of the asymmetric wave form by 180 degrees) the device 10 can be made to pump in reverse. In this case the ingress will become the egress and vice versa. A device of the type in FIG. 55 that uses waveform to create the symmetry of the moving orifice 61 is therefore a sound actuated pump 27 which can work in either direction depending upon the waveform of the signal sent to the transducer 20. This produces efficient reversal of pumping direction for inflation and deflation of an inflatable bubble 31.

Figure 56:
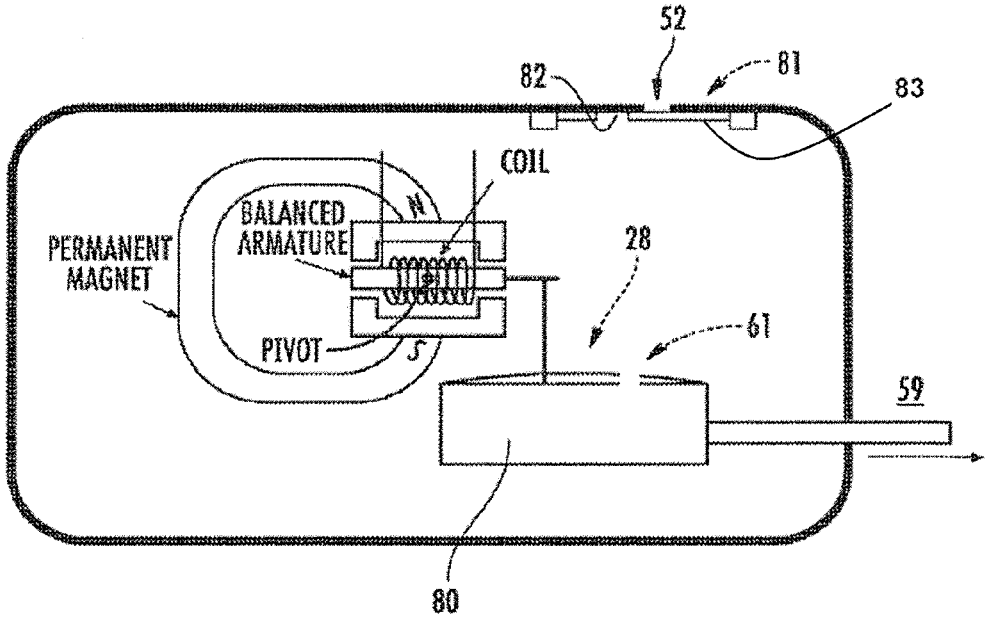
FIG. 56 is a schematic of an embodiment similar to that of FIG. 55 including a check valve.

The pumping efficiency of the device 10 in FIG. 55 can be increased by adding a membrane check valve 81 having an orifice 82 to either the ingress port 52 or the egress port 59 or both. This arrangement with the valve 81 on the ingress port 52 is shown in FIG. 56. The valve 81 is similar in design to those used in some embodiments of the diaphonic valve previously described which utilizes a flexible membrane covering an orifice 63 (see the check valve 62 in FIG. 17).

In FIG. 56, the membrane 83 has a pore or orifice 82 which is off-center and does not line up with the ingress port 52. Flow in through the ingress port 52 flexes the membrane 83 and allows fluid to flow through both orifices 82, 52. Back pressure seals the membrane 83 against the ingress port 52 shutting off back flow.

The embodiment shown in FIG. 56 increases pumping efficiency by preventing back flow, but also prevents the switching of the pumping direction by changing the wave form supplied to the transducer 20.

Dual Transducer

Figure 57:
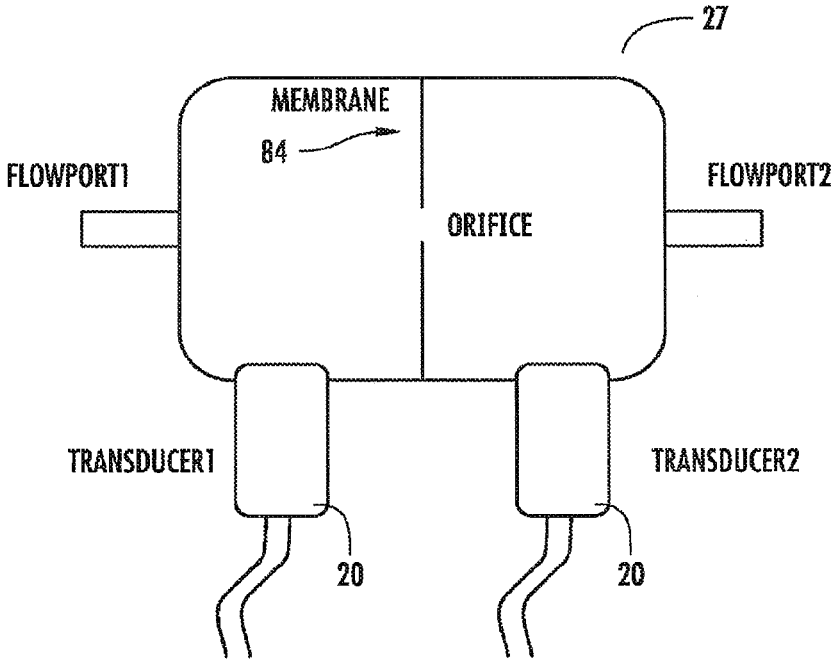
FIG. 57 is a schematic of a dual transducer device in accordance with an embodiment of the present invention.

FIG. 57 shows another embodiment of a sound actuated pressure pump 27, which uses two transducers 20. The sound waves produced by the two transducers interfere with one another across a membrane 84 (which may be either rigid or flexible) and through an orifice 85 in the membrane 84. By manipulation of the separate waveforms of the sound produced by the two transducers 20 and by manipulation of the relative phases of these waves the device can be made to produce a pressure differential driving fluid flow from Port 1 to Port 2 or from Port 2 to Port 1. Thus, the device 10 of FIG. 57 represents yet another means to reverse the flow direction of a sound actuated pump 27. In this case the reversal is achieved by electronically altering (switching) the wave forms supplied to the two transducers 20.

Figure 58:
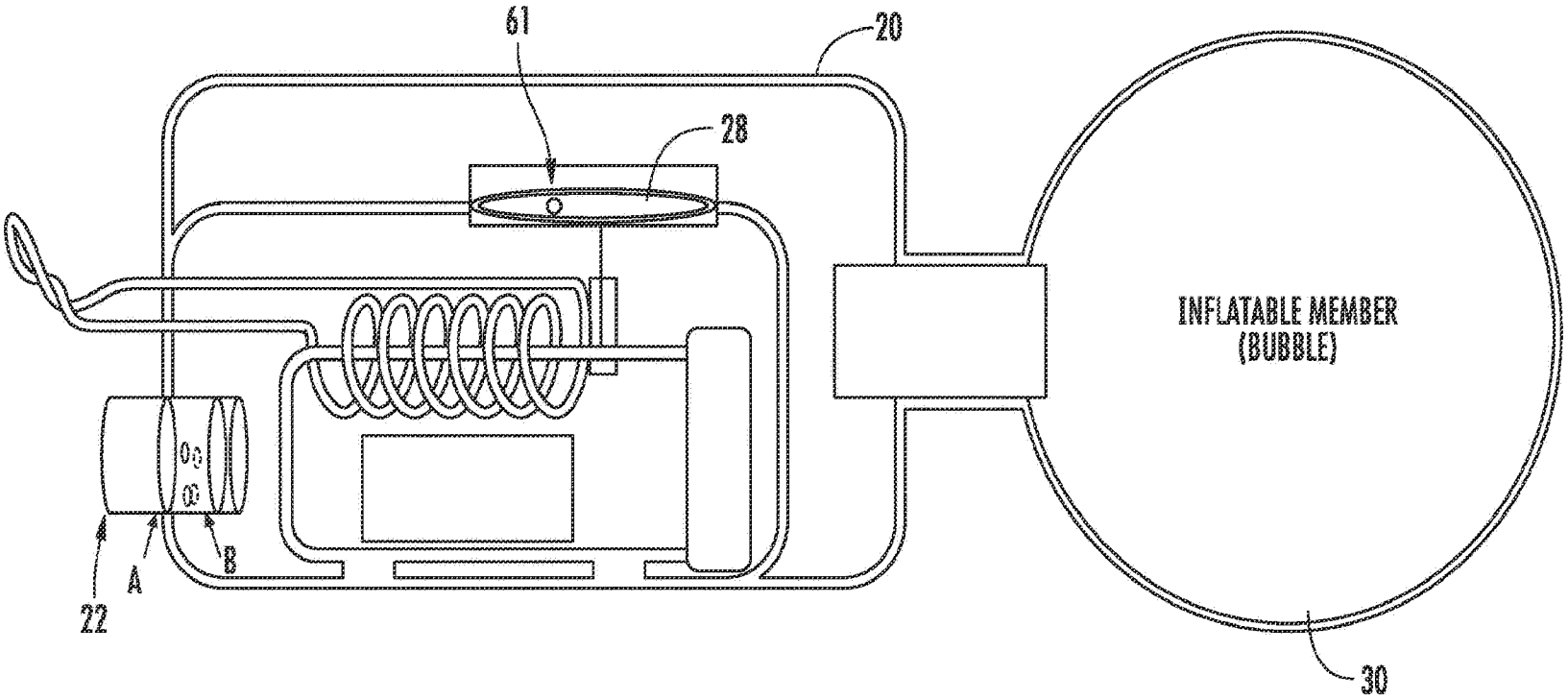
FIG. 58 is a schematic of a device having a co-axial diaphonic valve in accordance with an embodiment of the present invention.
Figure 59:
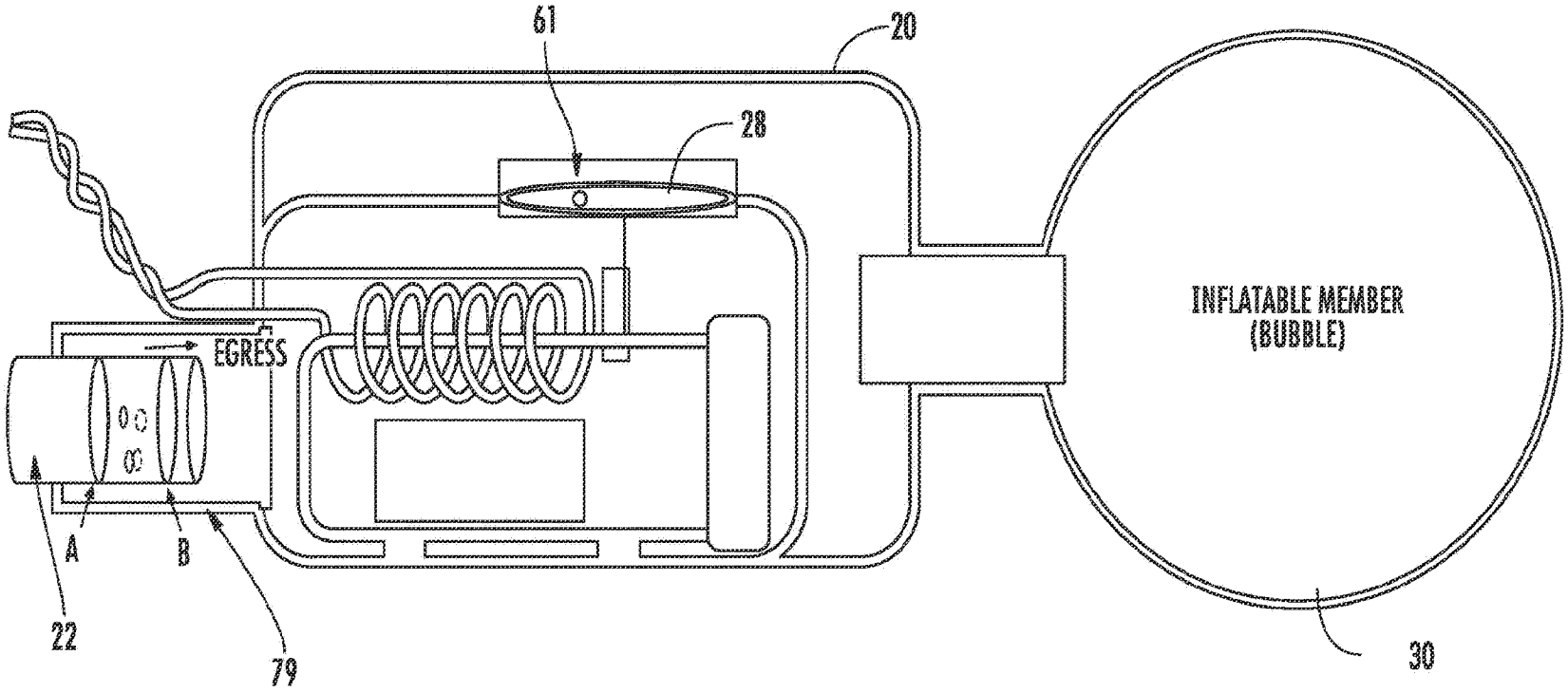
FIG. 59 is another schematic of a device having a co-axial diaphonic valve in accordance with an embodiment of the present invention.

The effect can also be achieved through the use of a single transducer which employs the use of sound delivery tubes constructed so as to optimize the phase and attack differential at the membrane orifices between two sound waves emanating from the same transducer diaphragm, either from one side of the transducer diaphragm or from both Combination Co-Axial Diaphonic Valve Pump and Moving Orifice Pump Greater forward direction (inflation of the bubble) pumping efficiency can be generated by combining the co-axial diaphonic valve 22 in the transducer back volume with a port 61 in the diaphragm 28, as shown in FIG. 58. FIG. 59 shows the same general embodiment, but with the addition of a tubular extension 79 of the transducer back volume to accommodate the diaphonic valve 22.

The embodiments of FIGS. 58 and 59, which combine the co-axial diaphonic valve 22 with the moving orifice 61 in the diaphragm 28, provide a double acoustically generated pumping action. The co-axial diaphonic valve 22 always pumps in the forward direction (inflation of the bubble 31). The orifice 61 in the diaphragm 28 requires an asymmetric wave form to pump in the forward direction and, thus, augments the pumping action of the co-axial diaphonic valve 22. The orifice 61 in the diaphragm 28 may also have a conical shape (discussed herein in further detail) to further augment pumping in the forward direction. A combination of all these effects (co-axial diaphonic valve, port in diaphragm, asymmetric wave form, conical shape of port in diaphragm) can be combined to produce the highest pumping efficiency.

Figure 60:
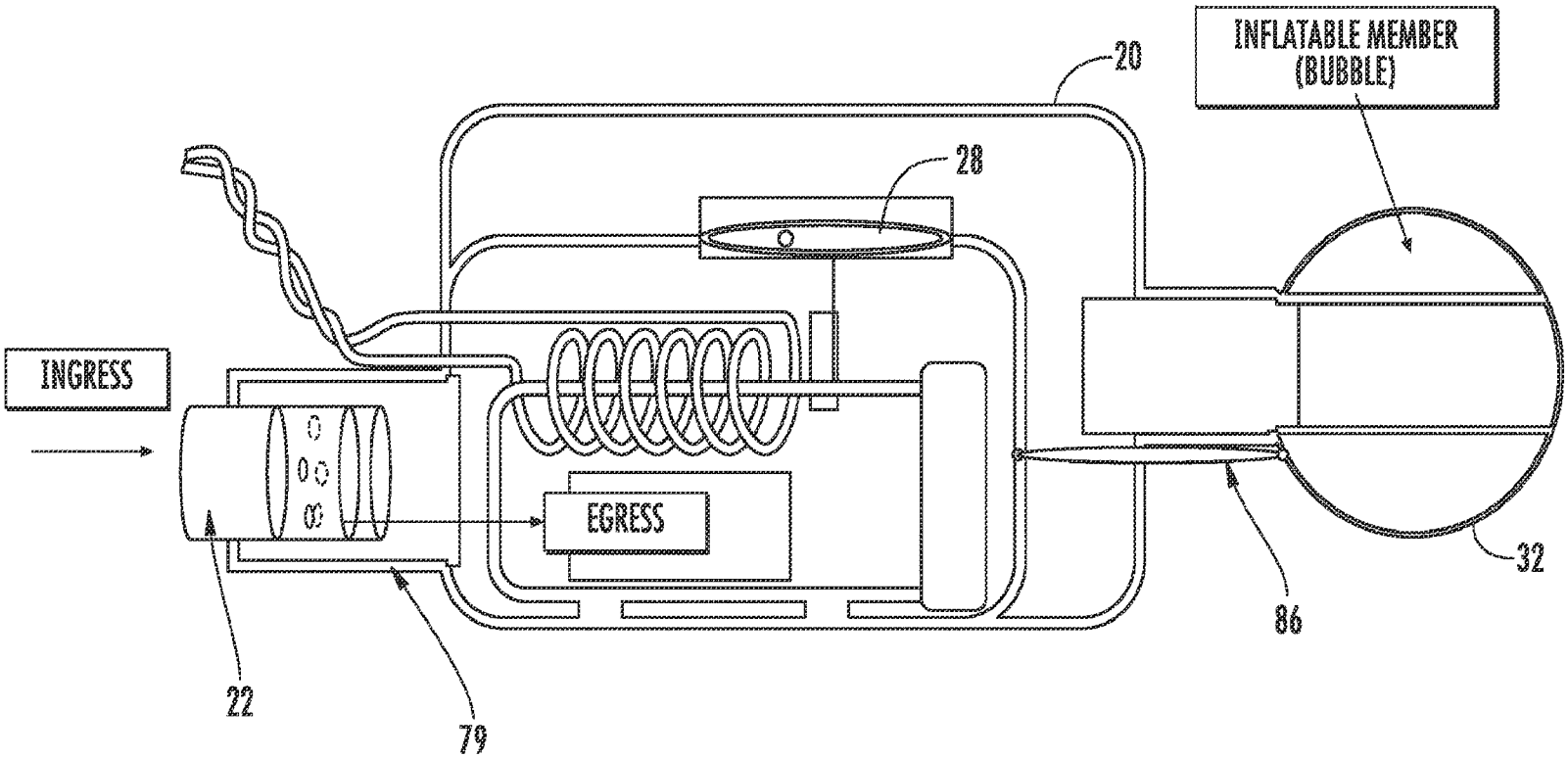
FIG. 60 illustrates a device similar to that shown in FIG. 15, including an inflation filling tube.

FIG. 60 shows an embodiment which employs a diaphonic valve 22 in the transducer back volume and an output tube 86 inflates a donut-shaped bubble 32. The embodiment in FIG. 60 may or may not also include either a pressure equalization port 56, a port 61 in the diaphragm 28, or both.

In the various embodiments disclosed here, the transducer back volume acts like a pressure ballast tank. It must be pressurized before pressure can be transferred to the inflatable member 30. Thus, approaches to reduce the back volume of the transducer 20 result in a more responsive and efficient pumping device. This applies to all the embodiments disclosed herein.

Figure 61:
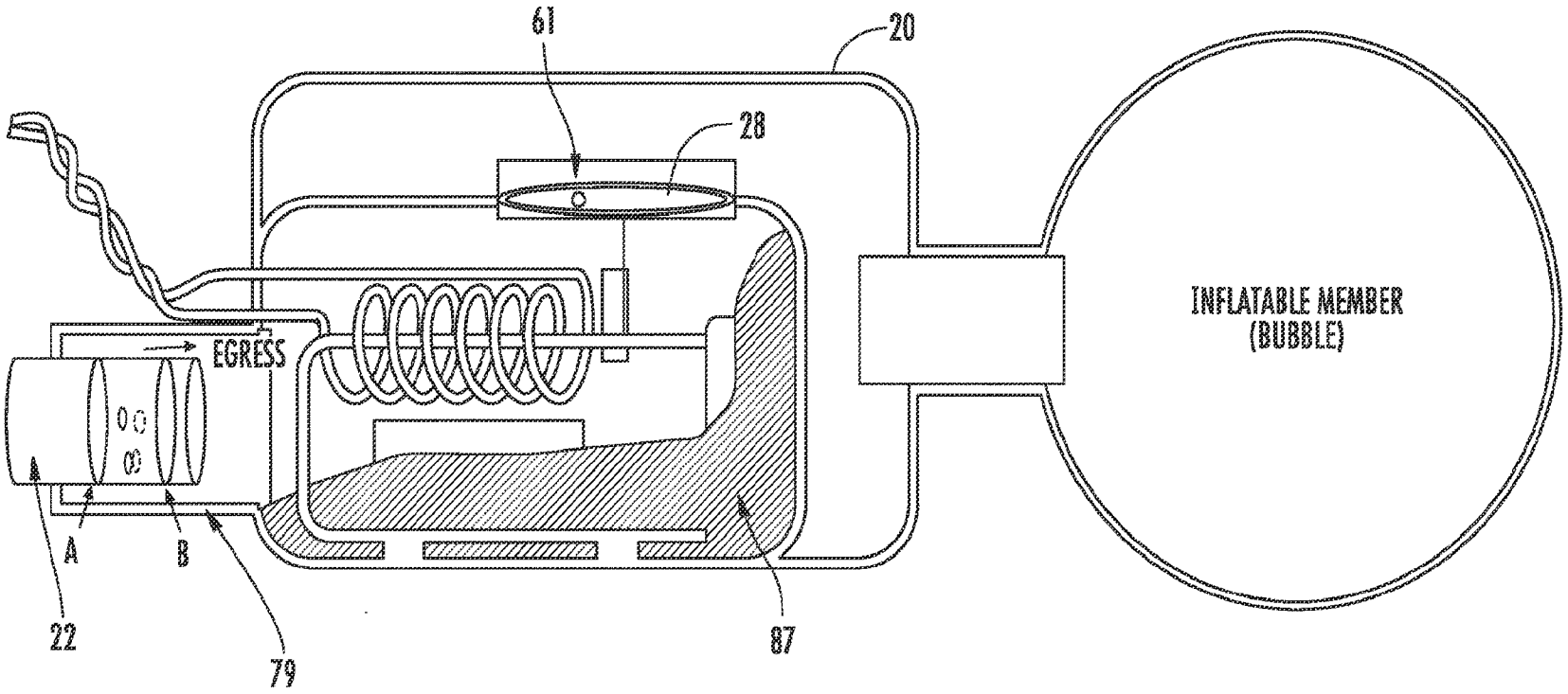
FIG. 61 is a cross-sectional schematic of a device including space-filling material in the transducer back volume, in accordance with an embodiment of the present invention.

FIG. 61 shows an example where space in the back volume of the transducer is reduced by filling empty space with a space filling material 87. Of course, this must be done so as to not interfere with the working (moving parts, electric or magnetic fields) of the transducer 20.

Figure 62:
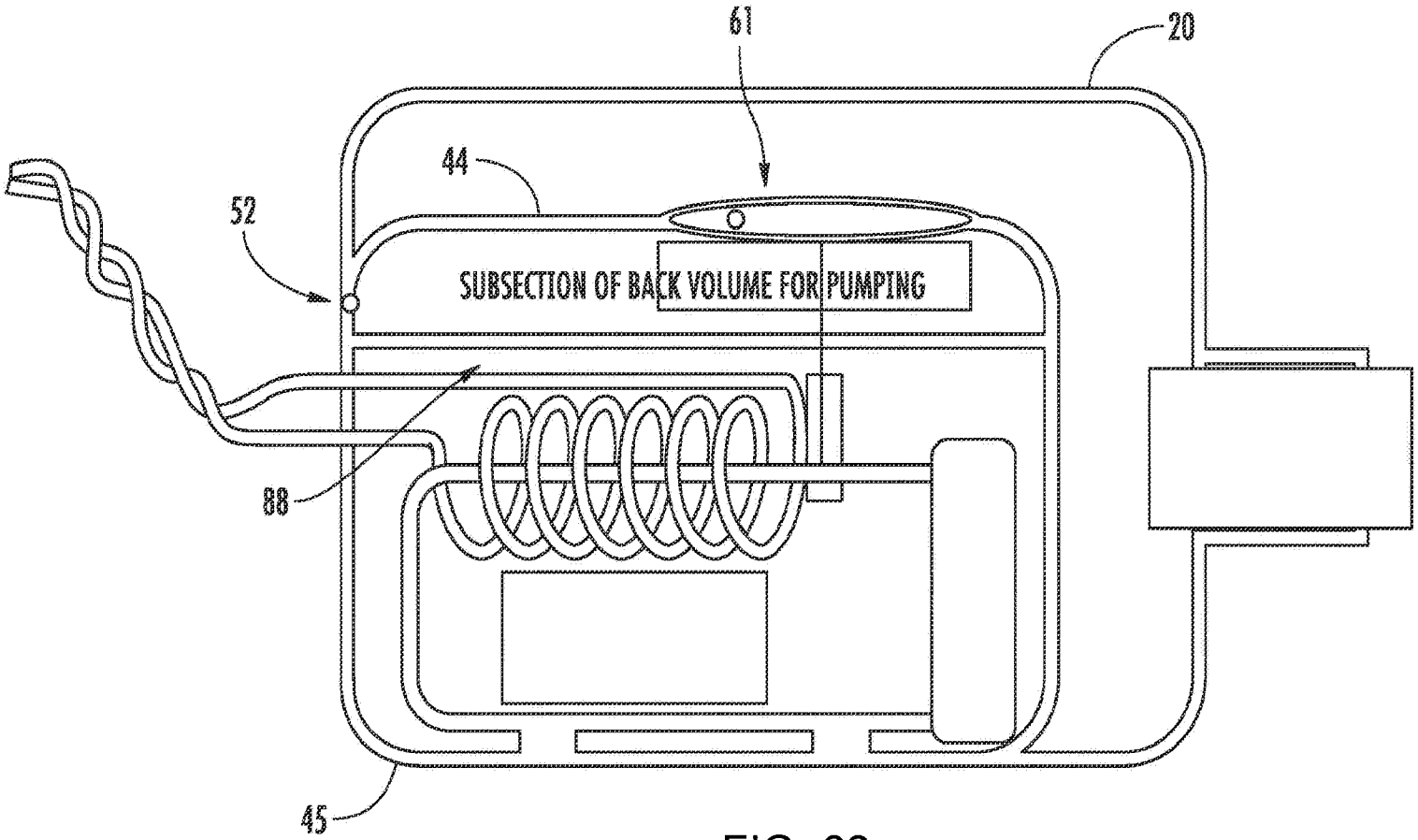
FIG. 62 is a cross-sectional schematic illustrating the use of a back volume partition, in accordance with an embodiment of the present invention.

FIG. 62 shows another approach to reducing the back volume of the transducer, namely adding a partition 88 to the back volume. This is illustrated with the relatively simple case of a pump based on a port in the diaphragm 28. The partition 88 creates a smaller subsection of the back volume, which is used in the pressure/pumping function of the transducer 20. The remainder of the back volume is not involved in pumping. If the balanced armature 21 is outside of the partitioned off subsection of the back volume used for pressure generation, then the drive pin must feed through the back volume partition with a gasket or seal that allows freedom of motion, but resists the leakage of pressure.

The approach of adding a partition to the back volume can be applied to any of the embodiments presented in this disclosure. When this is done, it is necessary that these valves connect to or reside in the smaller partitioned off part of the back volume used for pressure generation.

Automatic Insertion/Retraction Mechanism

The use of pressurizing mechanisms, such as an acoustically driven diaphonic valve, provides pneumatic operation of devices at or near the same location of the inflatable bubble 31. In an embodiment depicted in FIG. 63, the pressure is employed to pressurize a linear actuator 89 which moves the inflatable bubble 31 from within a protective cowl 90 or covering and gently inserts it into the ear canal, whereupon it is variably inflated. When the flow of pressure from the pressurizing means is reversed, the inflatable bubble 31 is automatically deflated and then withdrawn back into its protective housing 91. Additionally, electromechanical or manually operated means may be used to achieve this utility.

Figure 64:
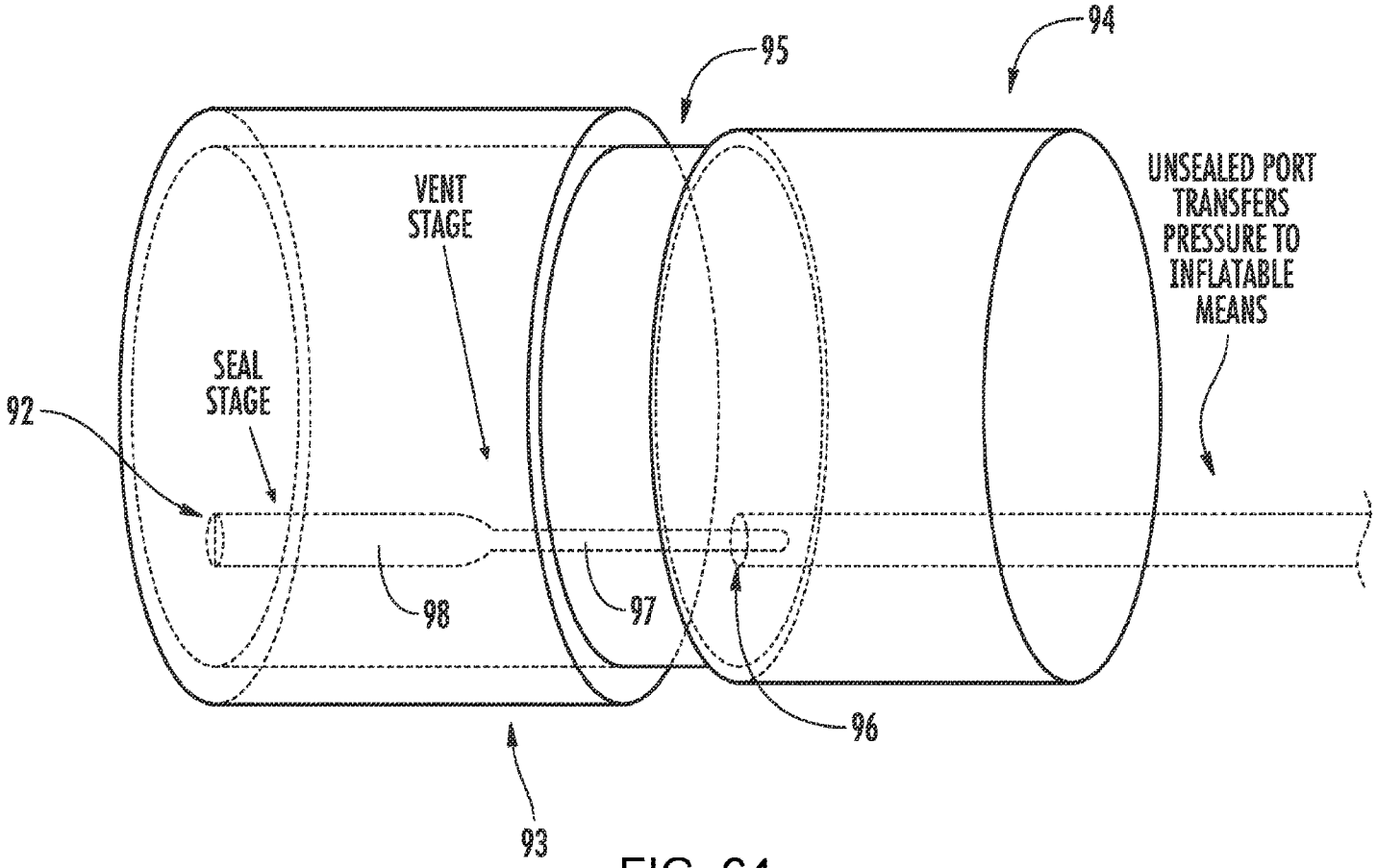
FIG. 64 is a schematic of a portion of the auto insertion mechanism shown in FIG. 63.

As depicted in FIG. 64, the actuator 89 can include a staged inflation and deflation needle valve 92. In an embodiment, the actuator 89 has a cylinder 93 with a piston 94 that reciprocates therein. Furthermore, a collapsible and inflatable cylindrical skirt 95 can be made from a nonporous ePTFE fabric or another polymer film material that is attached to the bottom of the cylinder 93 and the bottom of the piston 94 for sealing the space there between during actuation. Moreover, a graduated diameter needle 92 provides for controlling the passage of fluid (e.g., air) through the cylinder 93 and into a passage extending through the piston 94. The passage through the piston 94 includes a port 96 for receiving the needle 92, wherein the needle 92 has a distal portion 97 and a proximal portion 98, the distal portion 97 being smaller in diameter than the proximal portion 98.

In operation, as pressurized fluid enters the cylinder 93 from the pressure delivery tube (FIG. 63), the piston 94 moves to cause the inflatable bubble 31 to be inserted within a user's ear. Once the port 96 of the piston 94 is about the distal end 97 of the needle 92, pressure is allowed to escape the cylinder 93 via the passage in the piston 94. The escaping pressure is used to inflate the inflatable bubble 31 previously inserted within the user's ear.

Figure 63:
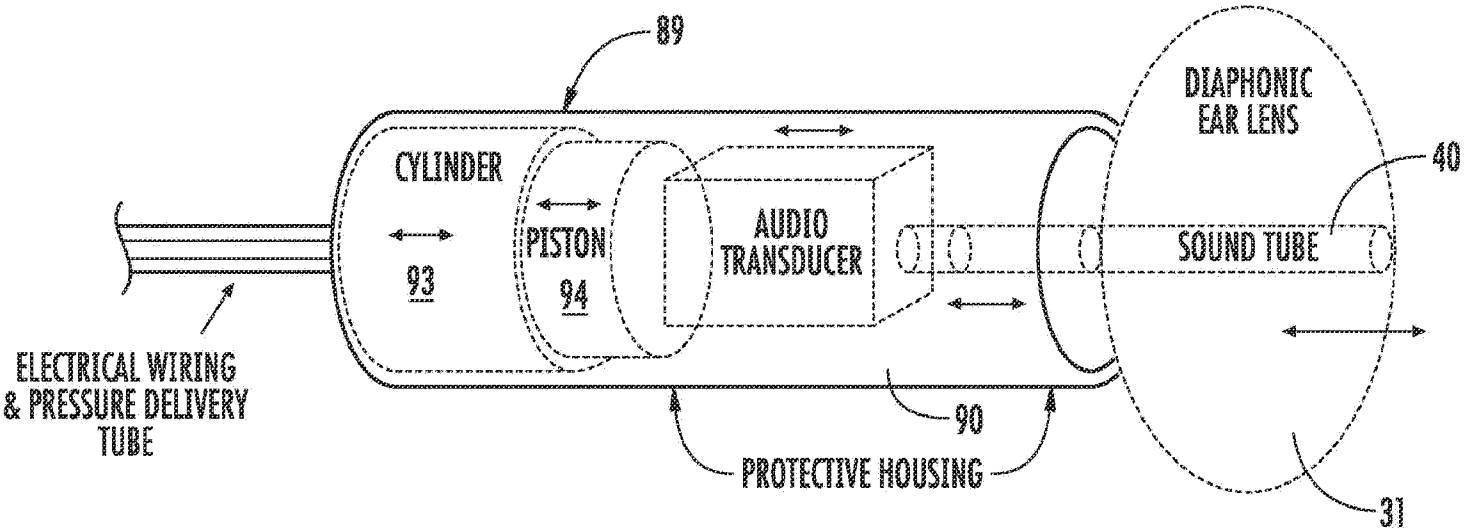
FIG. 63 is a schematic of an auto insertion mechanism for an embodiment of the present invention.

Once the inflatable bubble 31 is to be deflated and removed from the user's ear, pressure is relieved from the cylinder 93 via the pressure delivery tube (FIG. 63). This results in allowing the inflatable bubble 31 to deflate via the passage provided by the piston 94 and the space between the piston port 96 and the distal portion 97 of the needle 92. Once the inflatable bubble 31 is deflated, the piston 94 then moves towards the proximal portion 98 of the needle 92 whereby the inflatable bubble 31 is withdrawn from the user's ear.

Use of Active Noise Cancellation to Quiet the Inflation of a Bubble

Previously, it was shown that a particular embodiment of device 10 built with a Sonion 44A030 dual transducer has its best energy efficiency for pumping air to inflate a bubble in the ear at a frequency of about 3 kHz. At this operation frequency, the device 10 can inflate and maintain inflation of a bubble 31 in the ear over a 12 hour period, using less than five percent of the available battery power in a typical hearing aid. However, doing this requires initial and perhaps intermittent use of an inflation tone of about 3 kHz at a considerable amplitude (loudness). This tone may be unpleasant to the user.

Other embodiments, based on other transducers and other diaphonic valve configurations, may have their most energy efficient pumping at somewhat different frequencies. However, all such devices will have a frequency or range of frequencies in which pumping is most efficient, and this tone will often have the potential to be unpleasant to the user when played with sufficient amplitude (loudness) to effect bubble inflation.

To mitigate this potential problem of an unpleasant inflation tone, the present invention preferably uses two transducers in a device 10. The acoustical output of the two transducers, during the inflation of the bubble, is partially or completely out of phase so as to produce a noise cancellation (reduction in amplitude) and/or a shift in the audible frequency, so as to make the inflation process less objectionable to the user.

An embodiment of this invention includes a balanced armature transducer, as previously described, paired with a second transducer. The device generates pressure from sound pressure oscillations in the back volume of one of the transducers, and this pressure is used to inflate the bubble 31 (closed or donut-shaped) in the user's ear. The other transducer is used to produce a sound output which is matched (to the degree possible) in frequency and amplitude and is 180 degrees out of phase with the output of the first transducer. This arrangement quiets the device during bubble inflation.

For this device 10, during normal hearing aid (or other audio) operation, one of the two transducers can be turned off and the other transducer can provide the audio material to the user. This requires a switching scheme, which may be mechanical or electronic, in which one transducer is turned on and off. It is also possible to run both transducers in phase, and thus reinforcing each other's signal, during normal hearing aid operation. This requires a switching scheme, which may be mechanical or electronic, in which one transducer has its electrical input reversed (180 degrees out of phase for bubble inflation) and then switched back (in phase for normal listening).

Another example is a two transducer device, in which the audio output of the two transducers may be run out of phase during bubble inflation to quiet the device, but in which both transducers are incorporated into pumps working from their back volumes. With two pumps working to inflate the bubble 31, device 10 will inflate the bubble 31 more quickly. It is desirable to the application for the bubble inflation process to be quick (less than 20 seconds and preferably less than 10 seconds), as well as quiet.

A device providing active sound cancellation using two transducers can inflate a bubble 31 in the user's ear and can pump air to maintain inflation while continuing to play audio program material (hearing aid function, communications, MP3 audio, etc.). This can be achieved by superimposing the audio material signal on the inflation tone in one of the two transducers. The other transducer plays only the inflation tone, but 180 degrees out of phase. The net effect is that the inflation tone is fully or partially cancelled and the audio signal remains intact.

Alternatively, in a two transducer device (previously described herein), both transducers can play audio material, which may be the same or different, but which is not out of phase and which does not cancel itself out. At the same time, superimposed on this audio material, in each transducer, is the inflation tone. However, the two transducers play the same inflation tone 180 degrees out of phase with one another, producing a cancellation or partial cancellation of the inflation tone, while the audio material from both transducers is heard by the user.

Figure 65:
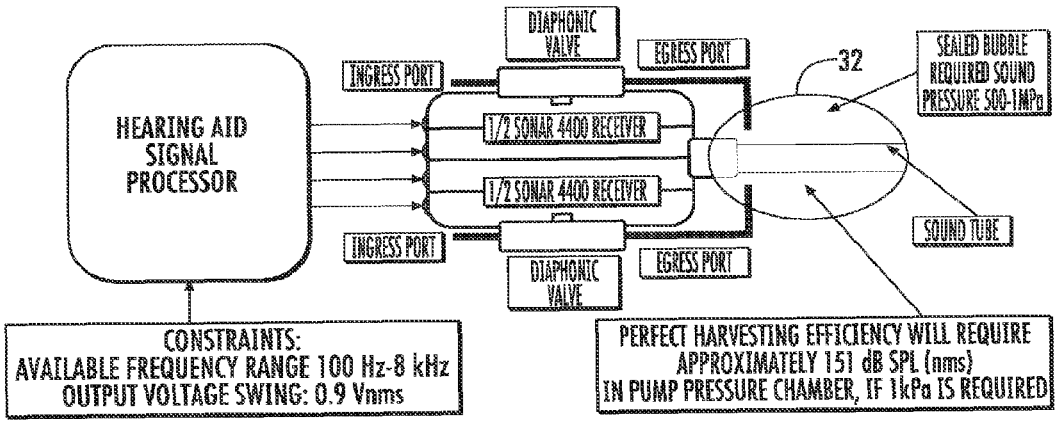
FIG. 65 is a schematic of an embodiment of a two transducer device in accordance with the present invention.

FIG. 65 shows a schematic of a particular embodiment of the two transducer device 10. This example was constructed using the Sonion 44A030 dual transducer, which provides the two transducers needed for the device in a single package. The particular example shown in FIG. 65 uses the device to inflate a donut-shaped bubble 32, but the application of the same dual transducer approach to a closed (driven) bubble is evident.

Figure 66:
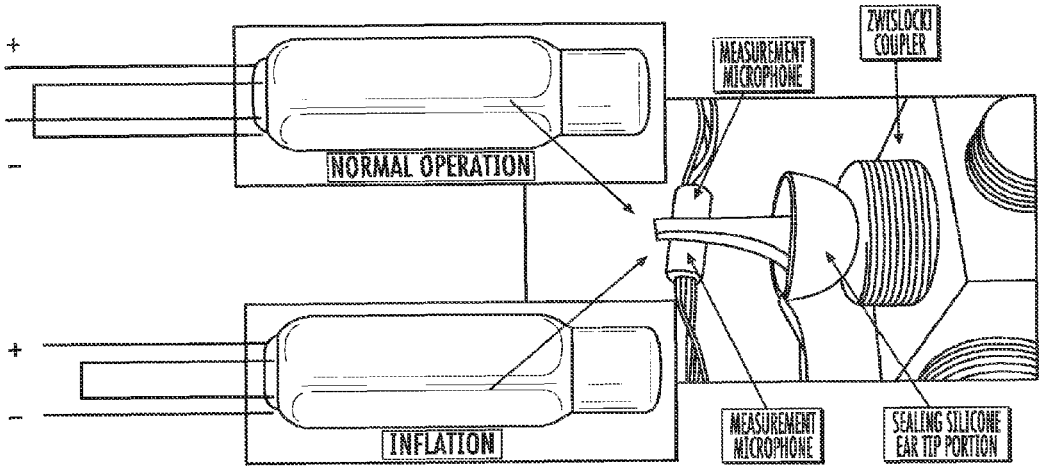
FIG. 66 is a photographic depiction of a Sonion 44A030 dual transducer wired so that the polarity of one of the transducers can be switched relative to the other.

As shown in FIG. 66, a Sonion 44A030 dual transducer, was wired so that the polarity of one of the transducers could be switched relative to the other. To inflate the sealed bubble 31, the two component receivers of the Sonion 44A030 are driven in series with opposite polarity. This action reduces the sound in the receiver tube as heard by the user. Once the desired inflation pressure is reached the inflation signal is switched off and the receiver sections are driven in series with additive polarities.

Figure 67:
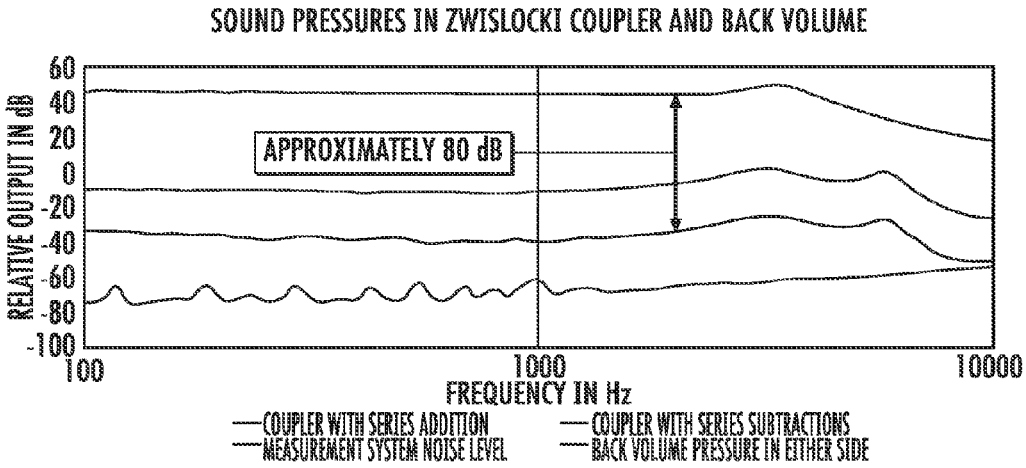
FIG. 67 is a graph showing the difference in sound pressure level (SPL) measured in a Zwislocki Coupler, which approximates the signal at the user's ear drum, corresponding to two transducers running 180 degrees out of phase in accordance with an embodiment of the present invention.

The prototype in FIG. 66 was constructed and measured so as to determine and confirm the sound pressures that would be available for pumping relative to the sound pressures presented to a hearing aid user. FIG. 67 shows that the difference in sound pressure level (SPL) measured in a Zwislocki Coupler (approximates the signal at the user's ear drum) is 30 dB lower for the Series Subtraction arrangement, corresponding to the transducers running 180 degrees out of phase, as opposed to Series Addition, where the transducers run in phase. Additionally, the back volume SPL, in either of the two transducers, which is available to create pumping pressure, is 80 dB higher than the SPL experienced by the user with the active cancellation of the inflation tone.

Replaceable Bubble and Sound Tube Assembly

Figure 68:
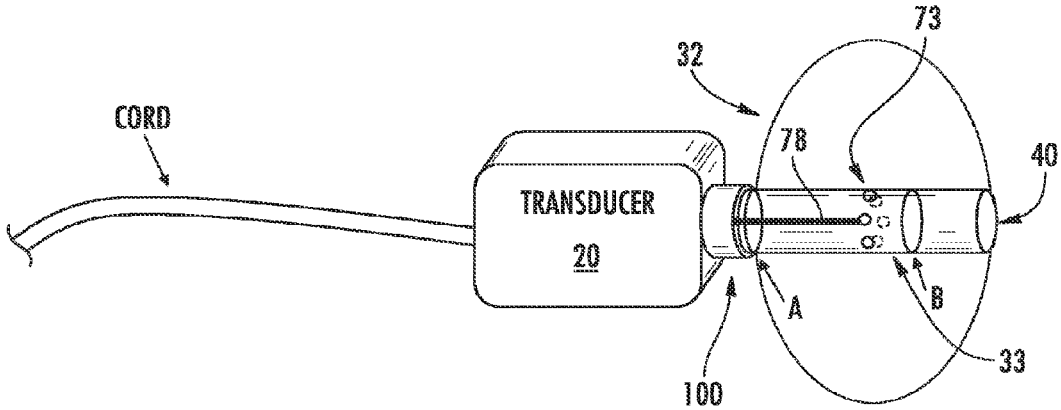
FIG. 68 is a schematic illustration of a device having a separable coupling for the sound tube in accordance with an embodiment of the present invention.
Figure 69:
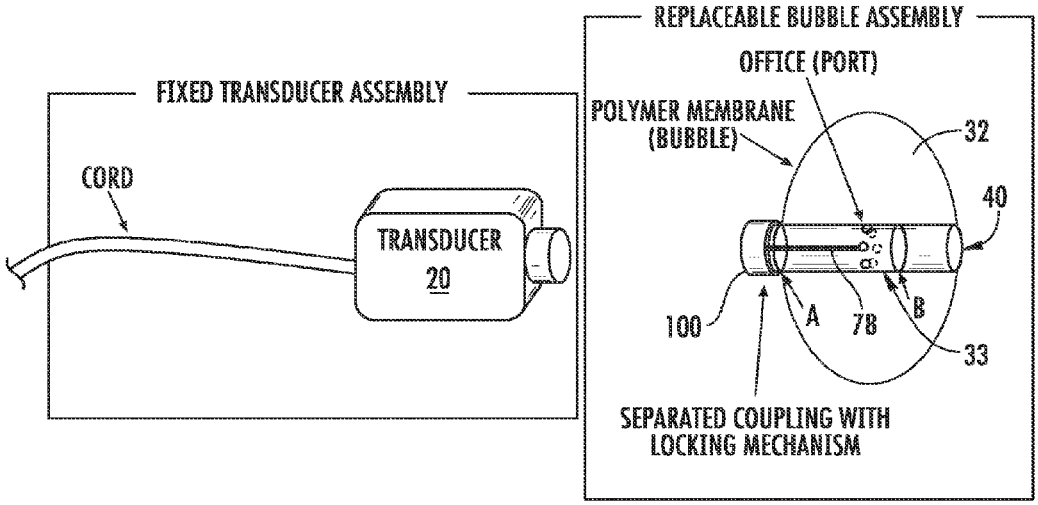
FIG. 69 is a schematic illustration similar to that of FIG. 68.

FIG. 68 shows a coaxial embodiment of device 10 in which the bubble 32 and sound tube 40 are connected to the transducer 20 via a coupling 100. As shown in FIG. 69, this coupling 100 allows the separation of the bubble 31 and sound tube 40 from the rest of the device 10, which includes the transducer 20.

In normal use, the bubble 32 and the sound tube 40 may become soiled and may need to be cleaned. The separable coupling 100 allows the bubble 31 and sound tube 40 to be removed from the rest of the device 10 for easier cleaning.

Additionally, the bubble 31 and sound tube 40 may become worn out due to usage or may be damaged in handling by the user. The separable coupling 100 allows a damaged, worn or soiled bubble and sound tube assembly to removed and replaced by a clean and/or new one. Due to the relatively delicate nature of the bubble 31 and the polymer sleeve 33 covering the sound tube 40, the bubble 31 and sound tube assembly is by design a disposable part of the device 10. It is designed to be periodically removed and replaced with a new bubble and sound tube assembly.

The use of a separable bubble 31 and sound tube assembly 40 can also be coupled with other pumping mechanisms besides the coaxial device 10. For instance, it can be coupled with a synthetic jet acoustical pumping device based on orifices in plates or with other diaphonic valve embodiments, each as described herein.

The separable coupling 100 between the replaceable bubble 31 and sound tube assembly 40 and the transducer 20 will necessarily include connections for the air ingress routes, in embodiments that employ such air ingress routes. The embodiment shown in FIG. 68 uses a groove 78 in the outer surface of the sound tube 40 for air ingress. This groove 78 has access to outside air in the gap between the separable coupling 100 and position A, where the polymer sleeve 33 begins. In this embodiment, therefore, air ingress is achieved without the need for an air ingress connection through the separable coupling 100.

Figure 70:
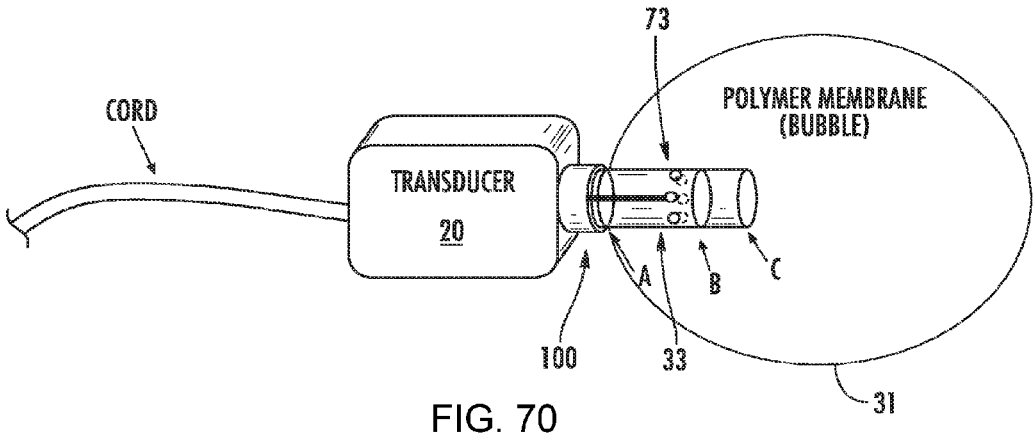
FIG. 70 is a schematic illustration similar to that of FIG. 68 with a short sound tube.

FIG. 70 shows and embodiment in which the removable/replaceable bubble 32 and sound tube assembly 40 includes a sound tube which terminates in an open end, within the bubble 32.

Separable Coupling with Lock and Key Mechanism

The bubble 31 (or 32) and sound tube assembly 40 can be made in different sizes to accommodate the natural variation in ear canal dimensions among users. Additionally, by tailoring the properties of the bubble material (strength, stiffness, elasticity, density, air permeability) different bubbles types can be produced, for example, to suit hearing aid patients with different hearing or ear related issues.

Thus, especially in the hearing aid application, the bubble 31 and sound tube assembly 40 can be considered a prescription analogous to prescription contact lenses for the eyes.

The simplest embodiment of the separable coupling, shown in FIGS. 68 and 69, is a friction fitting, smooth pair of concentric rings or short cylinders. A first, outer cylinder 101 fits into a second, inner cylinder 102 creating the coupling. As somewhat illustrated in FIGS. 71-76, the outer cylinder 101 may be connected to the removable bubble 31 and sound tube assembly 40, while the inner cylinder 102 may be connected to the transducer 20 and the body of the device 10. Alternatively, the outer cylinder 101 may be attached to the transducer 20 and the body of the device 10 and the inner cylinder 102 attached to the removable bubble 31 and sound tube assembly 40. The type of coupling 100 illustrated in the figures may be achieved by constructing the inner cylinder 102 of a rigid material (such as a rigid plastic) and the outer cylinder 101 of a flexible or rubbery material (such as a rubbery plastic). Alternatively, the coupling illustrated may also be achieved in which the outer cylinder 101 is constructed of a rigid material and the inner cylinder 102 is of a flexible or rubbery material. Also, both the inner and outer cylinders 101, 102 can be a rigid material or both can be a flexible or rubbery material.

The coupling 100 connecting the removable bubble 31 and sound tube assembly 40 to the transducer 20 and the body of the device 10, may be color coded to help the user choose the correct prescription bubble. In this case, the audiologist, when prescribing the device will fit the body of the device 10 with a coupling of a specific color, which matches the color of the coupling on the prescription bubble appropriate for the particular patient.

Figure 71A:
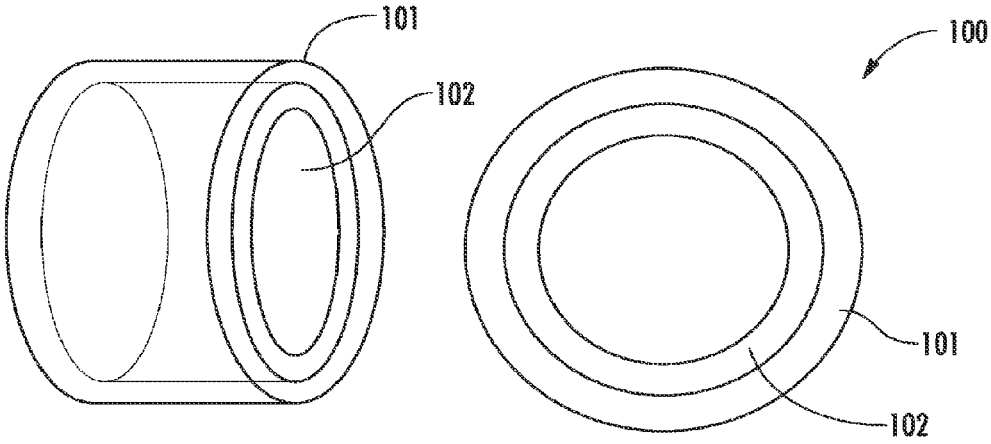
FIGS. 71A and 71B are illustrations of possible embodiments of the coupling shown in FIGS. 68-70.
Figure 71B:
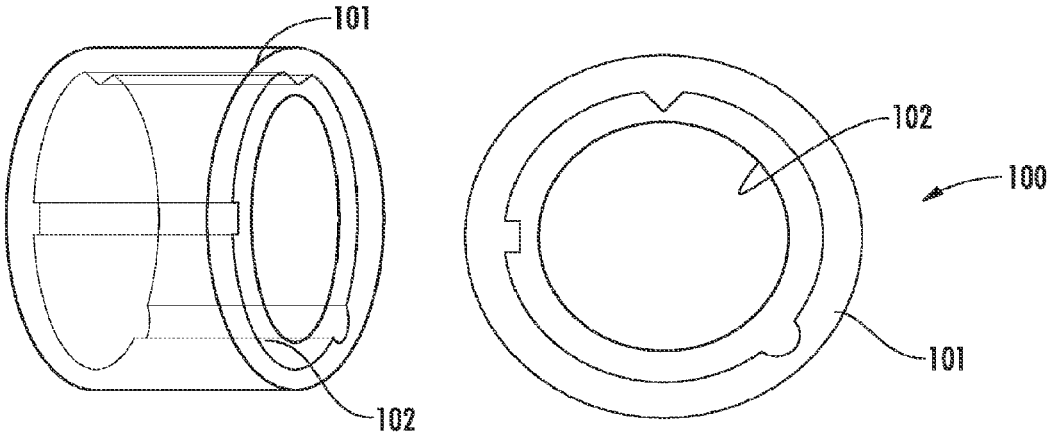

FIG. 71B shows an example of a "lock and key" recognition system for the separable coupling by which the bubble 31 and sound tube assembly 40 are connected to the transducer 20. A pattern of markings on the mating surfaces of the separable coupling must match for the coupling to be made. Different prescription bubble and sound tube assemblies will have different patterns in their half of the separable coupling. These will need to match the markings in the other half of the coupling on the fixed body of the device, by the transducer. The half of the coupling fixed onto the device will be determined by the prescribing doctor and will make sure the patient is only using the appropriate bubble and sound tube assemblies. Lock and key matching of the appropriate prescription bubble and sound tube assembly with the body of a user's device can also be combined with color coding of the coupling previously described. This provides a convenient method for the user to select the correct bubbles based on color of the coupling combined with a failsafe mechanism, based on lock and key matching to prevent the attachment of the wrong bubble.

The lock and key aspect of the separable coupling can be achieved with the shape, spacing and depth of grooves in concentric cylindrical surfaces, as shown in FIG. 71B. Other ways to achieve this lock and key mechanism include variations in the size and shape of the concentric fitting parts. For example, the coupling 100 can consist of concentric tubes of rectangular, square, triangular, rhombohedra, oval or star shaped cross section. These different cross sectional shapes can be combined with patterns of grooves or other markings of the type shown in FIG. 71B.

The lock and key coupling 100 may be held together by friction as shown in FIG. 71B or it may include an additional locking mechanism. For example, once the concentric tubes have passes through one another, the outer tube may be twisted around its circumference relative to the inner tube to lock the coupling. Alternatively, the coupling may be screwed together with threads on the mating surfaces of the concentric tubes, in which the arrangement of the threads (size, spacing, depth, etc.) provides the recognition (i.e. lock and key mechanism).

Different combinations of two or more of the locking and recognition mechanisms described are possible.

When embodiments incorporating air ingress tubes that feed air from around the back of the transducer are combined with a removable sound tube and bubble assembly, then the separable coupling must including a feed-through for the air ingress route.

Figure 72:
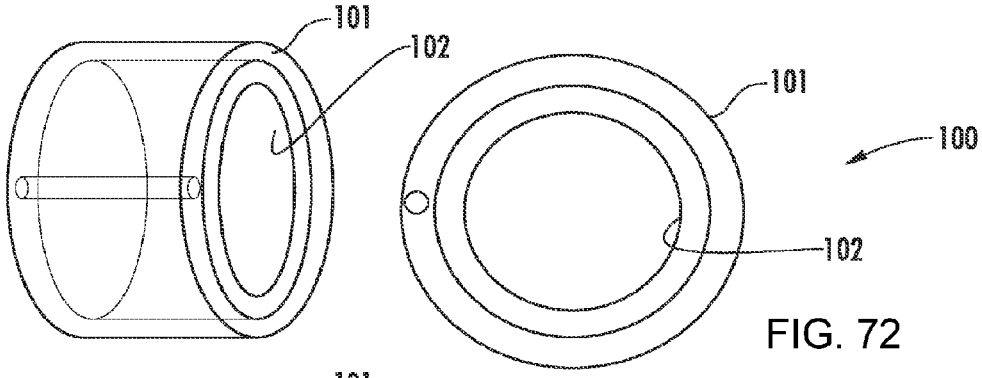
FIGS. 72 through 76 are illustrations of additional possible embodiments of the coupling shown in FIGS. 68-70.
Figure 73:
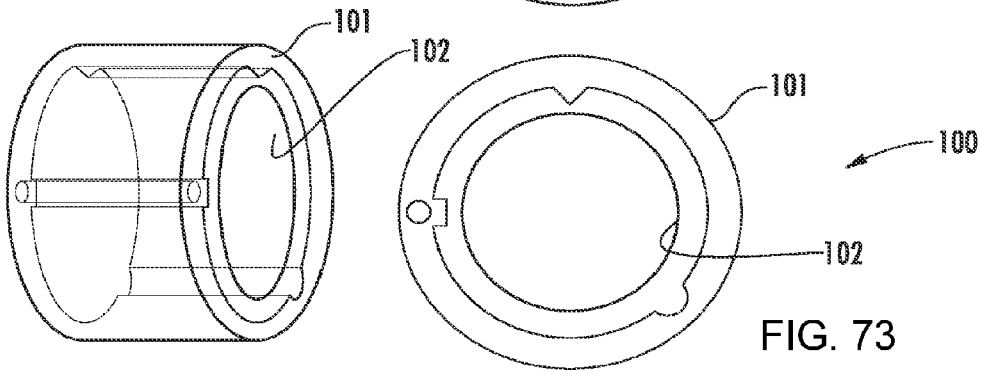

FIG. 72 shows such an air ingress tube 37 built into the wall of the outer concentric cylinder 101 of the separable coupling 100. In this example, the air ingress tube 37 runs in the wall of cylindrical coupling 100 parallel to the cylindrical axis of the coupling 100. The air ingress tube 37 can also be placed in the wall of the inner cylinder 102 of the separable coupling (not shown) and also transporting air parallel to the cylindrical axis of the coupling 100. FIG. 73 shows that the air ingress tube 37 passing through the outer cylinder 101 of the separable coupling 100 can be combined with the lock and key matching built into the concentric parts of the separable coupling 100. Placement of the air ingress tube feed-through in the inner cylinder of the separable coupling 100 is likewise possible to combine with a lock and key matching code on the coupling.

Figure 74:
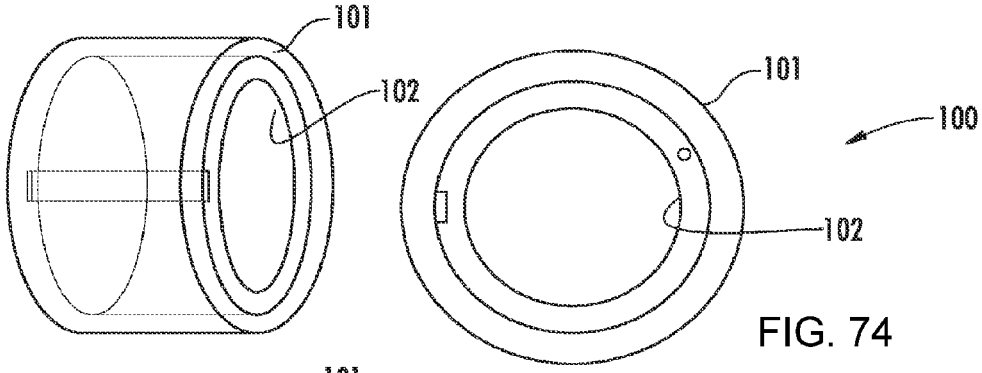

FIG. 74 shows an air ingress feed-through in the separable coupling 100 which is achieved by a slot or groove in the outer surface of the inner member of the coupling being covered by the inner surface of the outer member of the coupling. Likewise an air ingress feed-through may be achieved by a slot or groove in the inner surface of the outer member of the coupling covered by the outer surface of the inner member of the coupling.

Figure 75:
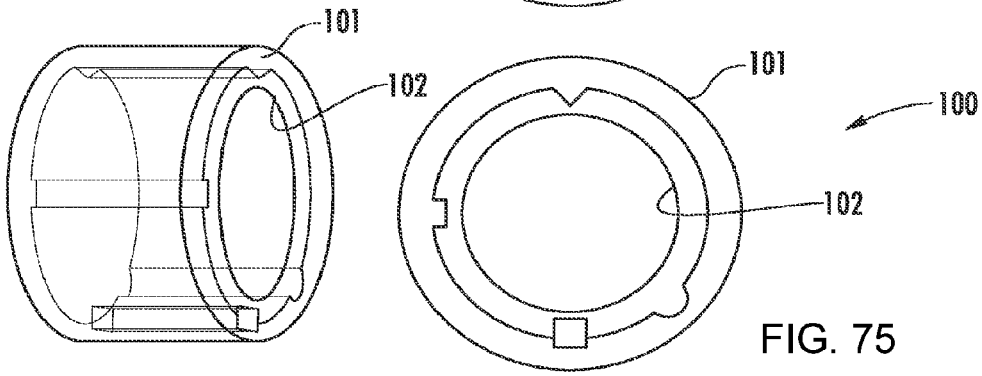

FIG. 75 shows an air ingress feed-through in the separable coupling 100 which is achieved by matching grooves in the outer surface of the inner part of the separable coupling and in the inner surface of the outer part of the coupling. This type of air ingress feed-through needs to be combined with the lock and key matching of the coupling surfaces so as to ensure that the grooves on the two members of the coupling match one another.

Figure 76:
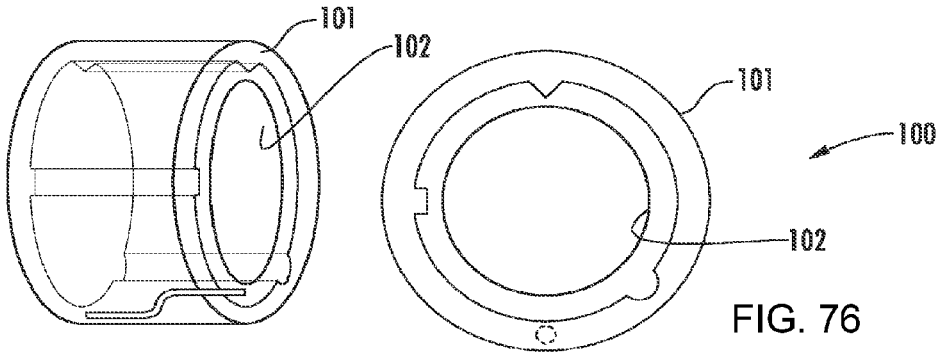

FIG. 76 shows an air ingress feed-through in the separable coupling 100 which is achieved with a tube in the wall of the outer member 101 of the coupling crossing over to a tube in the inner member of the coupling. This requires matching holes in the inner surface of the outer member 101 and in the outer surface of the inner member 102. Achieving the matching of the holes in the coupling surfaces requires that this type of coupling needs to be combined with the lock and key matching which ensures that the members of the coupling always meet in the same orientation. Another embodiment is an air ingress feed through, analogous to that of FIG. 76, but which crosses over from the inner member to the outer member 101 of the coupling 100.

The air ingress tube 37 through embodiments shown in FIGS. 70-76 are all illustrated with separable couplings 100 of cylindrical cross section. Concentric couplings of other cross sectional shape (rectangular, square, triangular, rhombohedra, oval or star shaped) are possible. The air ingress tube 37 through embodiments shown in FIGS. 70-76 can, by analogy be extended to these other cross sectional shapes for the separable coupling 100.

The air ingress tube 37 through embodiments in FIGS. 70-76 show a single feed-through route (tube or channel). Multiple, parallel feed-through of this type are also possible and these embodiments are particularly useful with air ingress systems of the type shown other figures.

Supplemental Pumping

The inflation of the polymer bubble 31 may be supplemented mechanically by external devices located outside the ear canal, either directly outside the ear or on a cord connecting the device 10 to an external electronic device, such as a digital music player. These external pumping devices may be electronically or manually powered. Air is injected into the polymer bubble 31 through the air ingress tube 37 as illustrated in, for example, FIG. 37, or through a separate tube connecting the manual pump to the inside of the polymer bubble 31.

An example of supplemental pumping methods for the device 10 include a syringe pump (not shown) or variations of the syringe pump concept. A plunger, which may be a rod or sphere, is moved through a tube to compress the air in front of it. The tube containing the compressed air of the syringe pump is connected to the inside of the bubble, and thus the syringe pump may be used to inflate or deflate the bubble by pushing or pulling the plunger in the tube.

Other examples of supplemental pumping methods for the device 10 include diaphragm pumps (not shown) in which a flexible diaphragm is mechanically depressed to squeeze air out of a chamber enclosed by the diaphragm. The chamber has two check valves, where one valve opens when the chamber is pressurized to allow air to flow from the chamber toward the polymer bubble and the other check valve closes under pressure, but opens under partial vacuum and thus allows the chamber to refill when the diaphragm is released.

Another example of a supplemental pumping method for the device 10 includes squeezing the tube itself that connects the bubble to the outside air. The tube containing appropriate check valves then functions in similar manner to the diaphragm pump described herein.

Still another example of a supplemental pumping method is to perform a peristaltic pumping motion on the tube connecting the bubble to the outside air. This peristaltic action may be performed manually or via a power driven peristaltic pump.

Inflation of the polymer bubble 31, deflation of the bubble 31, and maintenance of pressure during use of the device 10 can be achieved either by the external methods described herein, by the pumping action of the device pump 27, or by a combination of external methods and device pumping. For example, an external method may be used to supplement the pumping of the device 10 for quick inflation and deflation, while the pumping action of the device pump maintains bubble pressuring during use.

Feedback Control Through Pressure Regulation

Loss of the ear canal seal in a hearing aid can lead to unpleasant and potentially dangerous feedback because the hearing aid speaker and microphone are in close physical proximity and are no longer isolated from one another. Embodiments of the present device 10 preferably include a control mechanism (not shown), which may be either hardware (electronics) or software based. When the feedback control is activated the gain of the electronic device is temporarily reduced. In response to this action, the device 10 is directed to increase its pumping action, thereby increasing the inflation in the polymer bubble 31 and improving the ear canal seal. This pressure increase, triggered by the onset of feedback, then reduces the feedback coupling path between the device receiver and microphone.

Dual Wall Ribbed Bubble

Figure 77:
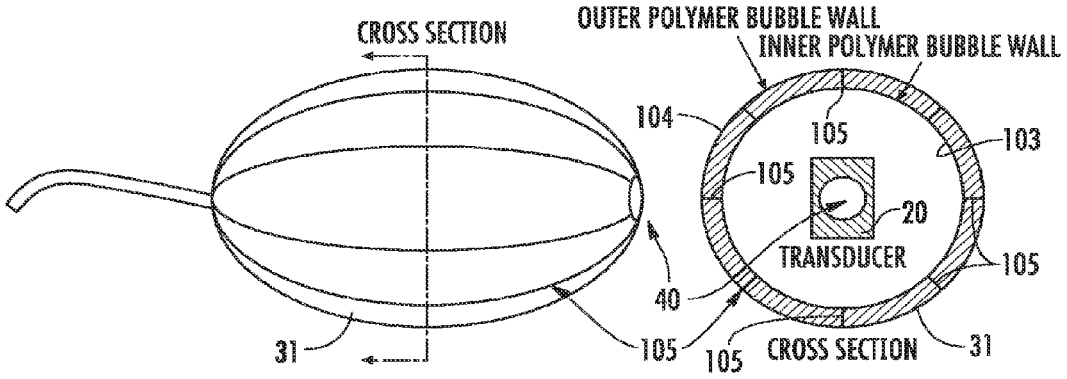
FIG. 77 is a side and cross-sectional schematic of a dual-walled inflatable member, in accordance with an embodiment of the present invention.

FIG. 77 shows an alternative design for the polymer bubble 31. In this embodiment, the bubble 31 is double-walled and only the space between the inner wall 103 and the outer wall 104 is pressurized by the pumping action of the sound actuated pump 27, an external pump or a combination of the two. Connecting ribs 105 between the inner wall 103 and outer wall 104 of the bubble 31 allow the double-walled bubble 31 to keep its shape. In FIG. 77, the ribs 105 are shown running longitudinally along the length of the bubble 31. However, other rib arrangements are possible including lateral ribs running around the circumference of the bubble, a spiraling pattern of ribs, or the like.

The ribs 105 may or may not be permeable to air. They function to set the distance between the inner wall 103 and outer wall 104 of the bubble 31 when inflated and they do not need to be impermeable to air to achieve this purpose. The ribs 105 may be made of an air permeable material or they may have holes in them. The ribs 105 may also be replaced by an arrangement of discrete posts that fix the distance between the inner and outer surfaces of the double-walled bubble 31.

This embodiment of the device 10 has less stringent pumping requirements to inflate the bubble than other embodiments, because of the greatly reduced inflated volume in the double-walled ribbed bubble 31. The interior space of the bubble 31 which contains the transducer 20 does not need to be pressurized.

Multi-Chambered Bubble from Joined, Inflatable Tubes

Figure 78:
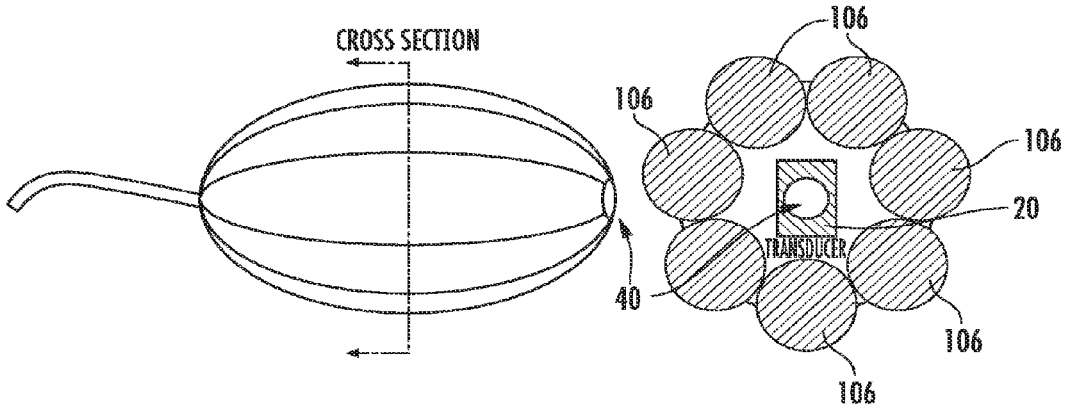
FIG. 78 is a side and cross-sectional schematic of a multi-tube inflatable member, in accordance with an embodiment of the present invention.

Similar to the double-walled bubble 31 embodiment of FIG. 77, in which the required inflation volume is minimized by having the interior of the bubble un-pressurized, FIG. 78 shows an example of a bubble design produced by bundling together inflatable polymer tubes 106. FIG. 78 shows that using fewer, larger diameter tubes gives a thicker bubble wall, while FIG. 79 shows that using a larger number of smaller diameter tubes produces a thinner bubble wall.

This design requires a circular pressure manifold, whereby pressure generated by the diaphonic valve is distributed to each of the tubular bubble wall sections. The example shown in FIGS. 78 and 79 is that of a bubble which encloses the transducer 20. The same bubble can also be incorporated into any of the previously described devices in which the transducer is outside the bubble or is partially enclosed by the bubble.

Figure 79:
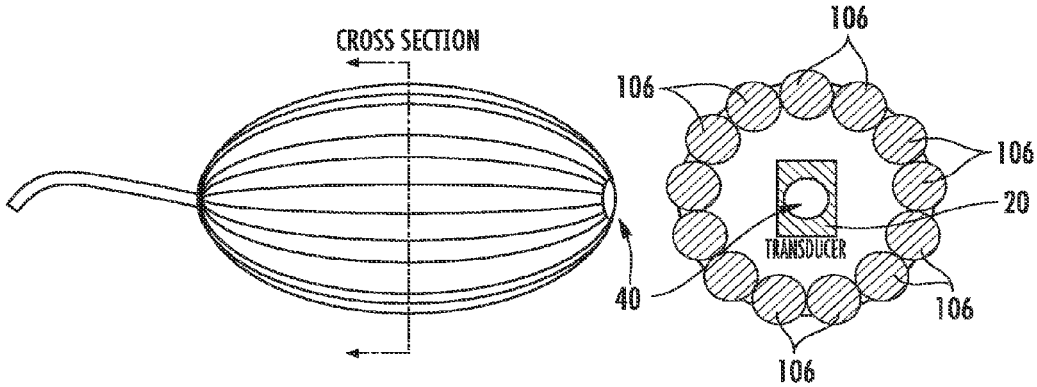
FIG. 79 is another side and cross-sectional schematic of a multi-tube inflatable member, in accordance with an embodiment of the present invention.
Figure 80:
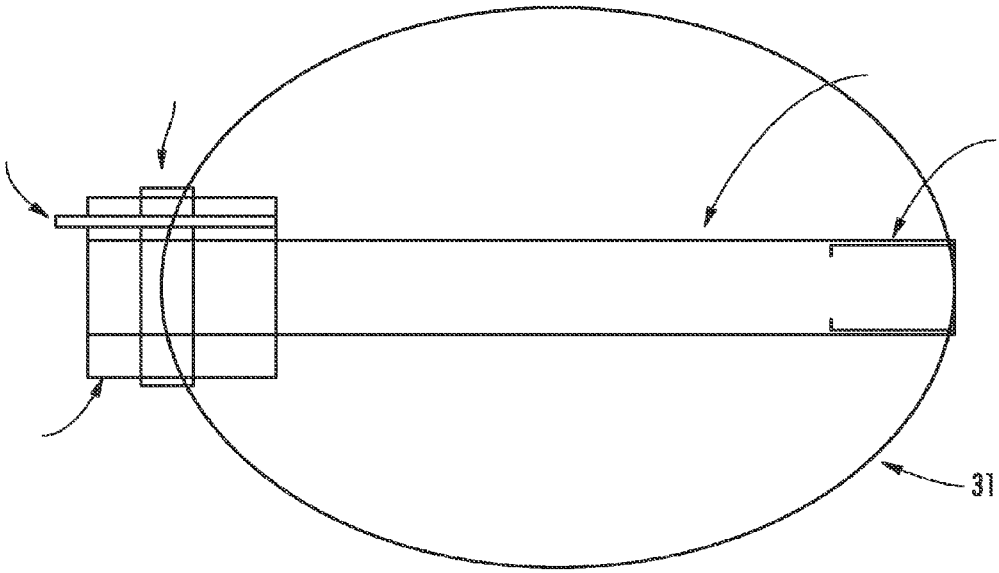
FIG. 80 is a schematic showing a bubble assembly for connection to a receiver-in-canal (RIC) assembly, in accordance with an embodiment of the present invention.
Figure 81:
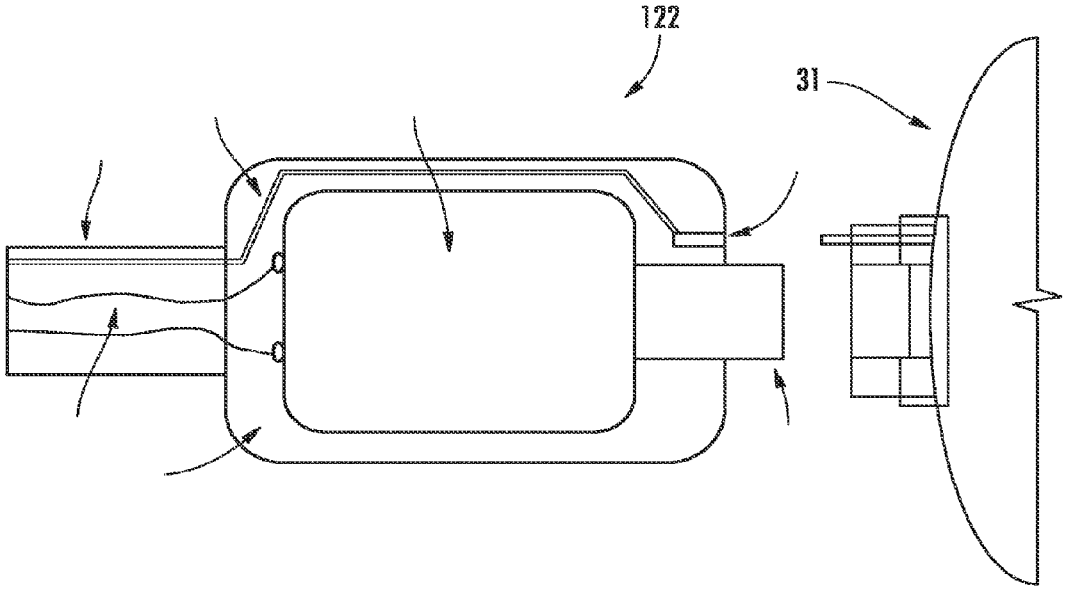
FIG. 81 is a schematic showing a bubble assembly for connector for coupling a bubble assembly to a receiver-in-canal (RIC) assembly, in accordance with an embodiment of the present invention.
Figure 82:
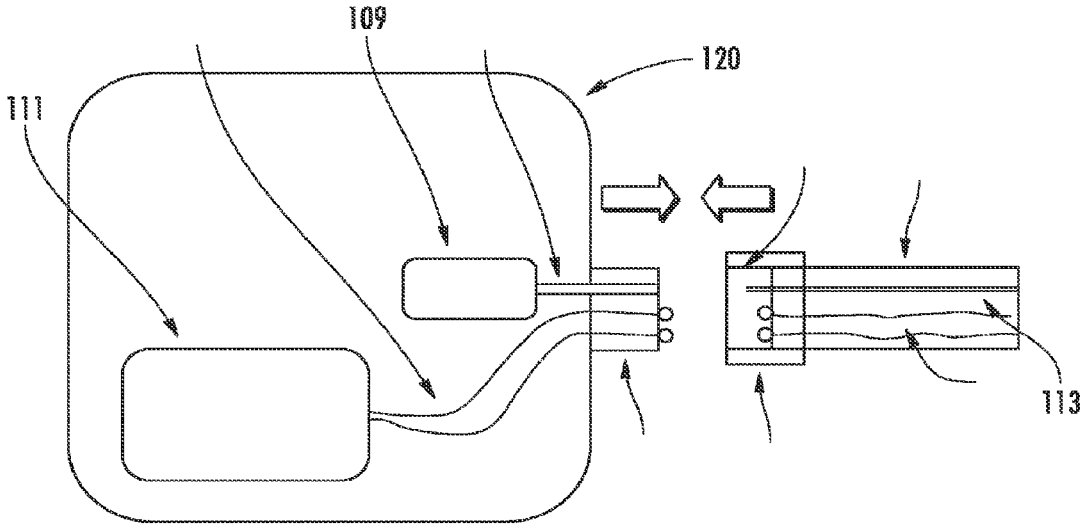
FIG. 82 is a schematic of a receiver-in-canal (RIC) device which couples to the assembly of FIGS. 80 and 81.
Figure 83:
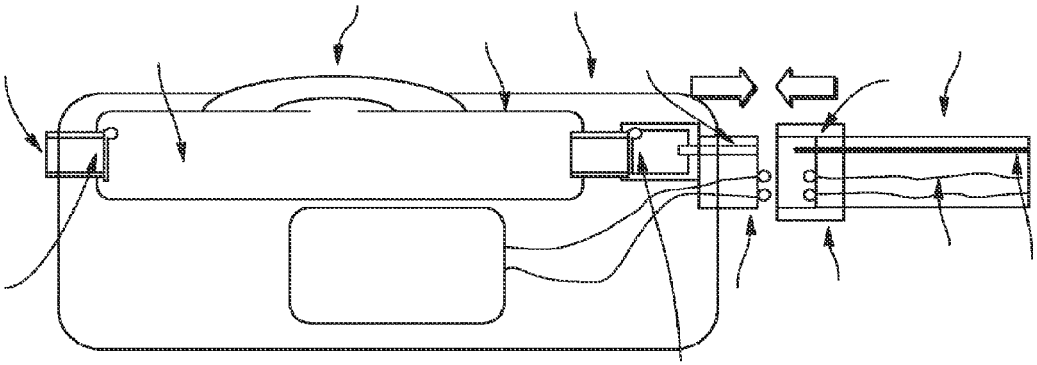
FIG. 83 is a schematic of a receiver-in-canal (RIC) device which couples to the assembly of FIGS. 80-82.

The inflatable, tubular sections 106 of the device in FIGS. 78 and 79 may be adhered together laterally by an adhesive or melt or solvent bonding process. Alternatively, the tubular sections 106 may be left un-bonded laterally along their lengths. In this case, the tubes 106 are only joined together at or near their two ends. The inflation of the un-joined tubes rigidifies the structure and gives the bubble 31 its shape.

The bubble 31 can be formed from as few as six tubes 106 and as many as twenty or more tubes 106. The number of tubes 106 is eventually limited by the need to distribute air flow and pressure to all of them via a pressure manifold.

Multi-Tone Ear-SEAL Test

A two tone ear seal test has been described for conventional ear tips including foam, silicone, or rubber inserts: http://www.sensaphonies.com/test/index.html. This approach can be applied to evaluate the ear seal obtained with the present device 10. In this approach the user inserts the device and then listens to a lower frequency tone (50 Hz as an example) and a higher frequency tone (500 Hz as an example) played in succession and then together at the same volume level. When the two tones are played together, if the user hears them both at about the same level, then the ear seal is good. If the two tones are not at or near the same level the device needs to be adjusted to obtain a better ear seal.

Pressure/Electrical Coupling for RIC-Type Hearing Aid

FIGS. 80-83 provide details for an embodiment of a bubble assembly used with a Receiver In the Canal or RIC type hearing aid, referenced previously herein. In this embodiment, the outputs of a signal processing circuit 111 and a pump 109 located in the hearing aid body 120 (FIG. 82), are coupled to a receiver 122 (FIG. 81) and the bubble 31 (FIG. 80) through a connection tube 113 carrying both electrical and pressure signals. The receiver 122 and bubble 31 are both inserted into the user's ear canal.

Alternative Design of Co-Axial Diaphonic Valve and Sound Tube Combination

Figure 84:
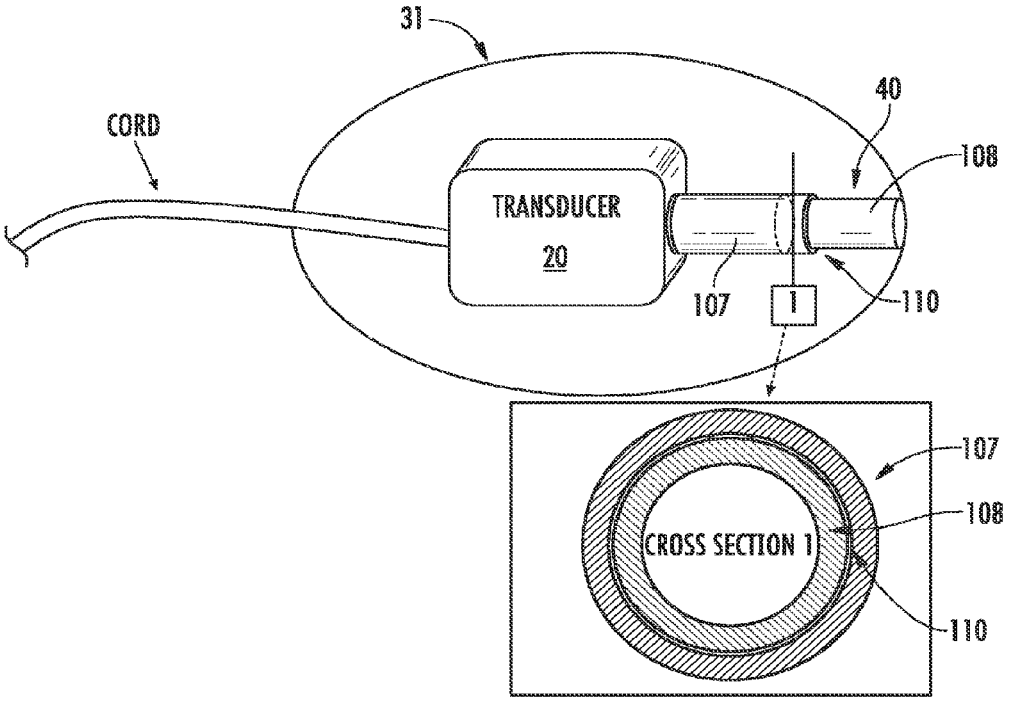
FIG. 84 is a side and cross-sectional schematic of a device having a two-piece sound tube, in accordance with an embodiment of the present invention.

FIG. 84 shows an alternative sound tube 40 to that shown in previous figures. In this embodiment, the sound tube 40 is divided into two sections, a larger diameter section 107 which is attached to the transducer 20 and the body of the device and a smaller diameter section 108 that extends out the end of the bubble 31 toward the tympanic membrane. The two tubes overlap one another at their junction. The smaller diameter tube 108 fits inside the larger diameter tube 107 leaving a gap 110 between the inner wall of the outer tube 107 and the outer wall of the inner tube 108. The gap 110 performs the same function in the embodiment of FIG. 84 as the circle of orifices or ports in the previous sound tube 40. In order to maintain the gap 110, it may be necessary to have spacers (not shown) which hold the two concentric tubes apart by the required small gap.

Figure 85:
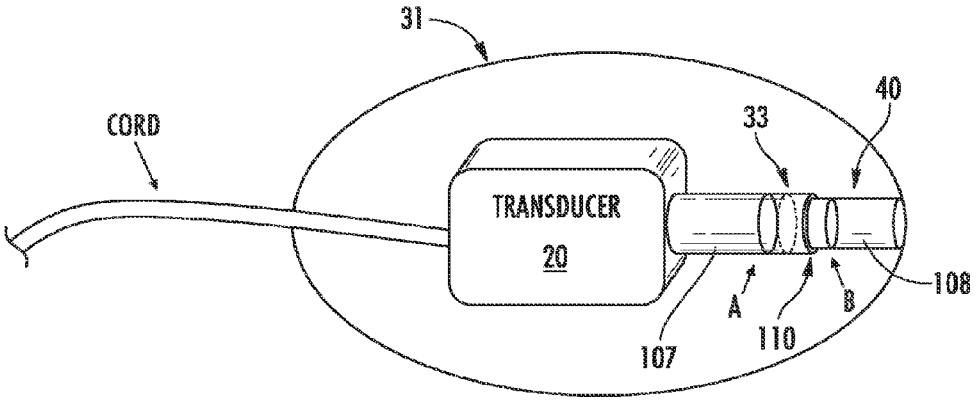
FIG. 85 illustrates a device similar to that shown in FIG. 84, including a polymer sleeve.

FIG. 85 shows the addition of a polymer sleeve 33, of the type first shown in FIG. 36, to the embodiment of FIG. 84. The polymer sleeve 33 is closed (sealed to the outside of the sound tube) at position A and open at position B. Addition of the polymer sleeve 33 improves the pumping efficiency of the device in FIG. 85 over that in FIG. 84.

Figure 86:
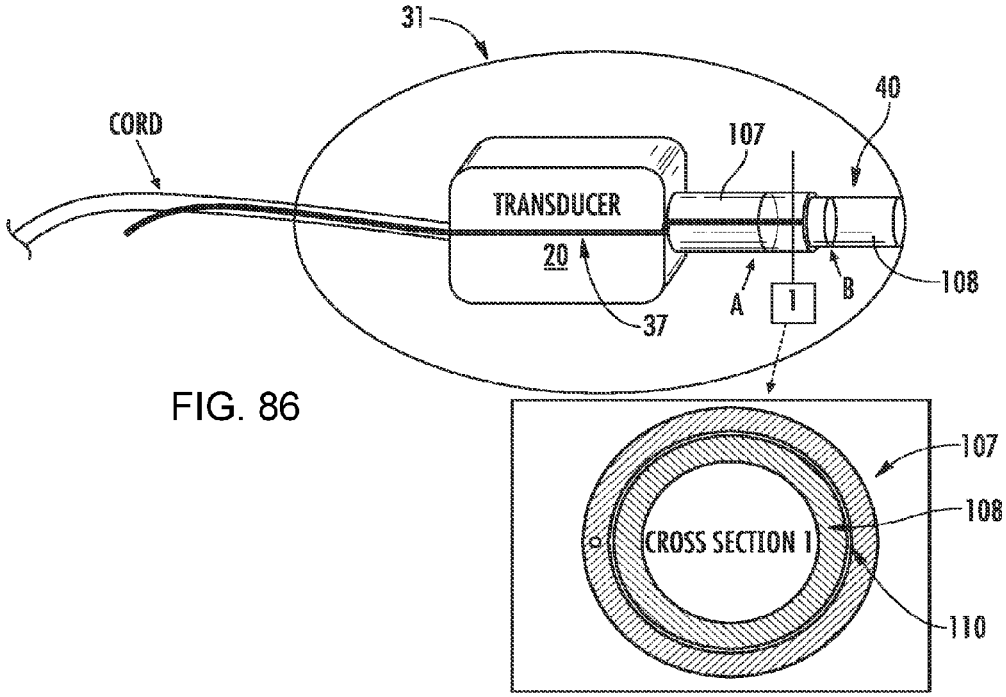
FIG. 86 illustrates a device similar to that shown in FIG. 85, including an air ingress tube.

FIG. 86 shows the addition of an air ingress tube 37 to this embodiment as well. In general any of the air ingress tubing designs previously discussed can be used with this alternative sound tube 40. For example, there may be more than one air ingress tube in the sound tube. The exit point of the air ingress tube in the sound tube may be varied from the position shown in FIG. 86 (in the rim of the outer, larger section of the sound tube) to just about any other position in the gap between the two tubes or on the outer surface of either section of the sound tubes but under the polymer sleeve (between positions A and B).

Figure 87:
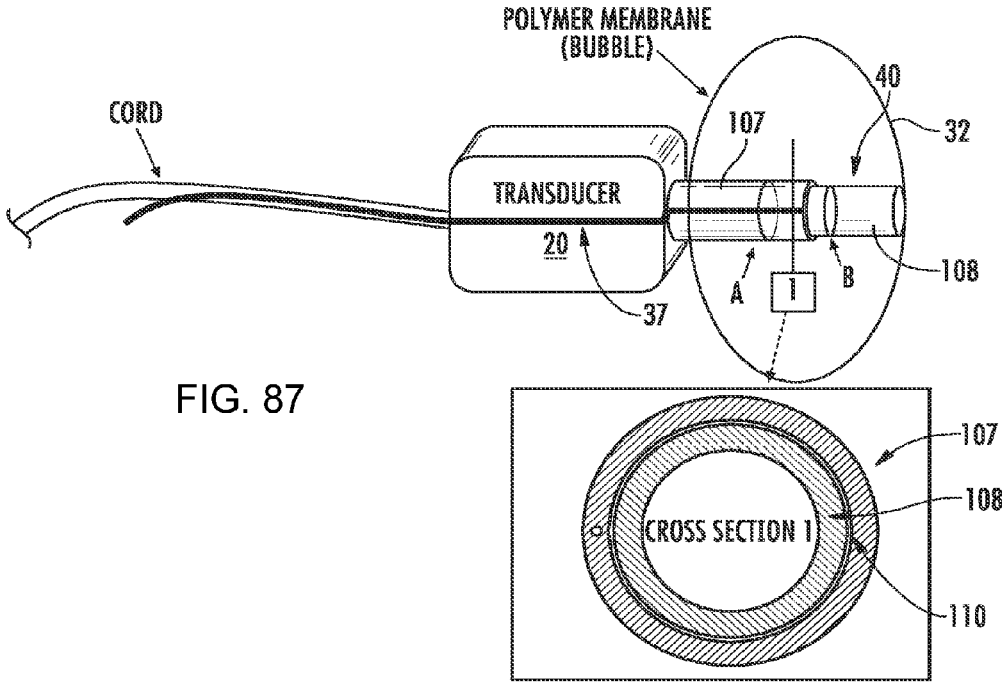
FIG. 87 illustrates a device similar to that shown in FIG. 86 with only the sound tube enclosed within the bubble.

FIG. 87 illustrates that the alternative sound tube 40 can be used with a bubble 31 that does not enclose the transducer 20. The alternative sound tube 40 can also be used with a bubble 31 that partially encloses the transducer (not shown).

FIG. 88 shows that this alternative sound tube 40 can be used with a separable coupling 100 between the bubble 31 and sound tube assembly 40 and the body of the device 10 including the transducer 20. Thus, the alternative embodiment of the sound tube 40 can be incorporated into a removable bubble 31 and sound tube assembly 40. The alternative embodiment of the sound tube 40 can be used in replaceable bubble and sound tube assemblies for listening devices and hearing aids. The alternative embodiment of the sound tube 40 can be used in prescription replaceable bubble and sound tube assemblies for listening devices and hearing aids and can have a color coded or key coded coupling to prevent use of the wrong bubble in the device.

Pressure Release and Safety Devices

Any of a number of methods for venting the pressure in the bubble, either slowly for removal by the user, or rapidly (for example, via a rupture disk-like pressure release valve) as a safety feature to prevent over pressurization of the bubble and potential bursting in the ear are preferably employed for the embodiments of the present invention. Other safety features include a tether on the bubble or bubble and sound tube assembly that allows them to be removed from the ear should they become separated from the in-ear audio device. All of these previously disclosed methods and devices can be applied with the new embodiments described in the present disclosure.

It should be emphasized that the above-described embodiments of the present invention, particularly, any "preferred" embodiments, are possible examples of implementations merely set forth for a clear understanding of the principles for the invention. Many variations and modifications may be made to the above-described embodiment(s) of the invention without substantially departing from the spirit and principles of the invention. All such modifications are intended to be included herein within the scope of this disclosure and the present invention, and protected by the following claims.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of applicants contribution. The actual scope of the protection sought is intended to be defined in the following claims when viewed in their proper perspective based on the prior art.

What is claimed is:

1. A receiver assembly for generating acoustic signals and for inflating a membrane located within an ear canal, comprising:

a first receiver including:

a housing, an inflation port in the housing, a first diaphragm for generating a first acoustic signal in response to a sound-input audio signal during a normal operational mode and a second acoustic signal in response to an inflation audio signal during an inflation mode, a first front volume within the housing for transmitting the generated first and second acoustic signals within the ear canal, and a first back volume within the housing in direct communication with the inflation port and separated from the first front volume by the first diaphragm, the first back volume, during the inflation mode, expelling air through the inflation port for inflating the membrane;

a second receiver including:

a second diaphragm for generating a cancellation acoustic signal in response to a cancellation audio signal during the inflation mode, and a second front volume for transmitting the generated cancellation acoustic signal within the ear canal; and at least one sound port coupled to the first and second receivers and directing the acoustic signals from the first and second front volumes within the ear canal;

wherein, during the inflation mode, the cancellation acoustic signal at least partially cancels the second acoustic signal to reduce a noise effect that is associated with the inflation mode.

2. The receiver assembly of claim 1, wherein the first receiver includes a first valve system coupled to the housing of the first receiver directly adjacent to the inflation port, the first valve system including a plurality of layers to provide a flat configuration to the first valve system, at least one of the plurality of layers defining an egress port, and wherein during the inflation mode, the first valve system expels air through the egress port for inflating the membrane located within the ear canal.

3. The receiver assembly of claim 2, wherein the second receiver includes a second valve system including a second plurality of layers to provide a flat configuration to the second valve system.

4. The receiver assembly of claim 2, wherein a first one of the plurality of layers in the first valve system is a flexible polymeric layer, the flexible polymeric layer including a U-shape cut that defines a valve flap, the valve flap located directly above the inflation port in the housing, and wherein another one of the plurality of layers in the first valve system includes a check valve.

5. The receiver assembly of claim 1, wherein, in the inflation mode, the second acoustic signal produces an inflation tone at an optimum air-pumping frequency for the first receiver.

6. The receiver assembly of claim 5, wherein the inflation tone includes a range of frequencies at about three kilohertz (3 kHz).

7. The receiver assembly of claim 1, wherein the second acoustic signal is 180 degrees out of phase with the cancellation acoustic signal.

8. The receiver assembly of claim 7, wherein the cancellation acoustic signal is substantially matched in amplitude to the second acoustic signal.

9. The receiver assembly of claim 1, further comprising a switching device for switching between the inflation mode and the normal operational mode.

10. The receiver assembly of claim 1, wherein the second receiver has a second housing that attaches to the housing of the first receiver.

11. The receiver assembly of claim 1, wherein the second receiver also produces an acoustic output in response to the sound-input audio signal during the normal operational mode.

12. A method of operating a dual-receiver assembly to cancel an inflation tone generated by a first receiver of the dual-receiver assembly while creating an inflation pressure, the first receiver having a first valve system for expelling air through an egress port to inflate an external inflatable membrane located within the ear canal of a user, the method comprising:

operating the first receiver of the dual-receiver assembly to generate the inflation pressure and create the associated inflation tone;

in response to the operating the first receiver, expelling air through the egress port of the first receiver;

during the operating of the first receiver, operating a second receiver of the dual-receiver assembly to generate a second acoustic signal at least partially out of phase with the inflation tone; and directing the second acoustic wave within the ear canal to thereby interfere with the inflation tone so as to at least partially cancel the inflation tone.

13. The method of operating the dual-receiver assembly of claim 12, wherein the first valve system of the first receiver comprises:

a plurality of layers to provide a flat configuration to the first valve system, at least one of the plurality of layers defining the egress port, and wherein the expelling the air includes passing the air through the plurality of layers of the first valve system.

14. The method of operating the dual-receiver assembly of claim 13, wherein a first one of the plurality of layers in the first valve system is a flexible polymeric layer, the flexible polymeric layer including a U-shape cut that defines a valve flap, the valve flap located directly above an inflation port of the first receiver, and wherein another one of the plurality of layers in the first valve system includes a check valve.

15. The method of operating the dual-receiver assembly of claim 12, wherein the second acoustic signal is substantially matched in amplitude to the inflation tone.

16. The method of operating the dual-receiver assembly of claim 12, wherein the inflation tone is at an optimum air-pumping frequency for the first receiver.

17. The method of operating the dual-receiver assembly of claim 16, wherein the optimum air-pumping frequency includes a range of frequencies at about three kilohertz (3 kHz).

18. The method of operating the dual-receiver assembly of claim 12, wherein the second acoustic signal is 180 degrees out of phase with the inflation tone.

19. The method of operating the dual-receiver assembly of claim 12, further including, operating the first receiver to generate acoustic signals corresponding to ambient sound detected by a microphone electrically coupled to the first receiver.

20. The method of operating the dual-receiver assembly of claim 19, further including, operating the second receiver to generate acoustic signals corresponding to the ambient sound detected by the microphone.

21. A receiver assembly for generating acoustic signals and for inflating a membrane located within an ear canal, comprising:

a first receiver including:

a first diaphragm for generating a first acoustic signal in response to a sound-input audio signal during a normal operational mode and a cancellation acoustic signal in response to a cancellation audio signal during an inflation mode, and a first front volume for transmitting the generated first acoustic signal and the cancellation acoustic signal within the ear canal;

a second receiver including:

a housing, an inflation port in the housing, a second diaphragm for generating a second acoustic signal in response to an inflation audio signal during the inflation mode, a second front volume within the housing for transmitting the generated second acoustic signal within the ear canal, and a second back volume within the housing in direct communication with the inflation port and separated from the second front volume by the second diaphragm, the second back volume, during the inflation mode, expelling air through the inflation port for inflating the membrane; and at least one sound port coupled to the first and second receivers and directing the acoustic signals from the first and second front volumes within the ear canal;

wherein, during the inflation mode, the cancellation acoustic signal at least partially cancels the second acoustic signal to reduce a noise effect that is associated with the inflation mode.

22. The receiver assembly of claim 21, wherein the second receiver includes a valve system coupled to the housing of the second receiver directly adjacent to the inflation port, the valve system including a plurality of layers to provide a flat configuration to the valve system, at least one of the plurality of layers defining an egress port, and wherein during the inflation mode, the valve system expels air through the egress port for inflating the membrane located within the ear canal.

23. The receiver assembly of claim 22, wherein a first one of the plurality of layers in the valve system is a flexible polymeric layer, the flexible polymeric layer including a U-shape cut that defines a valve flap, the valve flap located directly above the inflation port in the housing, and wherein another one of the plurality of layers in the valve system includes a check valve.

* * * * *